US007004847B2

(12) United States Patent
Henry

(10) Patent No.: US 7,004,847 B2
(45) Date of Patent: Feb. 28, 2006

(54) WATER AMUSEMENT SYSTEM AND METHOD

(75) Inventor: Jeffery Wayne Henry, New Braunfels, TX (US)

(73) Assignee: NBGS International, Inc., New Braunfels, TX (US)

( * ) Notice: Subject to any disclaimer, the term of this patent is extended or adjusted under 35 U.S.C. 154(b) by 233 days.

(21) Appl. No.: 10/402,201

(22) Filed: Mar. 28, 2003

(65) Prior Publication Data

US 2003/0190967 A1 Oct. 9, 2003

Related U.S. Application Data

(62) Division of application No. 09/738,109, filed on Dec. 15, 2000, now Pat. No. 6,561,914, which is a division of application No. 09/121,947, filed on Jul. 24, 1998, now Pat. No. 6,261,186.

(51) Int. Cl.
*A63G 31/00* (2006.01)

(52) U.S. Cl. ..... 472/128; 104/69

(58) Field of Classification Search ..... 472/13, 472/44, 45, 116, 117, 128, 129; 104/53, 69, 104/70

See application file for complete search history.

(56) References Cited

U.S. PATENT DOCUMENTS

| | | | | |
|---|---|---|---|---|
| 485,624 A | | 11/1892 | Gardner | |
| 583,121 A | * | 5/1897 | Pattee | 104/77 |
| 604,164 A | | 5/1898 | Wilde et al. | |
| 741,964 A | * | 10/1903 | Harlan | 472/45 |
| 774,209 A | * | 11/1904 | Stubbs | 472/45 |
| 783,425 A | | 2/1905 | Folks | |
| 1,124,950 A | * | 1/1915 | Reagen et al. | 472/13 |
| 1,520,217 A | | 12/1924 | Aupert | |
| 1,609,922 A | | 12/1926 | Wiig | |

(Continued)

FOREIGN PATENT DOCUMENTS

| | | |
|---|---|---|
| BG | 543055 | 12/1955 |
| DE | 129145 | 3/1902 |
| DE | 893778 | 6/1926 |
| DE | 893778 | 10/1953 |
| WO | 97/733668 | 9/1997 |

*Primary Examiner*—Kien Nguyen
(74) *Attorney, Agent, or Firm*—Meyertons, Hood, Kivlin, Kowert & Goetzel, P.C.; Eric B. Meyertons

(57) ABSTRACT

A water amusement system is described which includes a number of different water park rides. The water amusement system may include a water fountain system. The water fountain system includes a roof configured to turn in response to directing a stream of water at the roof. The water amusement system may include a water carousel. The water carousel is a carousel which is configured to float on a body of water. The water amusement system may include a musical fountain system. The musical fountain system is configured to spray water, play music and/or provide visual effects. The water amusement system may include a water powered Ferris wheel. The water amusement system may include a water powered bumper vehicle system. The water powered bumper vehicle system is configured such that the vehicles are preferably propelled by streams of water produced by water nozzles arranged about the water bumper vehicle system. The water system may include a boat ride system. The boat ride system includes a number of boats which are preferably towed by a rotatable base. The boats may also include steering devices and participant interaction devices. The water amusement system may also include a water train system. The water train system is a train system which is propelled by a water propulsion device.

81 Claims, 43 Drawing Sheets

U.S. PATENT DOCUMENTS 1,893,167 A * 1/1933 Glagolin ..... 472/44
1,926,780 A 9/1933 Lippincott
2,484,466 A * 10/1949 Rumler ..... 472/44
2,738,885 A * 3/1956 Demaline ..... 414/250
2,888,205 A 5/1959 Trucco
3,456,943 A * 7/1969 Brown ..... 472/3
3,598,402 A 8/1971 Frenzi
3,830,161 A 8/1974 Bacon
3,853,067 A 12/1974 Bacon
3,923,301 A 12/1975 Myers
4,196,900 A 4/1980 Becker et al.
4,198,043 A 4/1980 Timbes et al.
4,205,785 A 6/1980 Stanley
4,305,117 A 12/1981 Evans
4,376,404 A 3/1983 Haddad
4,392,434 A 7/1983 Durwald et al.
4,501,434 A 2/1985 Dupuis
4,545,574 A 10/1985 Sassak
4,545,583 A 10/1985 Pearman et al.
4,564,190 A 1/1986 Frenzi
4,778,430 A 10/1988 Goldfarb et al.
4,792,260 A 12/1988 Sauerbier
4,805,896 A 2/1989 Moody
4,805,897 A 2/1989 Dubeta
4,817,312 A 4/1989 Fuller et al.
4,836,521 A 6/1989 Barber
4,905,987 A 3/1990 Frenzi
4,954,014 A 9/1990 Sauerbier et al.
4,960,275 A * 10/1990 Magon ..... 472/13
5,011,134 A 4/1991 Langford
5,020,465 A 6/1991 Langford
5,022,588 A 6/1991 Haase
5,069,387 A 12/1991 Alba
5,143,107 A 9/1992 Kelley
5,152,210 A 10/1992 Chen
5,167,321 A 12/1992 Brodrick, Sr.
5,171,101 A 12/1992 Sauerbier et al.
5,194,048 A 3/1993 Briggs
5,213,547 A 5/1993 Lochtefeld
5,224,652 A 7/1993 Kessler
5,230,662 A 7/1993 Langford
5,236,280 A 8/1993 Lochtefeld
5,265,802 A 11/1993 Hobbs et al.
5,271,692 A 12/1993 Lochtefeld
5,393,170 A 2/1995 Lochtefeld
5,401,117 A 3/1995 Lochtefeld
5,421,782 A 6/1995 Lochtefeld
5,437,463 A 8/1995 Fromm
5,439,170 A 8/1995 Dach
5,452,678 A 9/1995 Simpkins
5,453,054 A 9/1995 Langford
5,482,510 A 1/1996 Ishii et al.
5,503,597 A 4/1996 Lochtefeld et al.
5,564,859 A 10/1996 Lochtefeld
5,628,584 A 5/1997 Lochtefeld
5,664,910 A 9/1997 Lochtefeld et al.
5,667,445 A 9/1997 Lochtefeld
5,738,590 A 4/1998 Lochtefeld
5,766,082 A 6/1998 Lochtefeld et al.
5,779,553 A 7/1998 Langford
5,791,254 A 8/1998 Mares et al.
5,820,471 A * 10/1998 Briggs ..... 472/128
6,161,771 A 12/2000 Henry
6,261,186 B1 7/2001 Henry
6,354,955 B1 3/2002 Stuart et al.
6,561,914 B1 5/2003 Henry

* cited by examiner

RIGHT SIDE

FRONT

WATER AMUSEMENT SYSTEM AND METHOD

PRIORITY CLAIM

This application is a divisional of U.S. patent application Ser. No. 09/738,109 entitled "WATER AMUSEMENT SYSTEM AND METHOD" filed Dec. 15, 2000 now U.S. Pat. No. 6,561,914, which is a divisional of U.S. patent application Ser. No. 09/121,947 entitled "WATER AMUSEMENT SYSTEM AND METHOD" filed Jul. 24, 1998 now U.S. Pat. No. 6,261,186.

BACKGROUND OF THE INVENTION

1. Field of the Invention

The present disclosure generally relates to water amusement attractions and rides. More particularly, the disclosure generally relates to a system and method in which participants are actively involved in a water attraction. Further, the disclosure generally relates to water-powered rides.

2. Description of the Relevant Art

Water recreation facilities have become a popular form of entertainment in the past few decades. Conventional water attractions at amusement parks typically involve using gravity to make water rides work, or they involve spraying water to create a fountain. The water rides that use gravity typically involve water flowing from a high elevation to a low elevation along a water ride surface. These gravity induced rides are generally costly to construct, and they usually have a relatively short ride time. Conventional fountains in water parks are generally passive attractions for people because guests of the parks usually cannot control the water flow in these fountains.

One water attraction that allows guests to become more actively involved with water spraying objects is described in U.S. Pat. No. 5,194,048 to Briggs. This attraction relates to an endoskeletal or exoskeletal participatory water play structure whereupon participants can manipulate valves to cause controllable changes in water effects that issue from various water forming devices.

A class of water attraction rides which are not gravity induced has been added to the theme park market. U.S. Pat. No. 5,213,547 to Lochtefeld discloses a method and apparatus for controllably injecting a high velocity of water over a water ride surface. A rider that rides into such injected flow can either be accelerated, matched, or de-accelerated in a downhill, horizontal or uphill straight or curvilinear direction by such injected flow. U.S. Pat. No. 5,503,597 to Lochtefeld et al. discloses a method and apparatus for controllably injecting high velocity jets of water towards a buoyant object to direct buoyant object movement irrespective of the motion of water upon which the buoyant object floats. U.S. Pat. Nos. 5,194,048, 5,213,547 and 5,503,597 are incorporated by reference as if fully set forth herein.

SUMMARY OF THE INVENTION

I. Water Fountain System

A water fountain system is provided, that is a participatory water play system. The water fountain system may have the operational ability to allow changes to water effects by the physical act of manipulating a valve or valves. The water fountain system may include sound and/or light displays that are controllable by physical acts of a participant. Furthermore, the water fountain system may teach participants, especially children, the cause and effect relationship between action (turning a valve) and reaction (water jets causing a roof to spin).

An embodiment of the water fountain system includes a roof having a friction surface. The roof may have the ability to rotate about a vertical axis when a jet of water hits the friction surface. The friction surface may contain a plurality of protrusions (e.g., rib-like members, indentions, or protruding structures) providing a contact surface for receiving the water. The water fountain system preferably includes a support member connected to the roof and to the ground below. A first conduit preferably directs water from a water source to a first nozzle located near the roof For example, the first nozzle may direct a jet of water in a first direction toward the roof to cause the roof to rotate in a substantially clockwise direction. A second conduit preferably directs water to a second nozzle also located near the roof. The second nozzle may then direct a jet of water in a second direction toward the roof to cause the roof to rotate in a substantially opposite, or a counterclockwise direction.

A diverter valve may be disposed upstream from the first conduit and the second conduit. The diverter valve may direct water to one of the first or second conduits while restricting water flow through the other conduit. The valve may be located near the ground so that it may be adjusted by a participant. In a multi-level system the valve may be located on one or more levels of the system. The valve may also be located near the roof A control system may be coupled (e.g., electrically, mechanically, or pneumatically) to the valve. The control system may be manipulated by one or more participants to operate the valve from the ground, or on any other level. Operation of the valve may also cause activation of any combination of the sound and/or lighting system.

II. Water Carousel System

A water carousel system is provided, that is a participatory water play system. The water carousel preferably includes a supporting platform configured to float on water, a propulsion device coupled to the supporting platform, and at least one rotatable shaft for driving the propulsion device with respect to the support platform. The shaft may be connected to participant power mechanisms, such as pedals, wheels, and/or handles, that are operable by participants to drive rotation of the shaft. The supporting platform preferably includes a seating device for holding at least one participant. The seating device is preferably configured to facilitate use of the participant power mechanism by the participant.

In one embodiment, the water carousel system preferably includes a platform configured to float on water, a floor positioned above the platform, and at least one rotatable shaft for driving rotation of the floor about the platform. The rotatable shaft may be coupled to participant power mechanisms that are operable by participants to drive rotation of the shaft. The physical act of powering one or more participant power mechanisms may, in some embodiments, cause the floor of the carousel to rotate about a substantially vertical axis. The participants may control the speed of rotation by varying the amount of power being applied to the participant power mechanisms.

The carousel system preferably includes a roof for providing shade to the participants of the carousel. The roof preferably has a friction surface. In one embodiment, the roof may rotate about a vertical axis when water is directed against the friction surface. An elongated support member preferably forms the vertical axis. The support member may extend from the roof, through the platform, and to the ground where it may be anchored. A valve may be manipulated to force water to contact a roof of the carousel to cause the roof to rotate in a clockwise or counterclockwise direction.

Further, the carousel system may include a sound system for playing music, and/or a light system for displaying lights, that are preferably controlled by the operation of the participant power mechanisms by one or more participants. The rate, volume, pitch, and/or pattern of the sounds produced by the sound system and/or the intensity, and/or pattern of lights produced by the light system are preferably determined by the rate at which the floor is rotated with respect to the platform. Since the rotational rate of the floor is directly proportional to the power applied by the participants to the participant power mechanisms, the participants are able to control the sounds and/or lights produced by the system. In one embodiment, the application of a predetermined amount of power to the participant power mechanism by the participants will preferably produce a musical tune at the proper pitch and/or rate.

The rotatable shaft is preferably located under the floor. One section of the rotatable shaft is preferably adapted to be powered by either arms or legs of a participant. In one embodiment, a portion of the rotatable shaft is shaped to form pedals and/or handles, and may extend upwardly through the floor. Rotation of the rotatable shaft is preferably caused by imparting a force to the pedals and/or the handles. Rotation of the rotatable shaft in turn preferably powers the propulsion device. The propulsion device preferably imparts a rotational force to the floor, such that the floor preferably rotates about the support member in a clockwise or counterclockwise direction. The propulsion device may be a wheel for rotating the floor on top of the platform. The platform may contain a circular track to guide the wheel or wheels as they rotate. The rotatable shaft to which the rotatable member (e.g., a wheel) is connected may be attached to the floor. When the wheel rotates via turning of the rotatable shaft, the floor is preferably forced to rotate with respect to the platform. Moreover, the support member may extend through the floor and may be attached to the platform.

The water carousel system further preferably includes a plurality of seating devices attached to the floor. The seating devices are preferably configured for holding at least one participant such that the participant may operate the participant power mechanism. Each seating device is preferably located near the participant power mechanism so that a participant sitting in the seating device may power the participant power mechanism.

In one embodiment, the sound system may include a mechanical sound device coupled to the support member. The mechanical sound device preferably includes a drum and a plurality of sound producing arms. The drum may have raised points on its outer surface. The arms are preferably attached to the floor. When the floor rotates, the arms may move about the drum, allowing the raised points to contact selected arms. Each arm preferably creates a different musical note upon being struck by a raised point, so the drum and arms may function as a "music box".

In another embodiment, the sound system is preferably controlled by a musical control unit. The musical control unit is preferably configured to impart electronic signals to the sound system in response to the movement of the floor. The musical control unit preferably includes a sensor for determining the rotational speed of the floor. As the floor of the carousel is rotated, the rotational speed of the floor is measured by the sensor and relayed to the music control unit. The music control unit is preferably configured to vary the rate and/or pitch of the music being produced by the sound system as a function of the rotational speed of the floor.

In another embodiment, a water carousel system preferably includes a floor configured to float on water. In place of a support platform, at least one flotation member may be attached to the floor. The carousel additionally includes a propulsion device coupled to the support member, and at least one rotatable shaft for driving rotation of the rotatable member with respect to the water. The rotatable shaft may be coupled to participant power mechanisms that are operable by participants to drive rotation of the shaft. The physical act of powering one or more participant power mechanisms may cause the floor of the carousel to rotate along the surface of the water about a substantially vertical axis. The participants may control the speed of rotation by varying the amount of power being applied to the participant power mechanisms.

In one embodiment, the rotatable member of the water carousel system is a water propulsion device, which preferably extends into the water. Examples of water propulsion devices include, but are not limited to, paddles, paddle wheels, and propellers. Rotation of the rotatable shaft preferably causes the water propulsion device to rotate such that a rotational force is imparted to the floor.

III. Musical Water Fountain System

A musical water fountain system is provided that is a participatory water play system. In an embodiment, the musical water fountain system includes a sound system for playing one or more musical notes, a fountain system for spraying water, a light system for displaying lights, and a plurality of activation points for activating the sound system, the fountain system, and/or the light system.

The act of applying a participant signal to the activation points preferably causes one or more of the following: a sequence of music notes is produced, water is sprayed from one or more fountains, and lights are activated. A participant signal may be applied by the application of pressure, a gesture (e.g., waving a hand in front of a motion sensor), or voice activation. The activation points are configured to respond to the applied participant signal. The activation points are preferably coupled to a control system. The activation points may be located on instruments. The activation points preferably sense the participant signal applied by the participant(s) and send a first signal to the sound system, a second signal to the fountain system, and/or a third signal to the light system. The sound system may respond by playing a musical note. The fountain system may respond by spraying water in the air to create a fountain effect. The light system may respond by turning on lights within a light display located near the fountain system.

The musical water fountain system preferably provides participants with a visual, audio, or tactile indication at a predetermined time to alert the participants to apply a participant signal to a specific activation point. A conductor may be used to provide the indication to the participants. The conductor may be an individual who motions to selected participants at predetermined times. The conductor may also be an image projected on a screen that is visible by the participants. Alternately, an electrical indication may be provided to the participants. For instance, a light, sound, or tactile signal may be activated to indicate the participants to apply a participant signal to the activation points.

In an alternate embodiment, the instruments may produce the musical notes and the sound system may enhance the musical notes by increasing their volume and/or by synthesizing musical sounds or sound effects. Instruments which may be included in the water fountain system include, but are not limited to, keyboard instruments (e.g., a piano), percussion instruments (e.g., a drum set), brass instruments (e.g., a trumpet), guitars (e.g., an electric guitar), string instruments (e.g., a violin), woodwind instruments (e.g., a saxophone), and electronically generated sounds (whistles, animal noises, etc.). The instruments of the water fountain system are preferably played via applying a participant signal to an activation point located on or in the vicinity of the instrument. For example, the activation points of a piano may be on the keys of the piano, and the activation points of a drum set may be located on top of each drum. In one embodiment, the instruments may be large enough to hold participants. The instrument may be played by standing on a pressure sensitive activation point.

In one embodiment, a musical fountain may include a group of different instruments. Each of the instruments may be activated by applying a participant signal to an activation point. A conductor may be used to indicate the activation of the instruments or of specific notes of the instruments. A group of participants may respond to the conductor's signals such that a musical tune is produced. By cooperatively participating with the fountain the participants may create sounds and visual effects which are pleasant to both the participants and spectators.

In another embodiment, an "orchestra" of fountains may be used to produce a musical tune. A series of fountains may be arranged about a centrally positioned conductor. The conductor may indicate to the participants to activate their musical fountain at predetermined times. The cooperative effort of the participants may create a musical tune by playing each of the individual fountains at the appropriate times.

IV. Water Ferris Wheel System

A water Ferris wheel system is provided that includes a water based power system. The water based power system is preferably coupled to a rotation mechanism of the Ferris wheel. Passage of a water stream through the water based power system preferably causes rotation of the Ferris wheel.

The Ferris wheel preferably includes a central axle member, and a support member coupled to the central axis member. Seating devices for holding passengers are preferably connected to the support member via axle members. The seating devices may rotate about the axle members so that they remain in an upright position as the support member spins in a substantially vertical plane. Water interaction devices are preferably coupled to the support member of the Ferris wheel.

The water interaction devices may be receptacles configured to hold water, paddles configured to interact with water, or a combination of receptacles and paddles. The water interaction devices are preferably configured to cause rotation of the support member when the water interaction devices are contacted with a water stream. A base support structure is preferably attached to the central axle member to elevate the support member above the ground. The base support structure may be composed of members which are affixed to the ground.

The Ferris wheel further includes a water source for supplying a water stream to the water interaction devices. The rate of rotation of the support member may be a function of the flow rate of the water to the water interaction devices. To achieve a slow rate of rotation a relatively slow flow of water may be selected. Increasing the rate of water preferably increases the force imparted by the water on the water interaction devices, increasing the rotational speed of the support member.

The Ferris wheel system preferably includes a braking system to control the position at which the support member stops rotating. The brake system preferably imparts a force sufficient to inhibit rotation of support member while water is directed at the water interaction devices. The use of a braking system in this manner, facilitates the transfer of participants to and from the Ferris wheel.

A conduit is preferably located near the Ferris wheel that serves as a water source to the Ferris wheel system. The conduit preferably includes a valve and a pump. Water is preferably forced by the pump through the conduit. The conduit preferably directs water to the water interaction devices. In one embodiment, the conduit delivers water to water interaction devices at a position substantially above the central axle member. Preferably, the conduit delivers water at a position approximately level with the central axle member. By positioning the conduit approximately level with the central axle member, a tangential stream of water may be delivered to the water interaction devices in a position which minimizes the amount of water reaching seating devices. Alternatively, the conduit may conduct a water stream below the support member of the Ferris wheel. The water interaction devices preferably extend out from the support member such that the water interaction devices along the bottom portion of the support member interact with the water stream.

In one embodiment, the water interaction devices are preferably composed of water receptacles. The receptacles may be any container that can hold a large amount of water. The receptacles preferably hold enough water to initiate rotation of the support member about the central axle member. Preferably, the volume of at least one of the receptacles is greater than that of at least one of the seating devices.

In one embodiment, the Ferris wheel system may further include a reservoir located on the ground below the Ferris wheel. The reservoir may collect water falling from the conduit, forming a pool. Water falling into the reservoir may be recycled back to the apex and through the conduit.

In an embodiment, the water interaction devices may be attached to some or all of the seating devices. Alternately, the seating device itself may also be a water interaction device.

The above described embodiments may be configured such that the passengers remain substantially dry or become substantially wet during the ride. In one embodiment, the seats are preferably configured to inhibit water from reaching the participants. Seating devices may include a roof configured to redirect any water falling onto the roof away from the seating device. The flow of water falling upon the roof is preferably directed into the reservoir pool for reuse.

In another embodiment, the seating devices may be configured to allow the participants to become substantially wet. In one embodiment, the seating devices are opened ended (i.e., do not have a roof). As the seating devices pass by the conduit, water may fall into the seating devices, causing the passengers to become substantially wet. The seating devices preferably include slots to allow the incoming water to be removed from the seating devices.

In another embodiment, the Ferris wheel may be propelled by a stream of water formed underneath the Ferris wheel. The Ferris wheel includes a number of seating devices located about a support member, as described above. Water interaction devices preferably extend from the support member in a direction away from the central axle member. A stream of water preferably runs below a bottom portion of the support member. Water interaction devices are preferably positioned about an outer edge of support member such that the water interaction devices which are at a bottom portion of the support member are partially inserted within the water stream. The support member is preferably rotated by causing a current to be formed in the water stream. As the water stream passes under the support member, the water contacts water interaction devices causing the support member to begin to rotate.

V. Water-Powered Bumper Vehicle System

A water-powered bumper vehicle system is provided that preferably includes a plurality of vehicles for holding participants, a plurality of nozzles, a pressurized water source for delivering water to the nozzles, and a valve for controlling water flow through one or more of the nozzles.

In an embodiment, the plurality of nozzles are positioned in different directions and are capable of directing water towards the vehicles to cause water-to-object momentum such that the vehicles move in different directions. A pressurized water source may deliver water to the nozzles. One or more valves connected to the nozzles preferably restrict water flow through at least one of the nozzles while permitting water flow through at least one of the nozzles to contact the vehicles. The nozzles are preferably positioned to move the water bumper vehicles in directions such that they contact each other.

In an embodiment, the plurality of nozzles are included in a nozzle assembly. The nozzle assembly may contain a valve configured to selectively restrict water flow through one or more of the nozzles while allowing water flow through one or more of the nozzles. The valve may be used to direct substantially discontinuous pulses of water from the nozzles toward the vehicles. The valve may be coupled to a control system for controlling water flow through the nozzles. The control system may be programmed such that water is directed from the nozzles in a random or predetermined sequence.

Sensors may be placed at different positions around the water bumper vehicle system. Preferably, sensors are placed upon the nozzle assembly. Sensors are preferably configured to detect when a vehicle is approaching a nozzle assembly. Sensors may be configured to detect contact between the nozzle assembly and a vehicle or the sensors may be configured to determine if a vehicle is close to a nozzle assembly. When the sensor detects the presence of a vehicle, the sensor preferably sends a signal to the control system which responds by activating a nozzle assembly.

Water sprayers may be positioned around the water bumper vehicle system. Preferably, the water sprayers may be used to spray participants with water. Water sprayers may also be coupled to the control system. The control system may be programmed such that water from the water sprayers is produced in a random sequence or at pre-determined times. Alternately, the water sprayers may be coupled to the sensors. When a vehicle is detected by a sensor, the sensor may turn on a water sprayer near the sensor such that the participants become wet.

In another embodiment, the control system may be coupled to participant activation devices located in each vehicle. Each of the participant activation devices may include a series of activation points, which are activated in response to a signal from the participant. Activation points may be used to control the nozzles and/or the water sprayers.

In one embodiment, the vehicles are preferably configured to float within a pool. The boundaries of the pool are defined by the retaining walls configured to hold the water of the pool. A plurality of nozzle assemblies are preferably arranged about the retaining wall. The nozzle assemblies preferably direct pulses of water toward the vehicles to propel the vehicles across a portion of the pool. Additional nozzle assemblies may be present within the pool. The nozzle assemblies may be floating or may be coupled to the bottom of the pool.

The vehicles may also include a steering system for allowing a participant to control the direction of travel of the vehicle. Preferably the steering system includes a steering device coupled to a handle or wheel. Movement of the steering device preferably alters the coarse of the vehicle while the vehicle is moving. The use of a steering system may allow a participant to control the direction that the vehicle travels over the water surface.

In another embodiment, the vehicles may be sitting upon a substantially smooth floor surrounded by a wall. Nozzle assemblies are preferably located at various locations on top of the floor. They are preferably spaced apart at a distance which allows the vehicles to pass between them. Vehicles may be propelled by the nozzle assemblies to move across the floor in different directions. Preferably, only a small amount of friction exists between the vehicles and the floor so that the vehicles may slide across the floor.

In another embodiment, the vehicles may be moved toward an exit zone after a predetermined amount of time. At this time, the nozzle assemblies may be programmed to guide the vehicles into the exit zone. The exit zone is preferably configured to allow a participant to leave and/or enter the vehicle.

VI. Boat Ride System

A boat ride system is provided that is a participatory play system. The boat ride system preferably includes a boat for holding a plurality of participants, an elongated member for pulling the boat in a substantially circular path, and a motor for rotating the elongated member.

In an embodiment, the boat includes one or more (preferably three) hydrofoils for raising the hull of the boat above the water level. The boat is preferably maneuverable by a participant. The hydrofoils may be adapted to move to steer the boat. Alternately, the boat may include a rudder that is operable by a participant. The boat is preferably pulled about a central axis by an elongated member powered by the motor. The boat may be connected to the elongated member with a substantially flexible tow strap having a sufficient length to allow the boat to be laterally maneuvered.

In an embodiment, participant interaction devices are preferably located on the boat. Participant interaction devices preferably include any device that allows participants to interact with targets and/or other participants and/or spectators. Examples of participant interaction devices include, but are not limited to electronic guns for producing electromagnetic radiation, water based guns for producing pulses of water, and paintball guns. Participants may operate the participant interaction devices as the boat is moving as part of a game. The participant interaction devices may be directed at targets. Targets may be positioned on the base, floating in the body of water, positioned on the perimeter of the body of water, positioned on other boats and/or or positioned on the participants and/or spectators. Participant interaction devices may be fired to send a projectile at a boat or target. A projectile as used herein is meant to refer to a beam of electromagnetic radiation, water, a paint ball, a foam object, a water balloon, or any other relatively non-harmful object that may be thrown from a participant interaction device. Participant interaction devices may also be located around the perimeter of the body of water to allow spectators to fire projectiles at the boats. The participants and/or spectators may be equipped with eye protection and other safety devices to protect participants and/or spectators from the projectiles.

In an embodiment, the participant interaction devices may include electronic guns for emitting electromagnetic beams toward at least one target. The target preferably includes a receiver adapted to sense the electromagnetic beams emitted from the electronic gun(s). The boat ride system may include an electronic scoring system for counting the number of times that a target is struck by an electronic beam. In an embodiment, the electronic gun becomes activated when the boat reaches a minimum predetermined speed. A sensor may be used to sense the height of the hull above the water. The electronic gun may be activated when the hull reaches a predetermined height above the water.

In another embodiment, the participant interaction devices may include water gun systems. The water gun systems are configured to fire a pulse of water when a trigger is depressed. The water guns may allow participants to fire pulses of water from the boat toward targets and/or other boats. Participants may use the water guns to wet participants on other boats and/or spectators surrounding the body of water. Additionally, the targets may be configured to respond to a blast of water. Targets may be electronically coupled to a scoring system.

VII. Water Train Ride System

A water train ride system is provided that preferably includes a train that is adapted to float on water and a trough adapted to contain water. The train preferably includes a plurality of train cars for holding participants and a propulsion system for moving the train through the water. The trough preferably includes a guide adapted to engage the train to maintain it within the trough as it moves through the water.

In an embodiment, the jet propulsion system includes a rotatable impeller and may be housed in an engine car. The engine car is preferably adapted to propel the train cars in a substantially wake free environment for the comfort of the participants. The engine car may include a steam generator and a whistle to give the appearance of a steam locomotive. The train is preferably used to transport participants to various locations in a water park.

The trough may be located on ground or underwater. The guide of the trough may include elongated members located on opposite sides of the trough or on the bottom of the trough. The elongated members preferably extend into grooves formed in the train.

VIII. Amusement Park System

An amusement park system is provided that comprises a number of water based rides. The amusement park system may be a "wet park" in which some or all of the participants become substantially wet during the rides. In another embodiment, the amusement park system may be a combination of a "wet park" and a "dry park". A "dry park" is a park system in which some or all of the participants remain substantially dry during the rides.

The amusement park system preferably includes a water fountain system and/or a water carousel system and/or a musical water fountain system. The amusement park system may also include any combination of a water Ferris wheel system, a water bumper vehicle system, a boat ride system, and a water train system. Other rides which may be found in a wet or dry park may also be present.

Each of the inventions I–VIII discussed above may be used individually or combined with any one or more of the other inventions.

BRIEF DESCRIPTION OF THE DRAWINGS

Other objects and advantages of the invention will become apparent upon reading the following detailed description and upon reference to the accompanying drawings in which.

Figure 1:
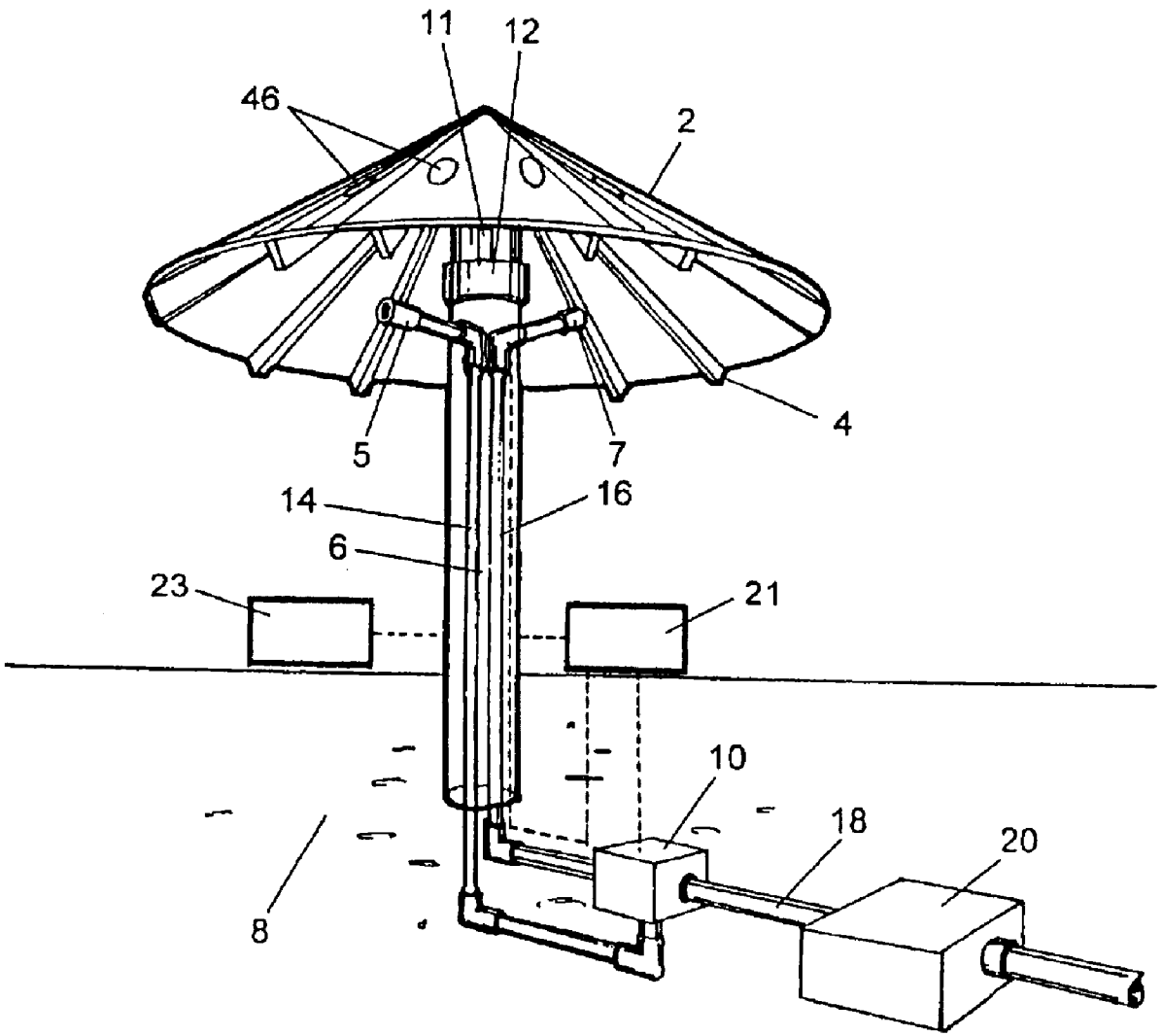
FIG. 1 is a perspective view of one embodiment of a water fountain system having an exoskeletal support member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

I. Water Fountain System

Turning to FIG. 1, one embodiment of a water fountain system for participatory play is illustrated. The water fountain system preferably includes a roof 2 which may have protruding members or protrusions 4 attached to its lower surface. A bearing 12 preferably allows roof 2 to rotate about a substantially vertical axis. Bearing 12 can instead be a bushing. Roof 2 preferably includes a lip 11 which may be a cylindrically-shaped shell. Lip 11 preferably extends vertically from the bottom of roof 2. Lip 11 is preferably seated within bearing 12 and may rotate in a substantially clockwise direction or a substantially counterclockwise direction. The rotation of lip 11 is facilitated because there is preferably little or no friction between the outer surface of lip 11 and the inner portion of bearing 12. In an alternate embodiment lip 11 contains a bearing on its inner surface that substantially surrounds the upper end of support member 6.

An elongated support member 6 preferably supports roof 2, and support member 6 preferably extends from reservoir 8 to roof bearing 12. Reservoir 8 preferably holds water used in the water fountain system. As depicted in FIG. 1, support member 6 may be an "exoskeletal" support member whereby a first conduit 14 and a second conduit 16 are mounted to support member 6 for conveying water to roof 2. Conduits 14 and 16 may be mounted on an inner surface of support member 6 (as depicted in FIG. 1) or on an outer surface of the support member. A first nozzle 5 is preferably attached to first conduit 14, and a second nozzle 7 is preferably attached to second conduit 16. First nozzle 5 may direct a jet of water to the lower surface of roof 2 such that roof 2 rotates about support member 6 in a clockwise direction (as viewed from above roof 2). Second nozzle 7 may direct a jet of water to another portion of the lower surface of roof 2 such that roof 2 rotates in a counterclockwise direction (as viewed from above roof 2).

As described herein, a "protrusion" is taken to mean any feature located on the roof that is configured to increase friction between the roof and water that is directed toward the roof. Protrusions 4 may cause the surface of roof 2 to be uneven. Protrusions 4 may be protruding structures or indented portions of roof 2 that facilitate rotation of the roof by providing a contact surface for water directed at the roof. Protrusions 4 are preferably rib-like support members. As described herein, a "friction surface" is taken to mean any surface that is configured to provide substantial resistance to a stream of water. Preferably an upper and/or lower surface of roof 2 is composed of a friction surface such that the roof may be contacted by water to cause rotation of the roof. The friction surface preferably includes protrusions 4.

A third conduit 18 is preferably connected to first conduit 14 and second conduit 16 to supply water to the first and second conduits. Valve 10 is preferably located at a junction where the third conduit is attached to the first and second conduits. Valve 10 is preferably a diverter valve which controls water flow to either first conduit 14 or second conduit 16. Valve 10 may be located at any point on or before nozzles 5 and/or 7. Third conduit 18 preferably extends into reservoir 8 to a location below the water level in the reservoir. Pump 20 is preferably disposed within third conduit 18 to force water from the reservoir through the conduits. If valve 10 is adjusted to direct water from third conduit 18 to first conduit 14, water is preferably pumped to nozzle 5. Nozzle 5 then preferably directs a jet of water in a first direction at the bottom of roof 2, which causes the roof to rotate in a clockwise direction. If instead valve 10 is adjusted to direct water to second conduit 16, nozzle 7 preferably directs a jet of water in a second direction to the bottom of roof 2. This jet of water preferably causes roof 2 to rotate in a counterclockwise direction. When water hits roof 2, it is preferably directed off in droplets to create a visual fountain effect. The water preferably passes from the roof back into reservoir 8 so that it may be recycled through the water fountain system.

In any of the embodiments described herein, "nozzle 5" and "nozzle 7" may each include multiple (i.e., one or more) nozzles.

Roof 2 is preferably composed of fiberglass, but it may also be made out of metal, plastic, or any other suitable material. Roof 2 may be substantially flat or it may be non-planar. Roof 2 may have a shape that resembles a figure such as, for example, a square, a circle, a triangle, a cone, a sphere, an umbrella, a pyramid, an animal, an insect, a plant, a dinosaur, a space ship, an inner tube, a boat, an auto, an airplane, etc. First conduit 14, second conduit 16, and third conduit 18 may be made of, for example, PVC, polyethylene, or galvanized steel pipes.

Figure 2:
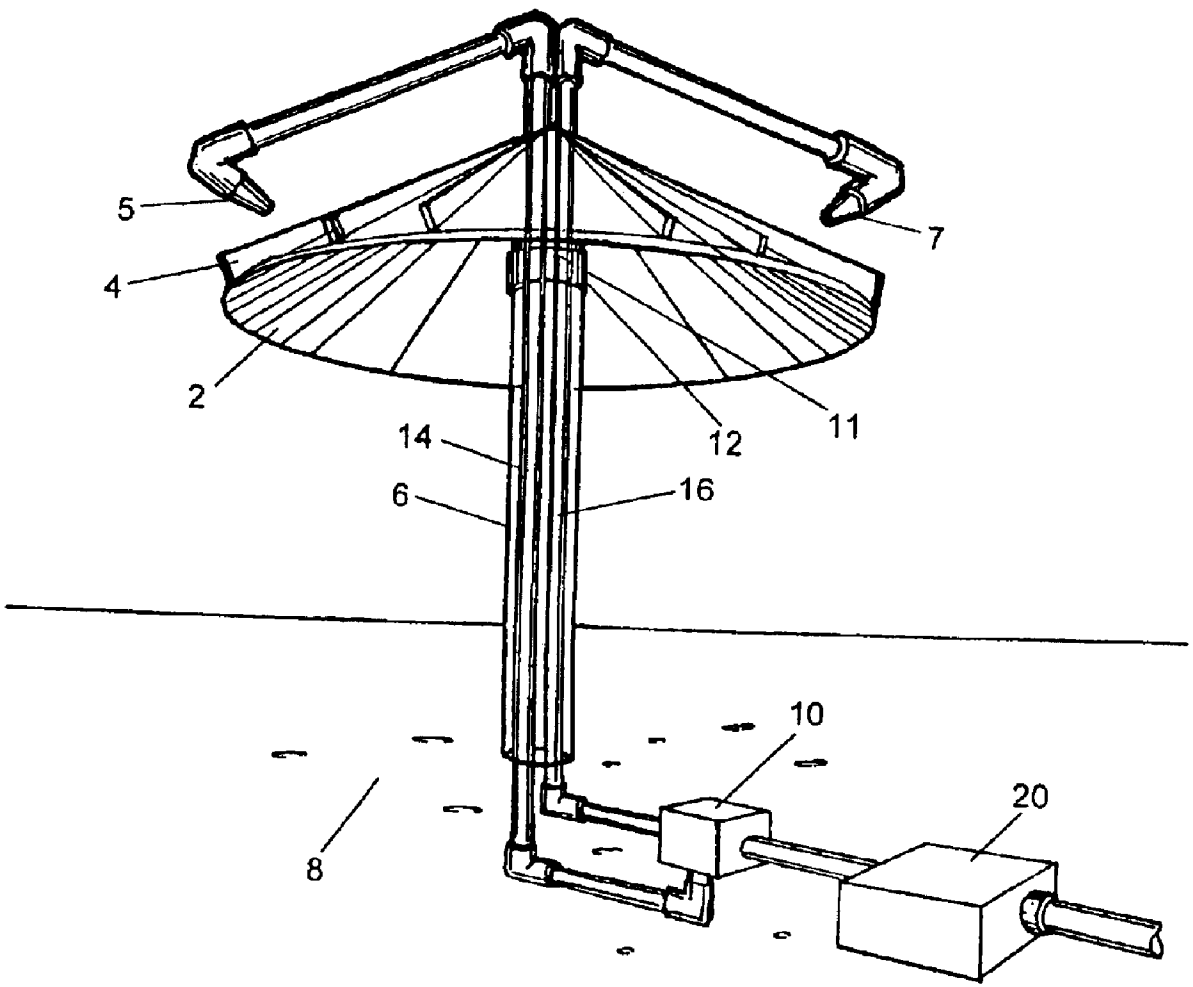
FIG. 2 is a perspective view of one embodiment of a water fountain system having an endoskeletal support member.

Turning to FIG. 2, another embodiment is presented that is similar to the embodiment of FIG. 1. The water fountain system preferably includes the same components as the water fountain system mentioned above. However, first conduit 14 and second conduit 16 preferably extend upwardly through an opening in roof 2 so that the nozzles are positioned above roof 2. The opening in roof 2 is preferably located substantially in the center of lip 1. First nozzle 5 may then direct water in a first direction at the upper surface of roof 2 to cause roof 2 to rotate in a clockwise direction. Roof 2 may have protrusions 4 located on its upper surface to create a friction surface for receiving water. Second nozzle 7 may direct water at the upper surface of roof 2 in a second direction to cause roof 2 to rotate in a counterclockwise direction. First and second nozzles 5 and 7 may be located at any point of the conduits 14 and 16 (e.g., near the center of roof 2, near the edge of roof 2, or any point between).

Figure 3:
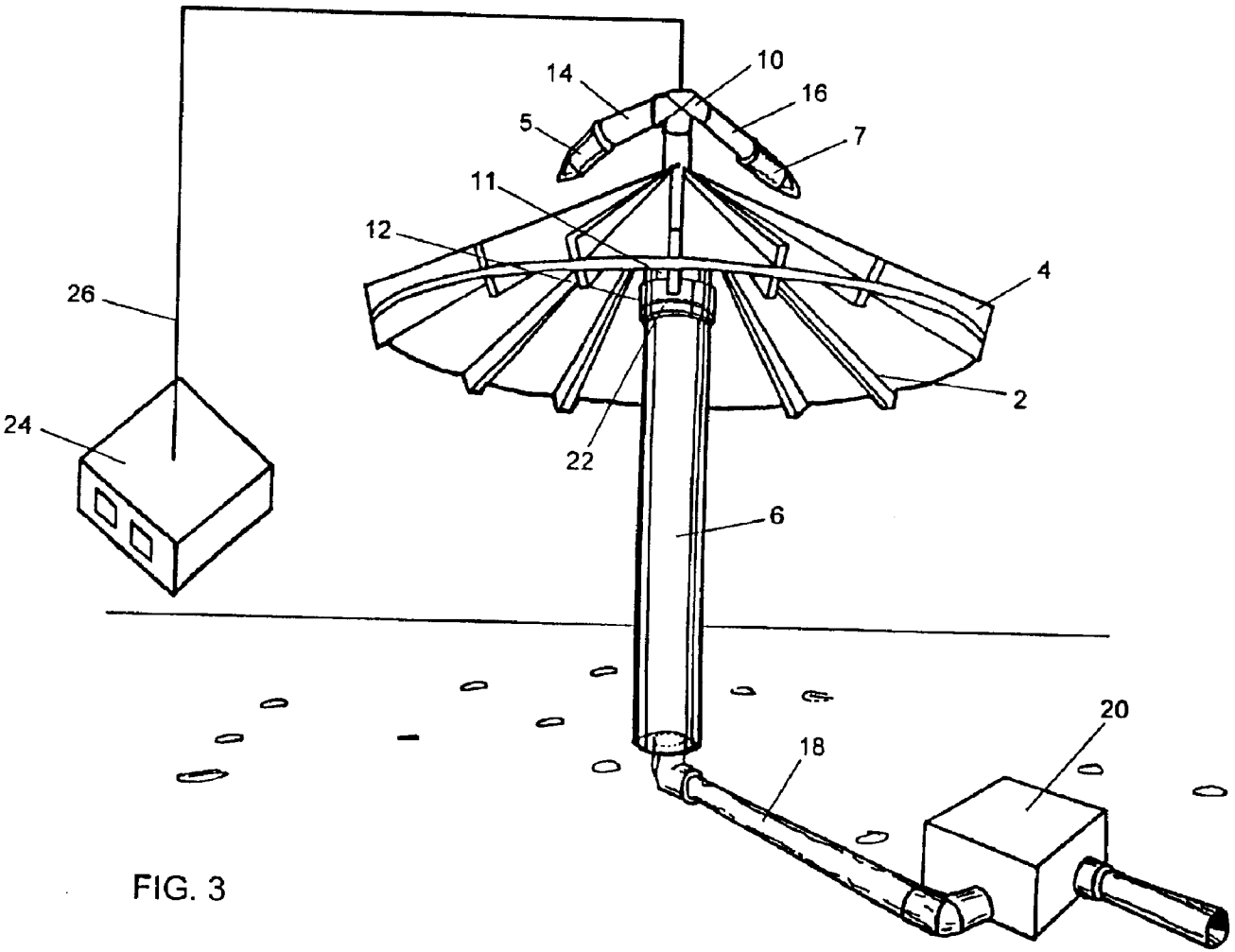
FIG. 3 is a perspective view of one embodiment of a water fountain system having an endoskeletal support member.

FIG. 3 depicts an embodiment of a water fountain system in which support member 6 is an "endoskeletal" support member. An "endoskeletal" support member is one which serves as both a support member and a conduit for passing water to roof 2. In FIG. 3, support member 6 coincides with a portion of third conduit 18. Third conduit 18 preferably extends upwardly through an opening in the roof located inside of lip 11. A ring 22 is preferably attached about third conduit 18 underneath bearing 12 to mount bearing 12 to third conduit 18. Valve 10, first conduit 14, second conduit 16, first nozzle 5, and second nozzle 7 are preferably located above roof 2. Protrusions 4 may be located on the upper surface of roof 2 to form a friction surface at which water may be directed to cause roof 2 to spin. Components of this embodiment preferably perform the same functions as previously discussed. However, valve 10 is preferably controlled from the ground using a control system 24. Control system 24 may be operated electrically, mechanically, hydraulically, or pneumatically. Signal lines 26 that preferably contain electrical signals, liquid signals, or air, may connect valve 10 to control system 24. Such signal lines 26 may pass through or outside of support member 6. Control system 24 may be controlled by simply depressing buttons to cause water to flow through either first conduit 14 or second conduit 16.

Figure 4:
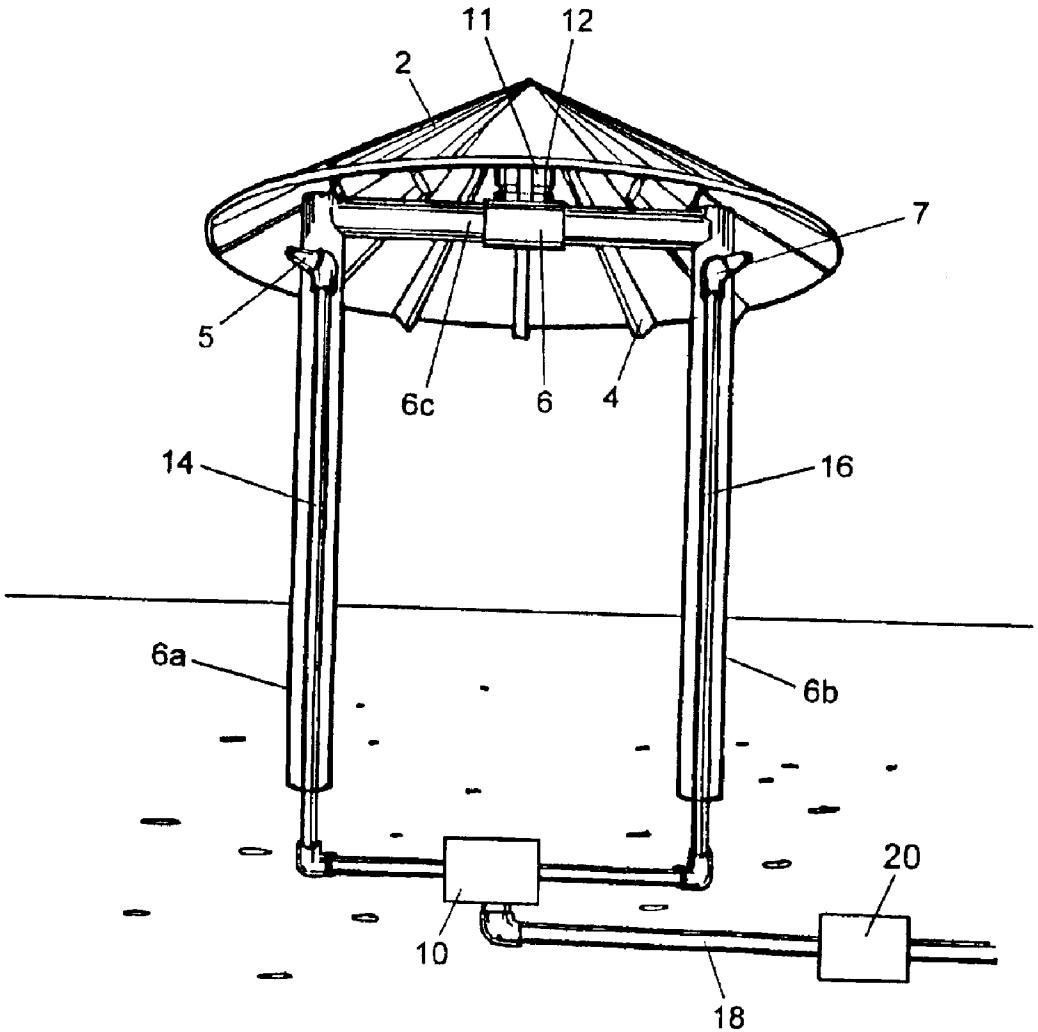
FIG. 4 is a perspective view of one embodiment of a water fountain system having an exoskeletal support member.

FIG. 4 illustrates another embodiment of a water fountain system in which support member 6 is an exoskeletal support member. All of the components of this embodiment preferably have the same functions as previously discussed. Support member 6 preferably has three members. First member 6*a* and second member 6*b* are preferably substantially parallel to one another. They are preferably connected to reservoir 8 at their bottom ends. They preferably extend upwardly to an elevational level below roof 2. Third member 6*c* preferably connects the upper end of first member 6*a* to the upper end of second member 6*b*. Third member 6*c* is preferably substantially perpendicular to members 6*a* and 6*b*. Third member 6*c* is preferably connected to bearing 12. First conduit 14 is preferably mounted to first member 6*a*, and first nozzle 5 is preferably connected to first conduit 14 near the upper end of first member 6*a*. Second conduit 16 is preferably mounted to second member 6*b*, and second nozzle 7 is preferably connected to second conduit 16 near the upper end of second member 6*b*. Roof 2 may have protrusions 4 located on its lower surface to form a friction surface thereon. Third conduit 18 preferably extends from within the water of reservoir 8 to valve 10.

Figure 5:
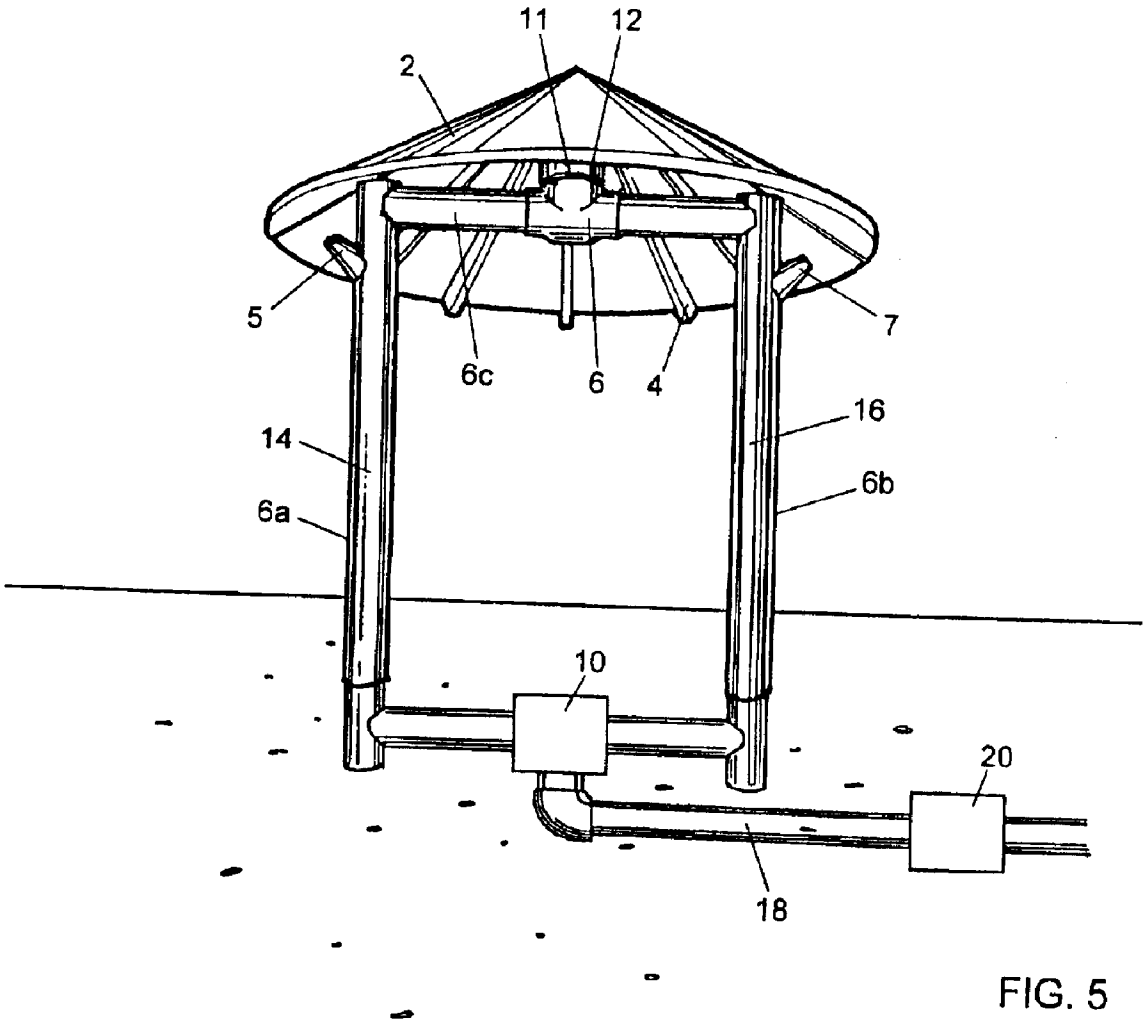
FIG. 5 is a perspective view of one embodiment of a water fountain system having an endoskeletal support member.

FIG. 5 depicts another embodiment of a water fountain system in which support member 6 is an endoskeletal support member. Support member 6 preferably has three members arranged as in FIG. 4 and discussed above. First member 6*a*, however, preferably forms a portion of first conduit 14. That is, water may pass through a section of first member 6*a*. First conduit 14 preferably extends from first member 6*a* toward the roof so that first nozzle 5 may direct water to the lower surface of roof 2. Furthermore, second member 6*b* preferably forms a portion of second conduit 16. Second conduit 16 may extend toward roof 2 from second member 6*b* so that second nozzle 7 can direct water toward the lower surface of the roof. Protrusions 4 may be located on the bottom of roof 2 to form a friction service for receiving water to cause roof 2 to rotate.

Figure 6:
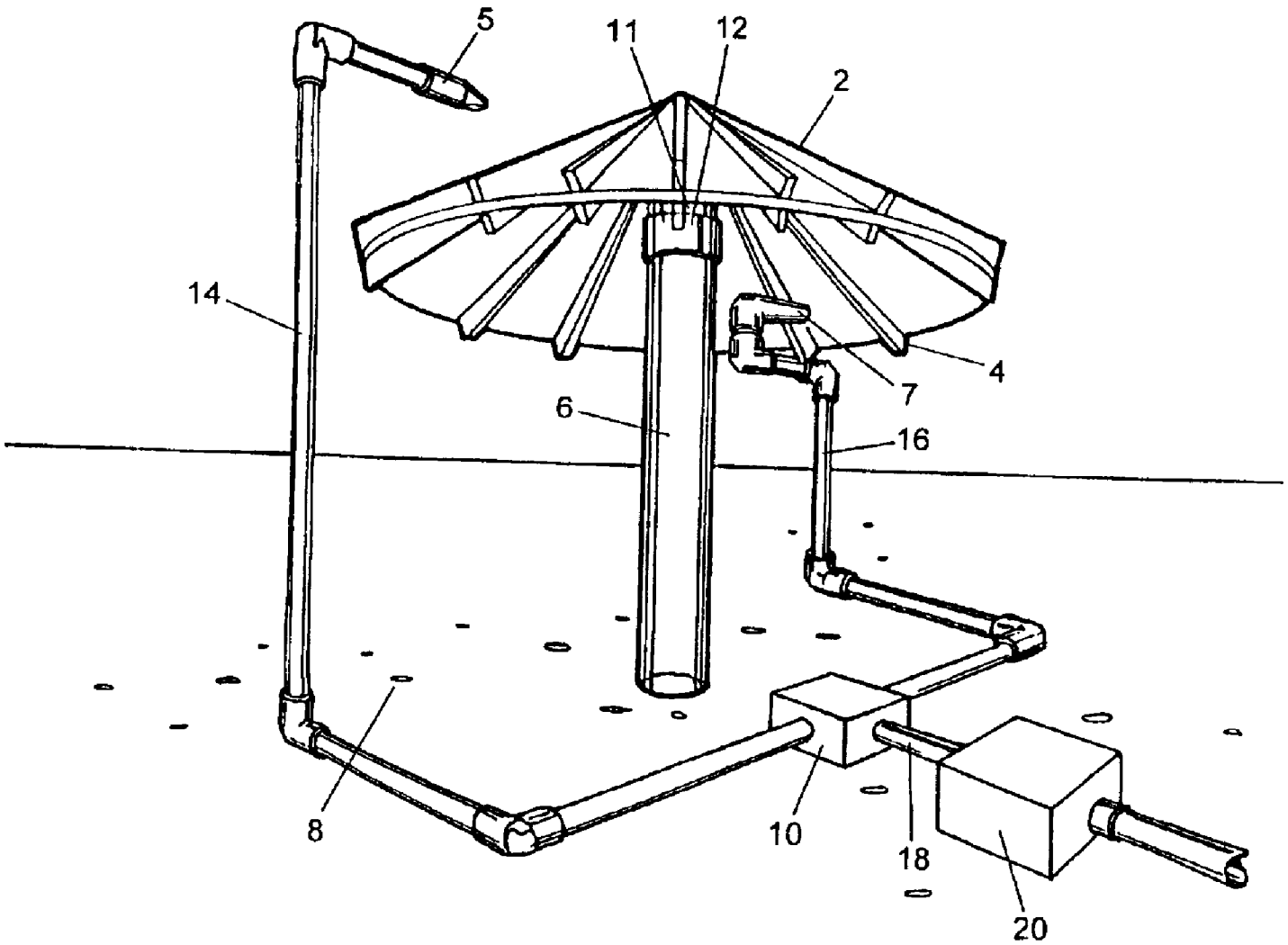
FIG. 6 is a perspective view of one embodiment of a water fountain system having an exoskeletal support member.

FIG. 6 depicts an embodiment of a water fountain system in which support member 6 is an exoskeletal support member. The components of the water fountain system preferably have the same functions as discussed previously. Conduits 14 and 16 may be separated from support member 6. Protrusions 4 may be located on both the upper surface and the lower surface of roof 2 to form a friction surface on both the top and the bottom of roof 2. Conduits 14 and 16 preferably extend upwardly on opposite sides of support member 6 to carry water to the roof. Conduit 14 may extend to an elevational level above roof 2 so that nozzle 5 may direct water at the top of roof 2. Conduit 16 may extend to an elevational level underneath roof 2 so that nozzle 7 may direct water at the bottom of roof 2. Nozzles 5 and 7 may be positioned to simultaneously direct water at the roof to rotate the roof in one direction. In an alternate embodiment, nozzles 5 and 7 direct water toward the roof at different times, whereby nozzle 5 is positioned to cause the roof to rotate in either a clockwise or counterclockwise direction, and nozzle 7 is positioned to cause the roof to rotate in a direction opposite to the rotational direction of the roof when nozzle 5 is used.

Figure 7:
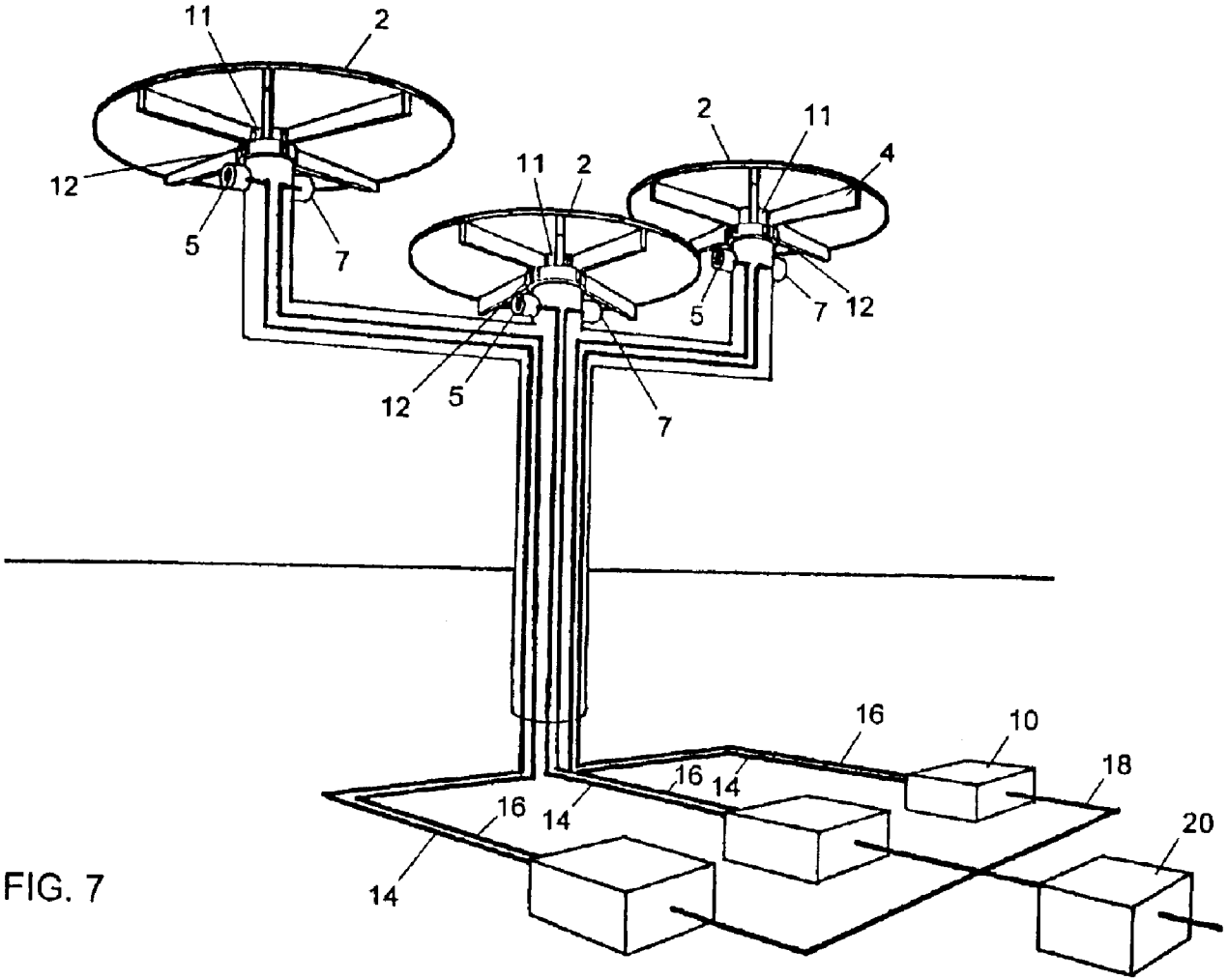
FIG. 7 is a cross-sectional plan view of one embodiment of a water fountain system having a plurality of roofs.

FIG. 7 depicts an embodiment of a water fountain system having a plurality of rotatable roofs 2. Roofs 2 may have any of many different shapes. However, when they are spaced very close together (e.g., stacked on top of one another), roofs 2 preferably have a substantially flat shape to prevent them from contacting each other upon rotating. They may also have protrusions 4 on their upper and/or lower surfaces to form friction surfaces thereon. The water fountain system preferably includes a plurality of conduits 14 and 16, a plurality of nozzles 5 and 7, and a plurality of valves 10. A pump 20 preferably pumps water from reservoir 8 to three valves 10 via conduits 18. Each valve 10 is preferably adjusted to either direct water through conduit 14 or conduit 16. Water is preferably directed to each roof 2 via either nozzles 5 or nozzles 7. Each nozzle 5 may direct a jet of water to its respective roof 2 such that roof 2 rotates in a clockwise direction. Each nozzle 7 may direct a jet of water to its respective roof 2 such that roof 2 rotates in a counterclockwise direction. Bearings 12 and lips 11 of roofs 2 preferably enable roofs 2 to spin.

Figure 8:
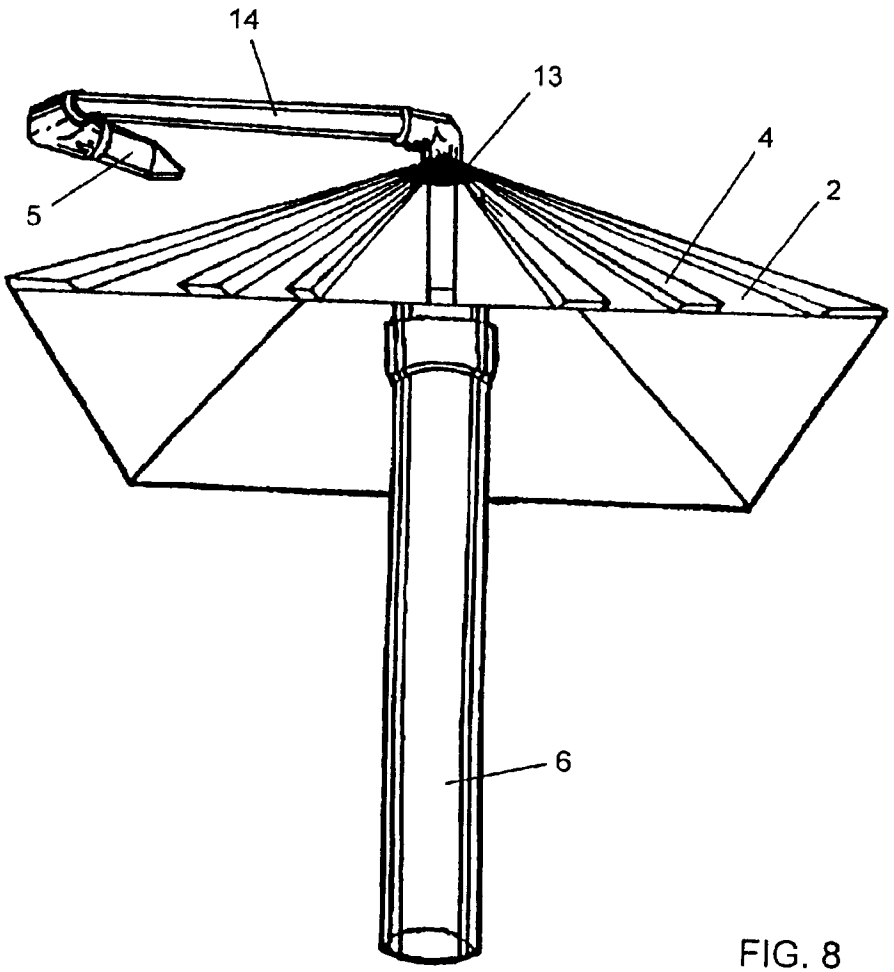
FIG. 8 depicts a perspective view of an embodiment of a water fountain system that includes a roof having members protruding from its surface.
Figure 9:
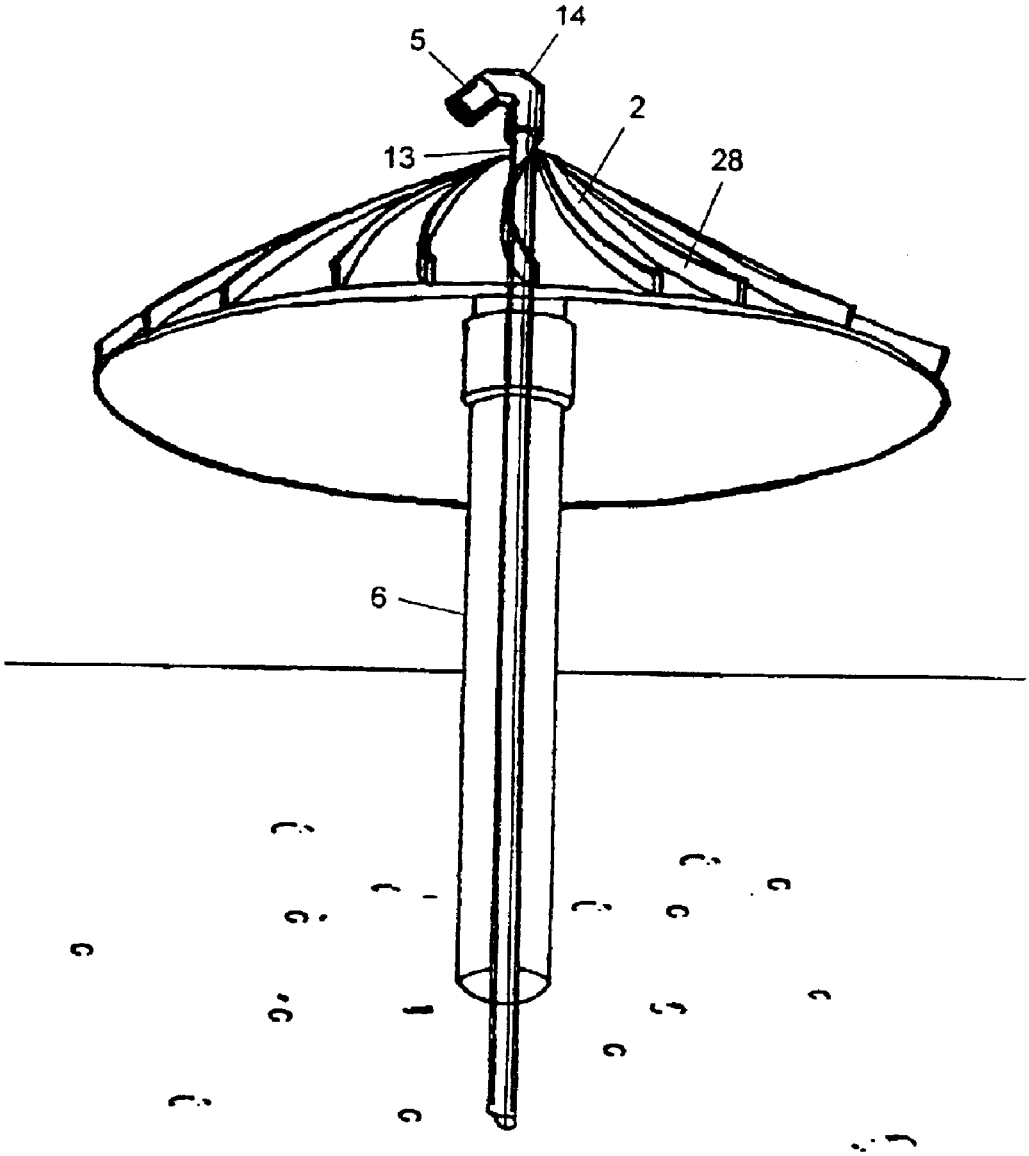
FIG. 9 depicts a perspective view of an embodiment of a water fountain system that includes a roof having curved members protruding from its surface.
Figure 10:
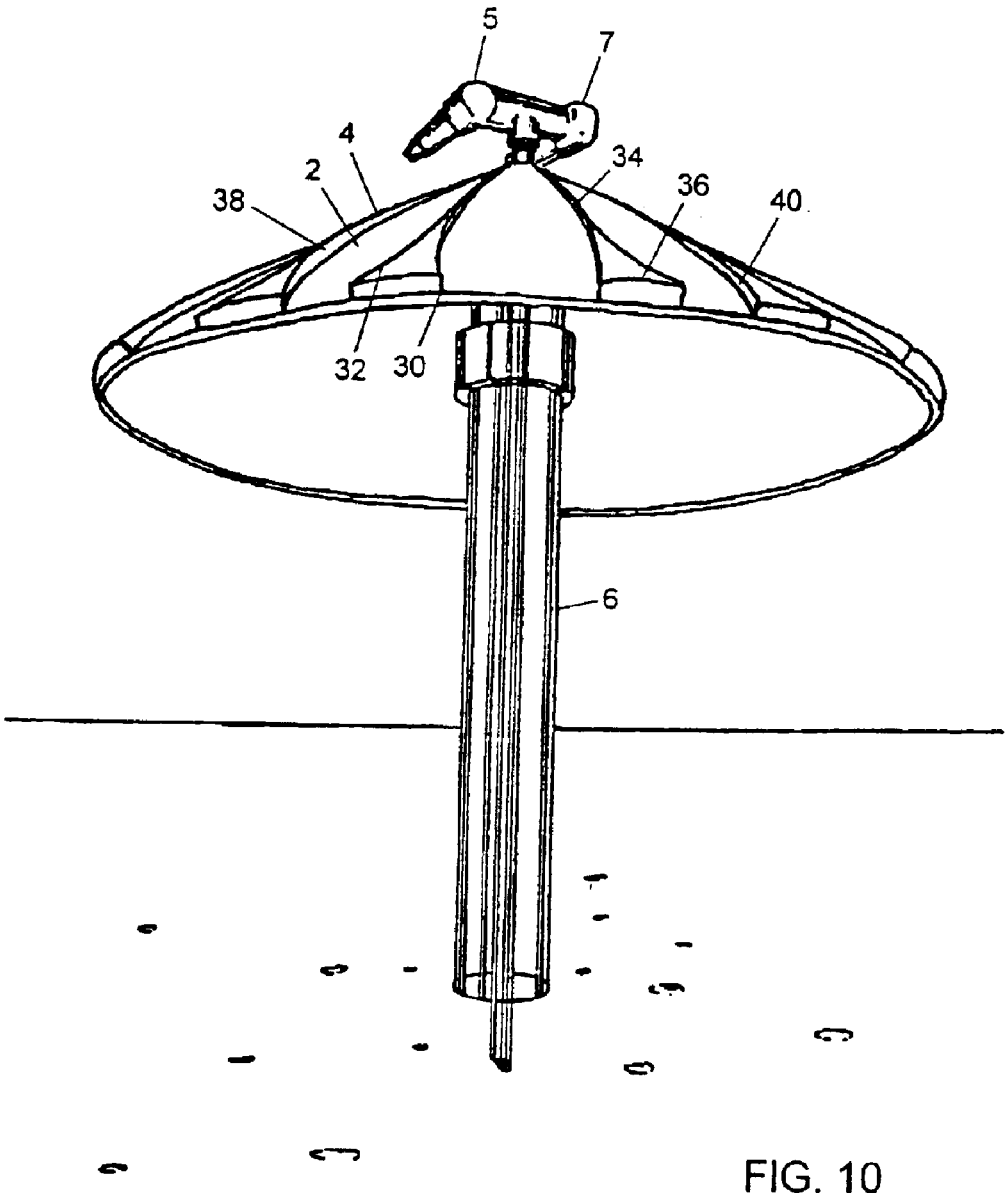
FIG. 10 depicts a perspective view of an alternate embodiment of a water fountain system that includes a roof having curved members protruding from its surface.

The perspective views of various embodiments of roof 2 are depicted in FIGS. 8–10. The protrusions 4 may be ribs that radially extend from central portion 13 of roof 2. The ribs preferably include a contact surface that is raised from the surface of the roof. It is to be understood that protrusions 4 may be disposed on both the top surface and the bottom surface of roof 2, depending upon the position of the nozzles.

Referring to FIG. 8, conduit 14 may extend from central portion 13 toward the outer edge of roof 2 to allow water to be directed from nozzle 5 to the radially-outward portions of protrusions 4 to substantially maximize the torque applied to the roof The water preferably impinges upon the contact surface of the protrusions 4 at a substantially perpendicular angle.

Referring to FIG. 9, the roof may contain a plurality of substantially curved ribs 28 radially disposed about the roof The curved ribs are preferably curved in a direction opposite of the rotational direction of the roof. In this manner, nozzle 5 may direct water toward ribs 28 from a location in the vicinity of central portion 13. The water preferably contacts at least a portion of ribs 28 at a substantially perpendicular angle to cause the roof to rotate.

Referring to FIG. 10, each radially disposed rib may contain a pair of complementary curved portions 30 and 32 that extend toward the edge of the roof in diverging directions. The curved portions 30 and 32 are preferably located about the outer edge of the roof. Portion 30 is preferably curved in a direction to allow the roof to rotate in a clockwise direction upon being contacted with a jet of water directed from nozzle 5. Portion 32 is preferably curved in a direction to allow the roof to rotate in a counterclockwise direction upon being contacted with a jet of water directed from nozzle 7.

As shown in FIG. 10, nozzle 5 may be offset from the center of central portion 13 and angled to direct water substantially along flow path 38 of curved portion 30 to rotate the roof in a clockwise direction (as viewed from above). Water flowing along flow path 38 of curved portion 30 is preferably inhibited from interacting with curved portions 32. Thus, curved portions 32 are inhibited from producing a significant torque in the counterclockwise direction when water is directed toward roof 2 from nozzle 5. Likewise, nozzle 7 may be offset from the center of central portion 13 and angled to direct water substantially along flow path 40 of curved portions 32 to rotate the roof in a counterclockwise direction (as viewed from above). Water flowing along flow path 40 of curved portion 32 is preferably inhibited from interacting with curved portions 30. Thus, curved portions 30 are inhibited from producing a significant torque in the counterclockwise direction when water is directed toward roof 2 from nozzle 7.

The radially-inward portions 34 of the ribs may have a lower height than the radially-outward portions 36. In this manner, the radially-inward portions tend not to block water directed at the radially-outward portions from the nozzle(s). Alternately, the nozzles may be positioned above or below the roof and angled to direct water above or below radially-inward portions 34 so that it may reach radially outward portions 36. Alternately, the radially-inward portions may be absent.

In all of the embodiments described herein, nozzles 5 and 7 may be directionally adjustable so that the water directed from such nozzles may be directed in different directions without having to alter the positions of conduits 14 and 16. The nozzles may be directionally adjusted manually or with a control system that is electrically, pneumatically or manually operated. In an embodiment, the water fountain system includes a single nozzle that may be adjusted to direct water towards roof 2 in at least two directions such that the nozzle can cause the roof to be rotated in a clockwise or counterclockwise direction. The nozzle is preferably adjustable using a control system so that a participant proximate ground level can change the direction from which water is directed at the roof.

Figure 11:
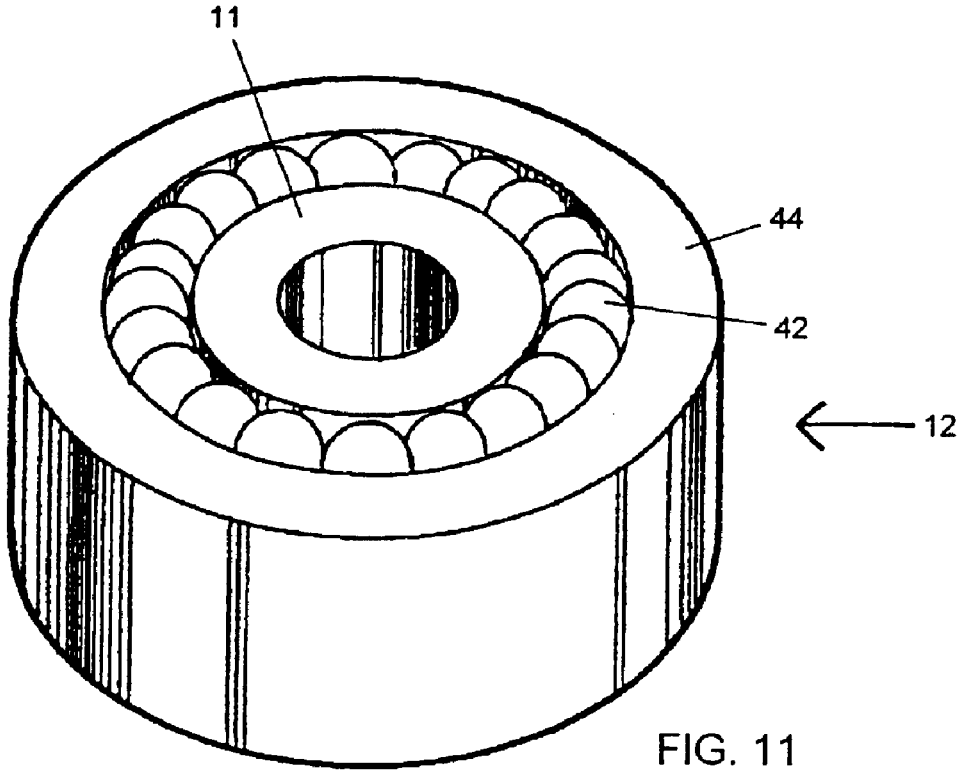
FIG. 11 is a cross-sectional view along a horizontal plane through a bearing of a water fountain system.

FIG. 11 illustrates a horizontal cross-section of bearing 12. Lip 11 of roof 2 is preferably a cylindrical shell seated within bearing 12. Its outer surface preferably contacts spinnable objects 42. These spinnable objects 42 may be in the form of balls or drums encased within a race 44. Race 44 preferably surrounds spinnable objects 42. When a jet of water hits roof 2 at an angle, lip 11 preferably rotates since objects 42 may rotate as lip 11 rotates. Little or no friction preferably exists between spinnable objects 42 and lip 11. In another embodiment, a bushing may be used instead of a bearing. In such an embodiment, the inner surface of the bushing is preferably lubricated to reduce friction between the bushing and the lip.

In an embodiment, the support member 6 may be shaped to resemble a figure such as, for example, a square, a circle, a triangle, a cone, a sphere, an umbrella, a pyramid, an animal, an insect, a plant, a dinosaur, a space ship, an inner tube, a boat, an auto, and or airplane. A sound system may be adapted to play sound effects that relate to the figures represented by the roof 2 and/or support member 6. For example, the support member 6 may have the shape of a dinosaur, and the sound system may be capable of producing sounds that would be associated with a dinosaur. Likewise, the roof may have the shape of, for example, a boat, car, or airplane, and the sound system may be capable of producing sounds generated by boats, cars or airplanes.

Each of the above-described water fountain systems may include a light system and a sound system 23 as illustrated in FIG. 1. The light system preferably includes lights 46 which may be located near or on roof 2. A control system 21 may be electrically coupled to lights 46 and sound system 23. In an embodiment, control system 21 includes a computer for transmitting and receiving electrical signals for coordinating operation of one or more valves 10, the lights 46, and sound system 23. Control system 21 may turn different lights 46 and/or sound system 23 on and off randomly or at predetermined times. The control system 21 may adjust valve 10 randomly or at predetermined times. Alternately, control system 21 may activate the lights in response to valve 10 being automatically or manually adjusted. Control system 21 may also be connected to sound system 23 located near the water fountain system. Adjustment of valve 10 may cause sound system 23 to be activated. Upon activation, sound system 23 may play music, or may only make a sound effect. For example it may play a whistle sound, animal sound, horn sound, etc. Alternately, sound system 23 may play music or sound effects at predetermined times so that the adjustment of valve 10 is not required for the sound system to be activated.

II. Water Carousel System

Figure 12:
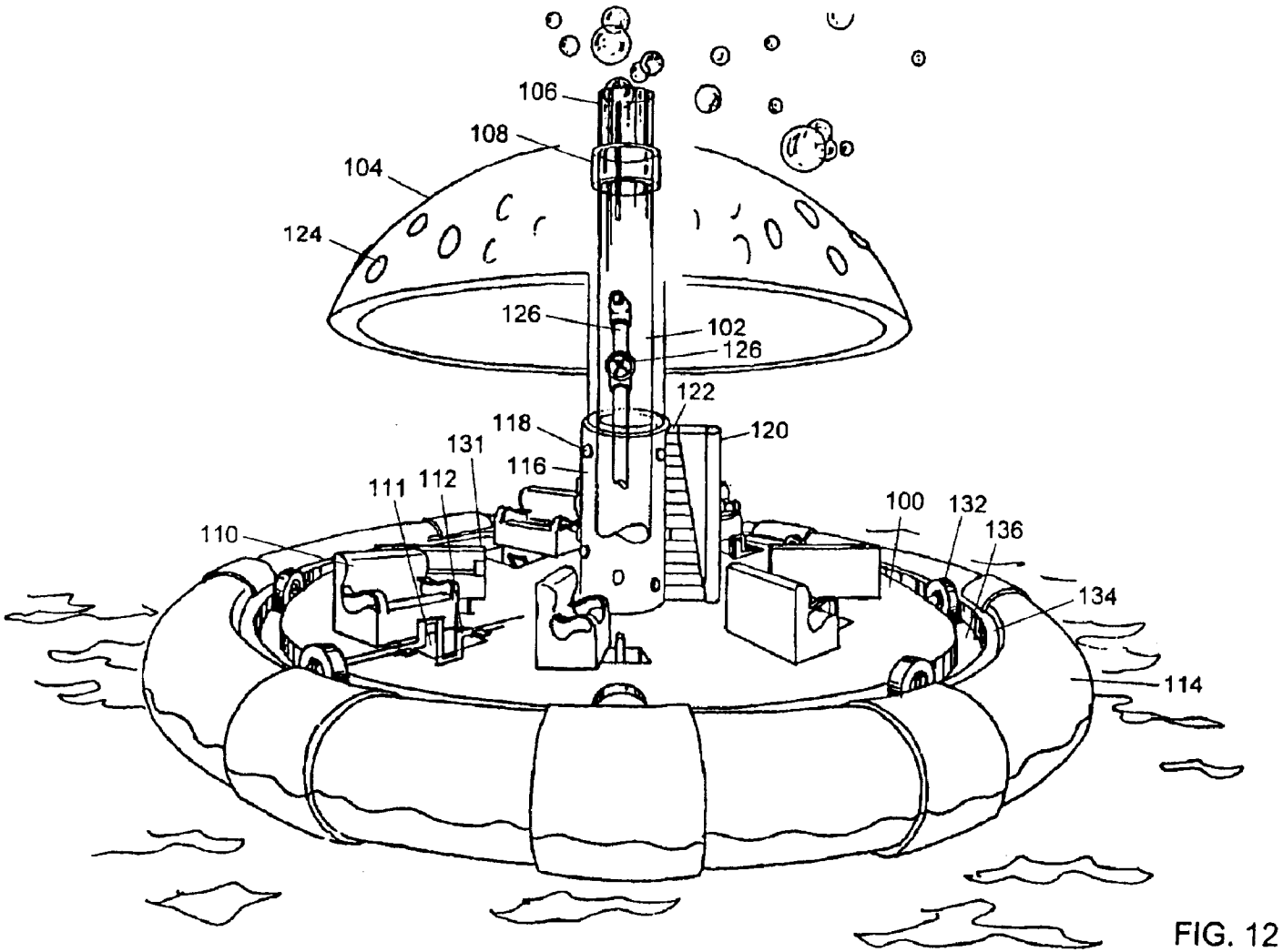
FIG. 12 is a perspective view of one embodiment of a water carousel system.

Turning to FIG. 12, an embodiment of a water carousel system is presented. The water carousel system preferably includes a floor 100 and a platform 134 underneath floor 100. Floor 100 and platform 134 are preferably circular in shape, but they may also be in the form of a variety of other shapes (e.g., square, rectangle, triangle, etc.). Platform 134 may be anchored to the ground while the platform is floating on water, or platform 134 may float freely on the water. An elongated support member 102 is preferably attached to platform 134 and may extend vertically through the center of floor 100 to the center of a roof 104. In an embodiment, elongated support member 102 may extend below the surface of the water to the ground to anchor the water carousel system.

Roof 104 is preferably configured to provide shade to the participants. Roof 104 may be stationary or rotatable. In one embodiment, the roof is rotatable and a jet of water may be directed toward roof 104 to cause it to rotate with respect to elongated support member 102. Roof 104 preferably contains a plurality of protrusions to provide a contact area for the water directed at the roof. It is to be understood that roof 104 may be configured according to any of the above-mentioned embodiments of roof 2 for the water fountain system. Roof 104 may include fiberglass, metal, plastic, or any other suitable materials. Roof 104 is preferably shaped like an umbrella, but it may form a variety of other shapes (e.g., a square, a circle, a triangle, a cone, a sphere, a pyramid, an animal, an insect, a plant, a mushroom, a dinosaur, a space ship, an inner tube, a boat, an auto, an airplane, etc.). A bearing 108 or a bushing may be connected to support member 102. The roof 104 is preferably coupled to bearing 108, thereby enabling roof 104 to rotate in a clockwise or counterclockwise direction when a jet of water is directed at roof 104. A second bearing 109 (shown in FIG. 16) or bushing is preferably attached about support member 102, and may be interposed between support member 102 and floor 100. It is preferred that little or no friction exists between bearing 109 and floor 100. Therefore, bearing 109 enables the rotation of floor 100 about support member 102.

The water carousel system further preferably includes several seats 110 which are attached to the top of floor 100. Seats 110 may form the shapes of animals, toys, carriages, chairs, etc. Further, seats 110 are preferably shaped to hold a participant sitting upon them. Preferably all seats 110 and roof 104 are shaped like figures bearing a common theme. Although seats 110 are depicted as being placed singularly around the edge of floor 100 in FIG. 12, they may also be placed in rows around the edge of floor 100. Each row may contain several seats.

A plurality of slots 111 may be located within floor 100. Slots 111 may be located underneath or in front of seats 110. The location of a slot 111 relative to one of the seats 110 is dependent on the shape of the seat. For instance, if one of the seats 110 is shaped like an animal, slot 111 may be located under seat 110 to allow the feet of a participant to reach slot 111. If one of the seats 110 is shaped like a chair, slot 111 may be located in front of seat 110 to allow the feet of a participant to more easily reach slot 111.

A rotatable shaft 112 is preferably connected to the bottom of floor 100. Rotatable shaft 112 is preferably located under the floor. One section of rotatable shaft 112 is preferably configured to be powered by a participant power mechanism. Participant power mechanisms may be powered by either the participants arms, legs or a combination of both. Operation of the participant power mechanism by the participants preferably causes the rotatable shaft to rotate. The rotatable shaft is preferably coupled to a propulsion device, the propulsion device being configured to cause floor 100 to rotate. A plurality of these shafts 112 are preferably included in the carousel system.

In one embodiment, rotatable shaft 112 is preferably configured to be powered by the legs of a participant. Rotatable shaft 112 may be formed in the shape of pedals. Alternatively, rotatable shaft may be coupled to one or two pedals to receive the feet of a participant. The pedals preferably extend through a portion of slot 111. The pedals are preferably positioned such that the participants may reach the pedals while seated on seats 110. The pedals may be rotatably powered (e.g., the pedals may be moved in a circular pattern, like a bicycle) or linearly powered (e.g., the pedals may be reciprocated, rather than moving the pedals in a circle). The pedals coupled to shafts 112 preferably extend up through each slot 111 so that they may be powered by the feet of a participant sitting in an adjacent seat 110.

Figure 13:
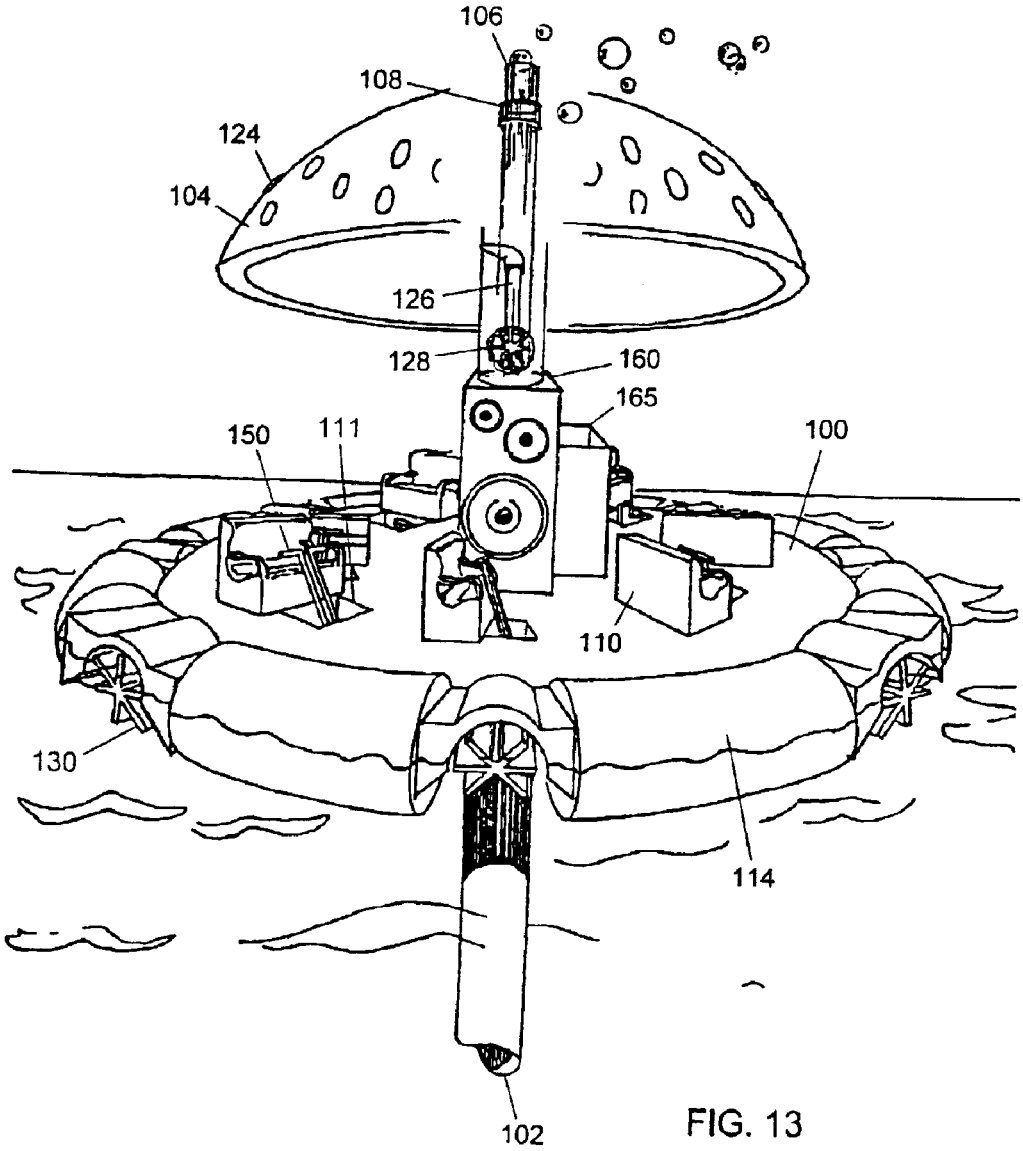
FIG. 13 is a perspective view of another embodiment of a water carousel system.

In another embodiment, rotatable shaft 112 is preferably configured to be powered by the arms of a participant, as depicted in FIG. 13. Rotatable shaft 112 is preferably coupled to an arm activated device 150 which is configured to receive a hand of a participant. A variety of arm activated devices 150 may be coupled to rotatable shaft 112, such as a handle, lever or a wheel. Arm activated device 150 may include a pair of handles for each arm of the participants. Arm activated devices 150 may be powered by rotation of the device (e.g., rotation of a wheel) or by reciprocating the device. Arm activated devices 150 are preferably positioned such that the participants may easily power the device while seated upon a nearby seat 110.

In another embodiment, a motor 131 may be coupled to floor 100 such that the carousel may be rotated without the participants, as depicted in FIG. 12. The motor may be coupled to floor 100 such that powering of motor 131 drives at least one of the shafts 112, which in turn drives a propulsion device, thereby causing rotation of floor 100 about the platform. The motor preferably uses either liquid fuels (e.g., gasoline or diesel fuel), gas fuels (e.g., natural gas), or electricity as a fuel source. Preferably, motor 131 is configured to maintain a minimal rotational speed of floor 100. The rotational speed of floor 100 may be adjusted by altering a speed of motor 131. Preferably, the speed of floor 100 is altered by powering of the participant power devices by the participants. For example, as the participants power the participant power devices, the added power may cause the carousel to rotate at a speed faster than the minimal speed. A speed regulation device, which may be built into motor 131, is preferably configured to inhibit rotation of the carousel at a speed faster than a predetermined maximum speed.

In one embodiment, the propulsion device is a wheel 132. Wheel 132 is preferably attached to each shaft 112. As each shaft 112 is rotated via powering of the participant power mechanism, wheel 132 is preferably also rotated. Platform 134 preferably has a circular shaped track 136, which may guide wheels 132 as they rotate. In one embodiment, the floor 100 and the platform 134 may serve as a guide to maintain the wheels within a circular path. In another embodiment, track 136 may contain two rails or members lying parallel to one another. They are preferably separated by a distance equal to the width of wheels 132. The rails preferably serve as a guide to maintain the wheels within a circular path about the platform. Alternately, the platform may contain an indention serving as a wheel guide that extends in a circular path about the platform and is shaped to contain the wheels. The rotation of wheels 132 preferably causes floor 100 to rotate about support member 102. Platform 134 may extend below the floor to the support member. Alternatively, platform 134 may extend under a portion of floor 100 from flotation member 114 toward, but not reaching, support member 102.

The carousel system also preferably includes at least one flotation member 114 attached to the outer edge of platform 134 to cause the whole carousel system to float. The flotation member is preferably constructed of plastic. Flotation member 114 may be a hollow tube, or a series of hollow tubes, configured to hold the weight of the central system.

The water carousel system may also include a sound system that operates in conjunction with the rotation of the carousel. The sound system may produce sounds either mechanically or electronically. Upon activation, the sound system may play music, or may only make a sound effect. For example, it may play a whistle sound, animal sound, horn sound, etc. The features of the sounds produced by the sound system are preferably determined by the rate at which the floor is rotated with respect to the platform. Such features of the sounds may include, but are not limited to: rate, volume, pitch, and/or pattern of the produced sounds. Since the rotational rate of the floor is a function of the power applied by the participants to the participant power mechanisms, the participants are preferably able to control the features of the sounds produced by the sound system. For example, as the rotational speed of the floor is increased the various sound features may be increased or decreased. Preferably, the sound features are increased (e.g., rate, pitch and/or volume is increased) when the rotational speed of the floor is increased. In one embodiment, the application of a predetermined amount of power to the participant power mechanisms by the participants will preferably produce a musical tune at the proper pitch and/or rate. Alternately, the sound system may play music or sound effects at predetermined times so that the adjustment of the rotational speed of floor 100 is not required for the sound system to be activated.

In one embodiment, the sound system may include a mechanical sound device coupled to support member 102. The mechanical sound device preferably includes a drum 116 and a plurality of sound producing arms 122, as shown in FIG. 12. Bearing 109 (see FIG. 16) is preferably disposed within drum 116. Drum 116 may have a number of raised points 118 along its outer surface. A plurality of sound producing arms 122 are preferably arranged at different vertical levels within a housing 120, which is preferably connected to floor 100. Arms 122 preferably extend horizontally toward drum 116. The combination of arms 122 and drum 116 preferably form a "music box" arrangement. As floor 100 rotates about support member 102, arms 122 preferably move around drum 116, allowing each raised point 118 to strike an arm 122. Arms 122 are preferably metal prongs. Contact between each arm 122 and the raised points 118 preferably makes the sound of a distinct musical note. Raised points 118 are preferably arranged to strike certain arms 122 so that specific notes are sounded to create a song. Rotation of shaft 112 causes arms 122 to move about drum 116. The speed at which the notes are played is preferably determined by the rate at which the floor is rotated with respect to the platform. As the rotational speed of the floor is increased, arms 122 are moved at a faster rate, thereby causing the speed at which the song is played to increase.

In another embodiment, a sound system 160 is preferably controlled by a control unit 165, as depicted in FIG. 13. Control unit 165 is preferably configured to impart electronic signals to sound system 160 in response to the movement of the floor. In an embodiment, control unit 165 includes a computer for transmitting and receiving electrical signals for coordinating operation of the sound system. Control unit 165 may be coupled to either a mechanical or electronic sound system 160. Control unit 165 preferably includes a sensor for measuring the rotational speed of the floor. As the floor of the carousel is rotated, the rotational speed of the floor may be measured by the sensor and relayed to control unit 165. Control unit 165 is preferably configured to vary the rate, volume, pitch, and/or pattern of the music being produced by sound system 160 as a function of the rotational speed of the floor.

Lights 124 are preferably located on top of roof 104. The control system preferably controls which lights are on and which lights are off at predetermined times. Alternately, the control system may detect the speed of the rotation of floor 100 to activate and synchronize the flashing of lights 124 with the rhythm of the music played by sound system 160.

Referring back to FIG. 12, roof 104 is preferably capable of spinning independently of floor 100. Roof 104 may be forced to rotate in a clockwise or counterclockwise direction via directing a jet of water toward the roof 104. A conduit 126 is preferably mounted to support member 102 for conveying water to the roof. Conduit 126 may be mounted inside support member 102 or to the outer surface of support member 102. The conduit may extend through floor 100 and platform 134 and terminate in the water below. In this manner, water that is directed onto roof 104 may be drawn from the body of water in which the water carousel system resides. A pump (not shown) may be disposed within conduit 126 to force water through the conduit. A valve 128 which controls the flow of water to the roof is preferably disposed in conduit 126. Valve 128 is preferably located near floor 100 so that it may be adjusted by the turning of a handle, electronically by means of a control system, or by activation points (such as the activation points described in the musical water fountain system) coupled to the valve.

The carousel may be a "wet ride" (e.g., a ride which allows the participants to become substantially wet) or a "dry ride" (e.g., a ride in which the participants remain substantially dry). In a wet ride embodiment, roof 114 is preferably configured to allow water to fall onto the participants. Water may be directed at the lower surface of roof 104 such that the water is sprayed onto the participants. Alternately, water may be directed toward an upper surface of roof 104. Roof 104 is preferably configured to allow water to fall upon the participants as a water stream travels over an outer surface of the roof. In a dry ride embodiment, the roof preferably inhibits water from reaching the participants, such that the participants remain substantially dry.

Platform 134 may be coupled to an elongated support member extending from a bottom surface of the floor to the roof. The elongated support member may provide a stabilizing force to the platform so that the platform is stabilized during the operation of the carousel. Elongated support member 102 may include a substantially hollow central portion 106. The central portion 106 may include a bubble generator for producing bubbles, and/or a smoke generator for producing a smoke-like substance (e.g., carbon dioxide gas). The generation of bubbles and/or smoke may operate in conjunction with the rotation of the carousel. The features of the bubbles (e.g., amount and/or size of the bubble) and the features of the smoke (e.g., amount and/or color of the smoke) produced during operation of the carousel are preferably determined by the rate at which floor 100 is rotated with respect to support member 102. For example, as the rotational speed of floor 100 is increased, the amount of bubbles produced may be increased or decreased.

In another embodiment, floor 100 of a water carousel system is preferably configured to float on water, as depicted in FIG. 13. This embodiment contains many of the same components as shown in FIG. 12 with a few exceptions noted below. In place of a support platform, at least one flotation member 114 is preferably attached to floor 100. Thus, floor 100 of the carousel floats on the water. As in the other embodiments of the carousel, a rotatable shaft 112 is preferably coupled to a participant power mechanism 150 and a propulsion device 130 positioned under the floor. The operation of participant power mechanism 150 by the participants preferably causes powering of propulsion device 130. Propulsion device 130 is preferably configured to impart a rotational force to the carousel when powered.

Propulsion device 130 is preferably a water propulsion device. Examples of water propulsion devices include, but are not limited to, paddles, paddle wheels, and propellers. Water propulsion device 130 is preferably configured to extend at least partially into the water. Water propulsion device 130 is preferably coupled to rotatable shaft 112, which is preferably positioned under floor 100. Slots 111 are positioned within floor 100 to allow access to rotational shaft 112 by the participant power mechanisms.

In one embodiment, the water propulsion device 130 may be a paddle wheel, as depicted in FIG. 13. Paddle wheel 130 is preferably attached to the end of each rotatable shaft 112. Each paddle wheel 130 preferably has planar blades or paddle members which encircle shaft 112. Paddle wheels 130 preferably extend into the water. When shaft 112 is rotated, the blades of each paddle wheel 130 preferably move through the water, forcing floor 100 to rotate about support member 102.

Figure 14A:
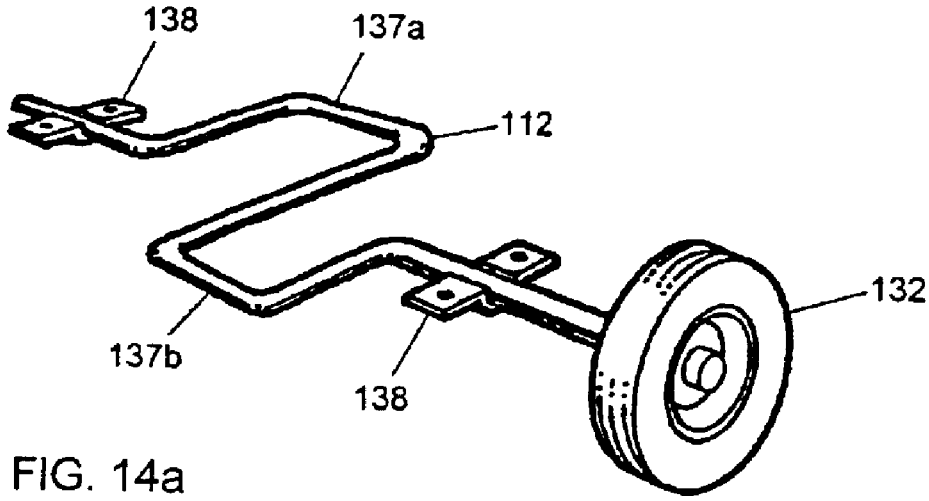
FIG. 14*a* is a detailed view of a shaft depicted in FIG. 12.

FIG. 14*a* depicts a more detailed view of one embodiment of shaft 112 of FIG. 12. Shaft 112 may be shaped to form a pair of pedals. A left foot may be placed on pedal 137*a*, and a right foot may be placed on pedal 137*b*. A rectangular-shaped plate may be placed on top of each pedal to facilitate the engagement between the pedals and the feet of a participant. When the left foot applies a downward force on pedal 137*a*, pedal 137*a* preferably rotates downward and pedal 137*b* preferably rotates upward. Pedal 137*b* may then be forced downward by the right foot to make pedal 137*a* rotate upward. A wheel 132 is preferably attached to an end of shaft 112. As the pedals are rotated, shaft 112 preferably rotates, further causing wheel 132 to rotate. Handles 138 which are attached to the bottom of floor 100 are preferably attached about shaft 112 to hold the shaft in place.

Figure 14B:
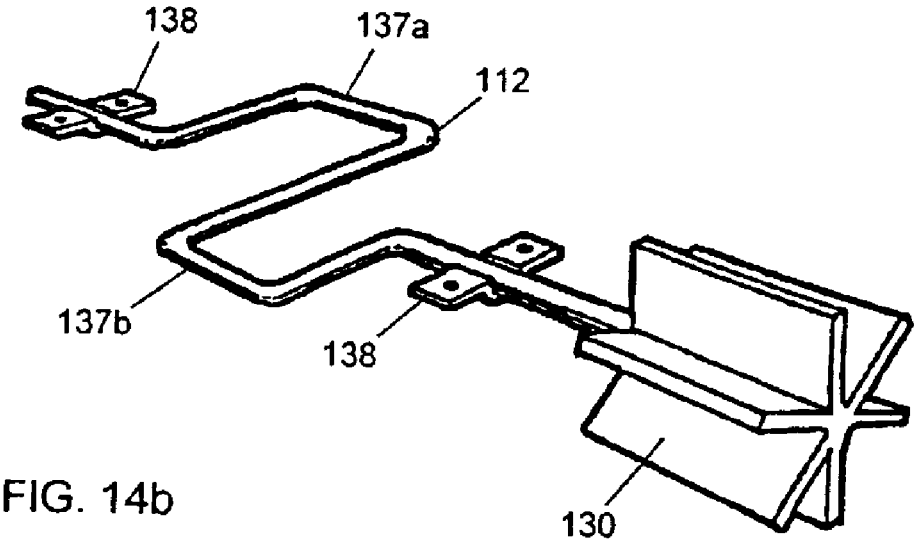
FIG. 14*b* is a detailed view of a shaft depicted in FIG. 13.

FIG. 14*b* illustrates a detailed view of shaft 112 of FIG. 13. Shaft 112 of FIG. 15 preferably includes the same elements as that of FIG. 14 except for having paddle wheel 130 attached to its end.

Figure 15:
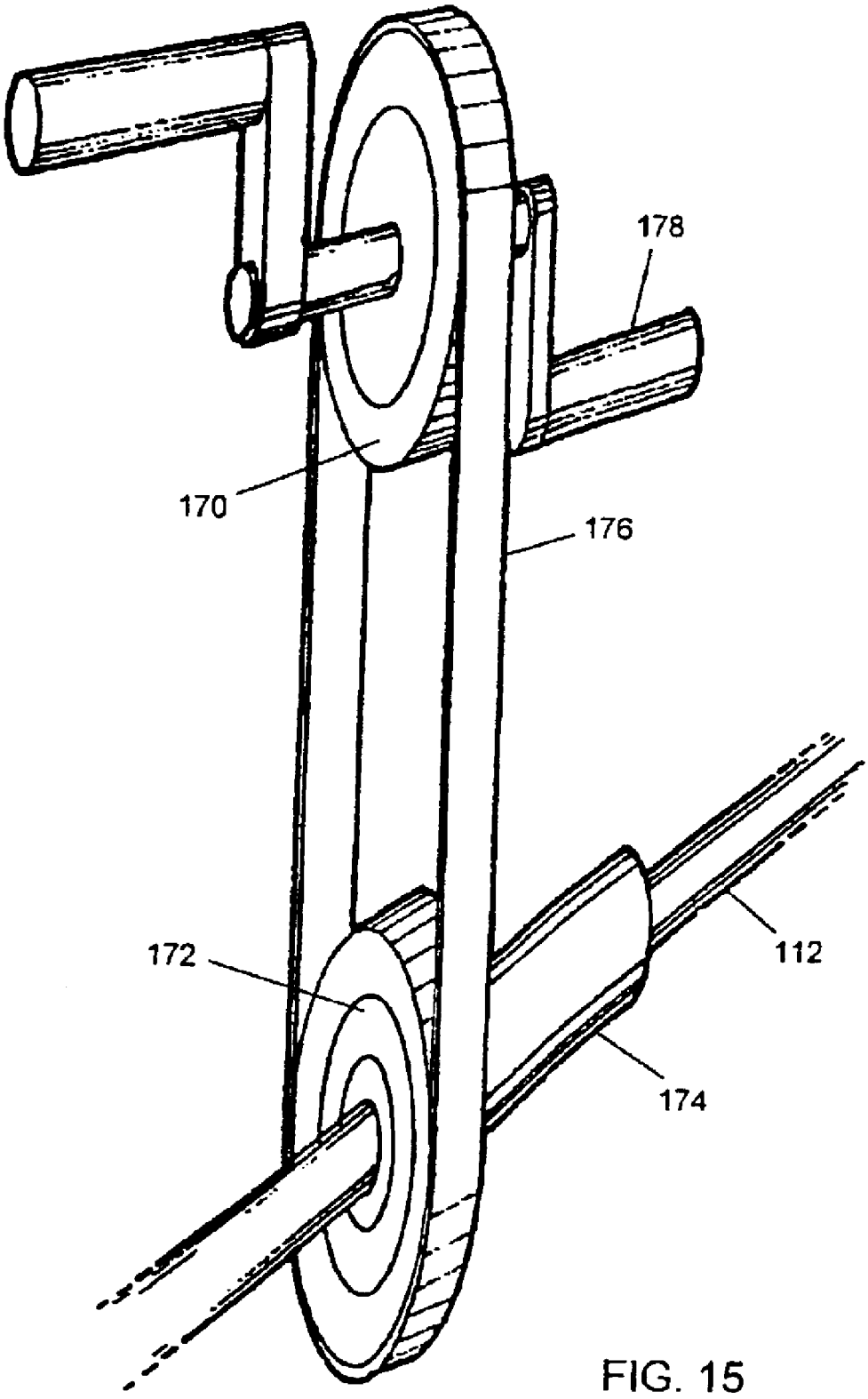
FIG. 15 is a detailed view of a gear system attached to a participant power mechanism of a water carousel system.

In another embodiment, the shaft may be coupled to a gear system as shown in FIG. 15. The gear system preferably includes two sets of gears 170 and 172 and a hub 174. Each set of gears may include one or more gears. The participant power mechanism 178 is coupled to the first set of gears 170. The first set of gears 170 is preferably coupled to the second set of gears 172 by a coupling member 176. Coupling member 176 may be a chain, a rope or a belt. The second set of gears 172 is coupled to shaft 112 at hub 174. Hub 174 is preferably configured to allow the participant to apply a rotating force to shaft 112 by rotating the first set of gears 170. Hub 172 is further configured to allow the participant to stop powering participant power mechanism 178 without stopping shaft 112 from rotating (e.g., like a bicycle coasting feature). The first set of gears 170 may be coupled to a pedal system (e.g., like a bicycle) or to an arm activated mechanism (e.g., a wheel). This type of gearing system has the advantage that the participants may stop or reduce their operation of the participant power mechanism without having to release the participant power mechanism. The gear system may also include a switching system (not shown). The switching system (e.g. a multi-speed hub system or a bicycle derailleur system) may be used to allow the participant to change the gears being used. This has the advantage of allowing the participant to choose a gearing system that is more comfortable to the rate of pedaling they desire, while still allowing them to apply power to shaft 112.

Figure 16:
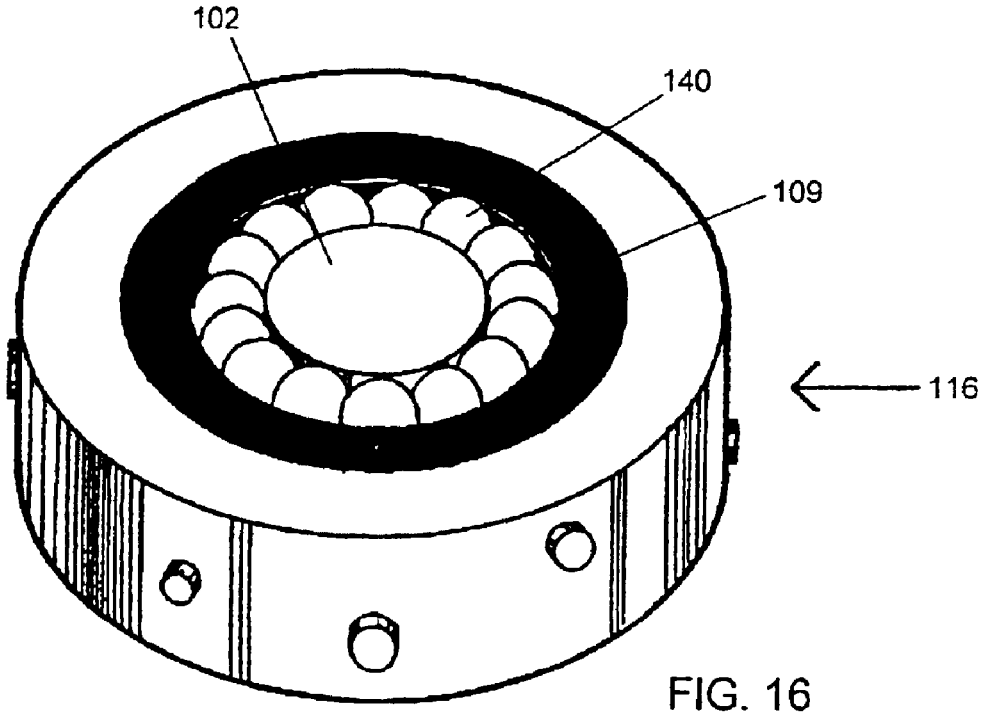
FIG. 16 is a cross-sectional view along a horizontal plane through a bearing within a drum of a water carousel system.

Turning to FIG. 16, a cross-section of drum 116 which is shown in FIGS. 12 and 13 is depicted. A bearing 109 or bushing is preferably located within drum 116. The outer surface of bearing 109 is preferably attached to the inner surface of drum 116. Bearing 109 preferably surrounds the outer surface of support member 102 to allow drum 116 to rotate about support member 102, thereby promoting the rotation of floor 100 (shown in FIGS. 12 and 13) about support member 102. Bearing 109 preferably includes spinnable objects 140. The outer surface of support member 102 preferably contacts spinnable objects 140. These spinnable objects 140 may be in the form of balls or drums encased within bearing 109. In another embodiment, a bushing may be used instead of a bearing. In such an embodiment, the inner surface of the bushing is preferably lubricated to reduce friction between the bushing and support member 102.

The use of a participant power mechanism, coupled to a carousel such that the speed of the carousel may be altered by the participants, allows the participants to control the ride in a manner that is typically absent from many amusement park rides. In addition to controlling of the speed of the ride, the participants may be required to work together to produce a sound or light pattern which may be pleasant to both participants and spectators. For example, by a cooperative effort, the speed and/or pitch of the sounds produced (e.g., a song) may be adjusted until the pitch and/or speed matches a predetermined pitch and/or speed. When the carousel is maintained at the appropriate speed the participants may be rewarded by hearing the sounds at the appropriate pitch and speed. Additionally, lights and additional sounds may be used to further reward the participants when the appropriate speed is achieved. In this manner, the ride may be enjoyed by the participants in a number of different ways. First, the novelty of riding a floating carousel may appeal to the participants. Second, the challenge, and ultimate reward, of producing a pleasant musical and/or visual pattern will appeal to participants who enjoy interactive rides. Finally, the production of a pleasant musical and/or visual pattern may require a cooperative effort on the part of the participants, allowing the participants to interact with each other, as well as with the carousel.

III. Musical Water Fountain System

Figure 17:
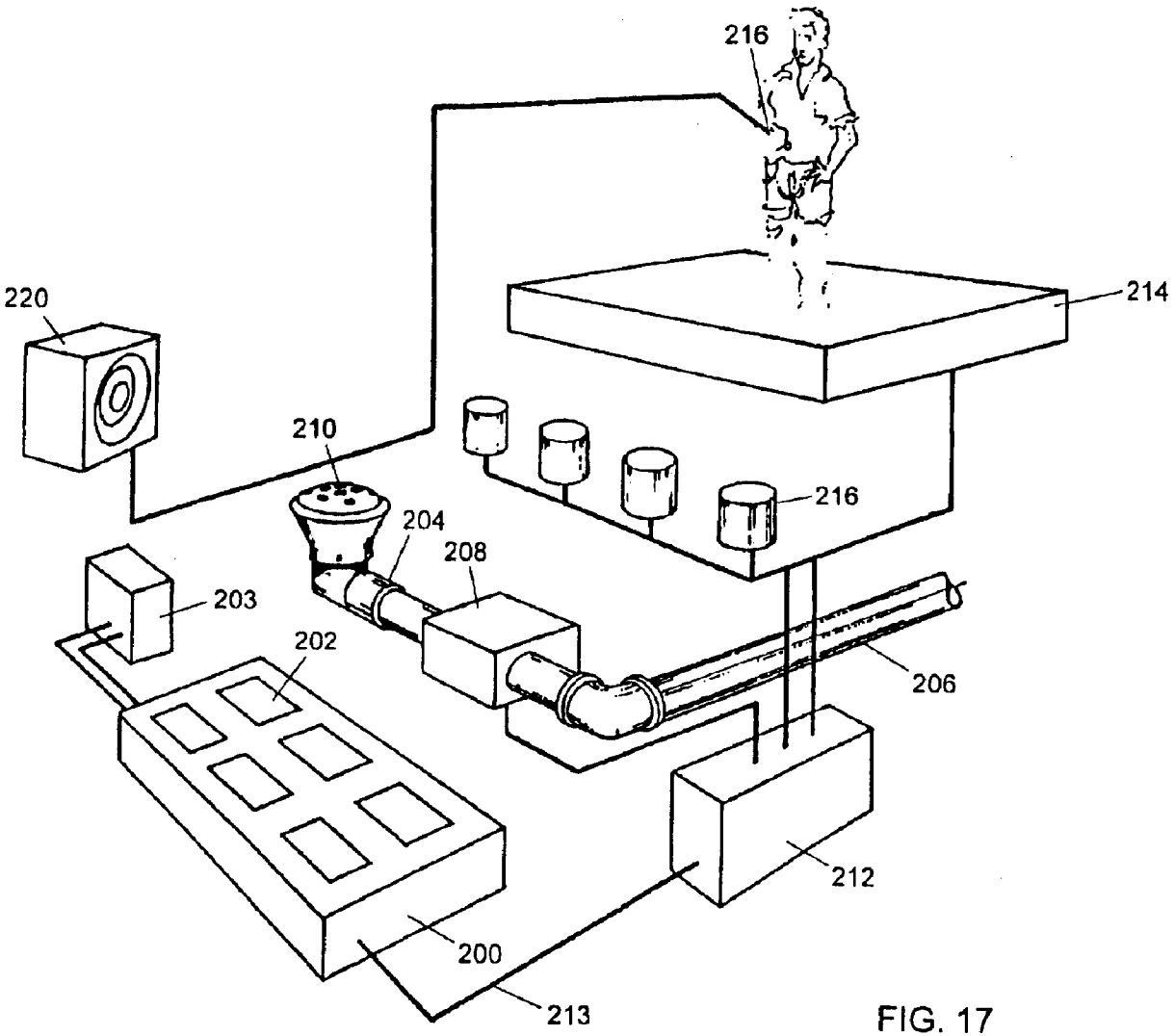
FIG. 17 is a perspective plan view of one embodiment of a musical water fountain system having a sound system.

An embodiment of a musical water fountain system is depicted in FIG. 17. The musical water fountain system preferably includes a sound system 203 for playing musical notes, a fountain system 204 for spraying water, and a lighting system adapted to activate lights 218. The sound system, fountain system, and lighting system are preferably activated by a participant such that the timing of the visual and sound effects created by such systems is dependent upon physical acts of the participant.

The musical water fountain system preferably includes at least one instrument 200 included in an "orchestra". In an embodiment, participants apply a participant signal to activation points 202 to activate the instruments. The participant signal may be applied by the application of pressure, moving a movable activating device, a gesture (e.g., waving a hand), or by voice activation. The activation point is preferably configured to respond to the participant signal. In one embodiment, the activation point may be configured to respond to a participant's touching of the activation point. The activation point may respond to varying amounts of pressure, from a very light touch to a strong application of pressure. Alternatively, the activation point may include a button which is depressed by the participant to signal the activation point. In another embodiment, the activation point may include a movable activation device. For example, the activation point may be a lever or a rotatable wheel. The participant may then signal the activation point by moving the lever (e.g., reciprocating the lever) or rotating the wheel.

In another embodiment, the activation point may respond to a gesture. For example, the activation point may be a motion detector. The participant may then signal the activation point by creating movement within a detection area of the motion detector. The movement may be created by passing an object (e.g., an elongated member) or a body part (e.g., waving a hand) in front of the motion detector. In another embodiment, the activation point may be sound activated. The participant may signal the sound activated activation point by creating a sound. For example, by speaking, shouting or singing into a sound sensitive activation point (e.g., a microphone) the activation point may become activated.

The activation points 202 are preferably located on or in the vicinity of the instrument 200. Each instrument 200 may contain a plurality of activation points 202. For example, the instrument may be a piano or a keyboard containing a plurality of keys wherein each of the keys contains an activation point 202 (see FIG. 18). Each of the activation points 202 is preferably configured to cause sound system 203 to play a different sound. In an embodiment, the fountain is adapted to create musical notes. Sound system 203 may be used to increase the volume of and/or alter the sound quality of the musical notes created by the instrument. Sound system 203 may include a speaker to increase the volume of the musical note being played. Alternately, the musical notes may be pre-recorded and generated by sound system 203, while the instruments may serve to contain the activation points without actually playing the musical notes. Alternatively, the sound system may make sound effects. For example, the sound system may produce a whistle sound, animal sound, horn sound, etc. In another embodiment, sound system 203 may be a mechanical device configured to produce sounds or musical notes when activation points 202 are signaled.

In one embodiment, each of activation points 202 is preferably configured to sense a participant signal and generate one or more signals in response to the participant's signal. The signals generated by the activation point may be electronic or pneumatic. Each of the activation points is preferably electrically coupled to a control system 212. Control system 212 may be a pneumatic or an electrically operated system. Control system 212 is preferably an electronic control system configured to route the signals from the activation points to the sound system, lighting system, and/or fountain system. For instance, each time a participant's signal is applied to an activation point, a first signal is preferably relayed to a sound system 203 via control system 212. The first signal preferably indicates to sound system 203 a particular musical note to play, depending on the activation point from which it originated.

Furthermore, when a participant signals an activation point, a second signal may be relayed to a fountain system 204 via control system 212. In response to the second signal, the fountain system 204 may produce a fountain effect. Examples of fountain effects include spraying of water, generation of bubbles, and generation of smoke. The fountain effect of spraying water may include varying the height, direction, and/or volume of the water produced by the fountain when certain activation points are signaled. Fountain system 204 preferably contains at least one conduit 206, at least one valve 208 disposed within conduit 206, and at least one nozzle 210 connected to conduit 206 for producing a spray of water. Conduit 206 may be made from materials such as PVC or galvanized steel. The valve 208 is preferably electrically coupled to control system 212. The second signal may be relayed to valve 208 to signal it to open, thereby causing water to be sprayed from nozzle 210.

In an embodiment, a lighting system 218 is located near fountain system 204. When a participant signals an activation point a third signal may be generated by control system 212. The third signal may be relayed to a lighting system 218, thereby activating selected lights of the lighting system.

It is to be understood that the first, second, and third signals described herein may each be taken to mean a single signal or may represent a series of signals. For instance, an activation point may generate a signal and send it to control system 212. In response control system 212 may transmit a signal to the sound system to produce a musical note. For simplicity, the "first signal" may be taken to include the signal generated by the activation point and the signal relayed by the control system.

Each of the activation points may be configured to generate the first, second, and third signals each time a participant's signal having a predetermined magnitude is sensed by the activation point. For pressure activated points, the signals may be generated in response to a predetermined amount of force applied to the activation point. For motion activated points, the signals may be generated in response to movement having a speed within a predetermined range. For voice activated points, the signals may be generated in response to a predetermined volume and/or pitch of the participant's signal.

Alternately, each activation point 202 may correspond to either the sound system, fountain system, or lighting system. That is, the activation points 202 may be configured to generate either the first, second, or third signal such that a participant can separately activate the sound system, fountain system, and lighting system by applying a signal to different activation points 202. Activation points 202 may contain transducers for sensing the magnitude of the signal applied to the activation points. Activation points 202 may selectively generate the first, second, and/or third signals as a function of the magnitude of the signal applied to the activation point. In this manner, the participants may control which of the sound system, fountain system, and light system are activated by controlling the magnitude of the signal applied to the activation point. For instance, a pressure sensitive activation point may generate the first signal to activate the sound system in response to sensing a force below a predetermined magnitude, while the activation point may generate the second and/or third signals in response to sensing a force above the predetermined magnitude.

In an embodiment the sequence in which a participant signals the activation points affects the resultant sound quality of the music generated by sound system 203. For instance, the sequence in which participant signals are applied to the activation points may determine the order in which the musical notes are played by sound system 203. In an embodiment, various indications are provided to participants at predetermined times to coordinate the activation of the sound system, fountain system, and lighting system to create a desired visual and audio display. The participants preferably apply a participant signal to an activation point immediately after receiving an indication at a predetermined time.

The indication provided to the participants may be supplied by an electrical indicator that is coupled to a control system 212. The control system preferably activates the electrical indicator at predetermined times. The indication may be a visual signal (e.g., light), an audio signal (e.g., a tone), or a tactile signal (e.g., a vibration). The indication may be located in the vicinity of the activation point. In an embodiment, a separate indicator is produced to indicate to a participant when to apply a participant signal to activation points to separately activate the sound system, lighting system, and fountain system.

Alternately, the indication may be provided by a conductor 216. As described herein, "conductor" is taken to mean any object or mechanism for coordinating the actions of the participants to create desired visual and/or sound effects by activating the sound system and/or lighting system and/or fountain system. The conductor may be an individual that motions and/or speaks to participants to signal the participants when to apply a participant signal to an activation point. The conductor may speak into a microphone, and the volume of the conductor's voice may be increased by a speaker 220 directed toward the participants. Individual speakers 220 may be located proximate each instrument or set of activation points corresponding to an instrument so that the conductor may communicate to selected participants at different times. Alternately, the conductor may be a robotic arm for directing the participants. In an embodiment, the conductor may be a projected image. For instance, different colors or images may be displayed on the screen at predetermined times, wherein each color or image corresponds to a different instrument or group of instruments. The display of a particular color or image may indicate to selected participants to apply a participant signal to selected activation points. Platform 214 preferably supports conductor 216. Platform 214 is preferably at an elevational level above the participants and activation points 202 so that the participants may easily see conductor 216.

Figure 18:
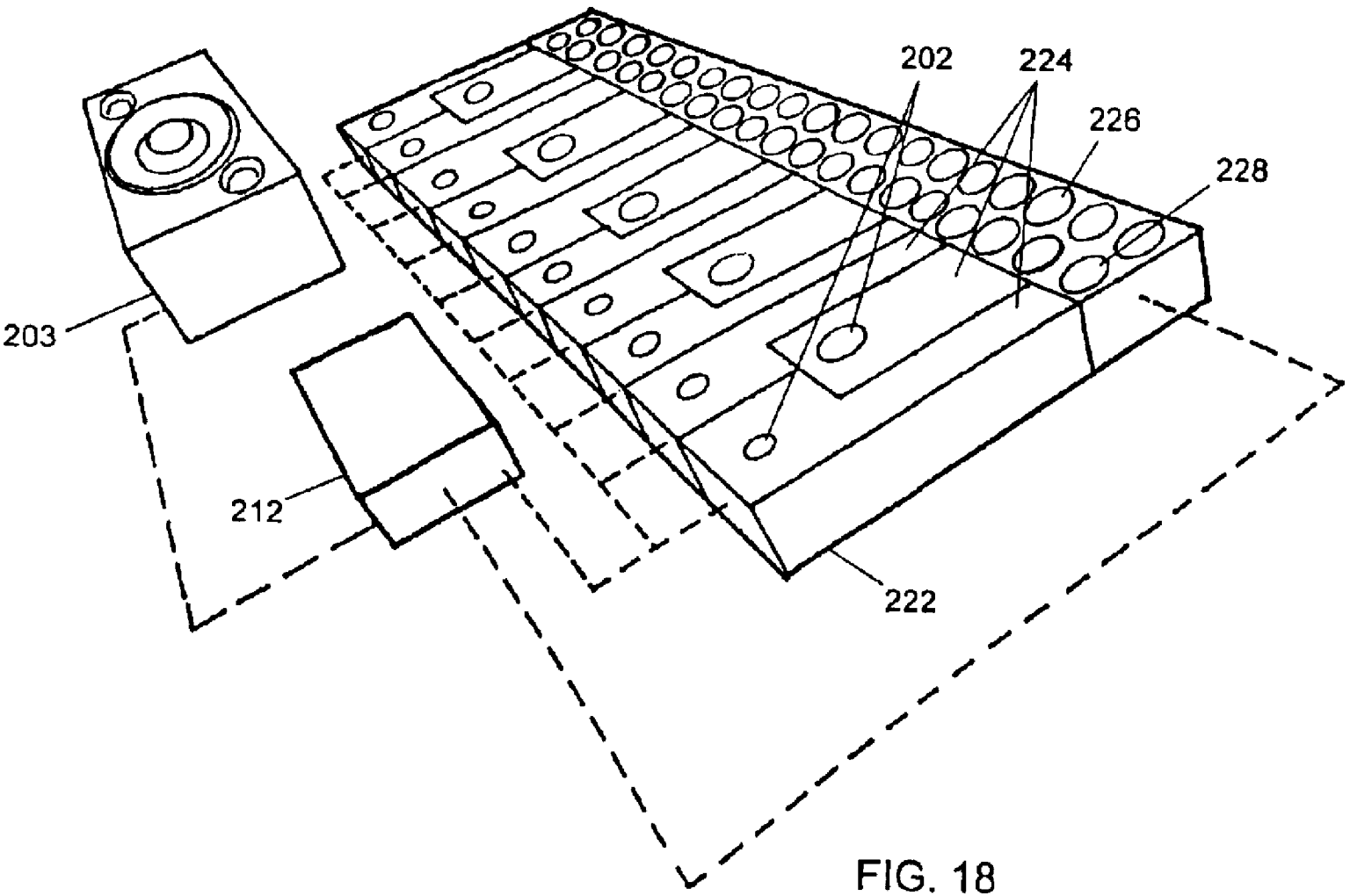
FIG. 18 is a perspective plan view of a keyboard which is an element of a sound system.
Figure 19:
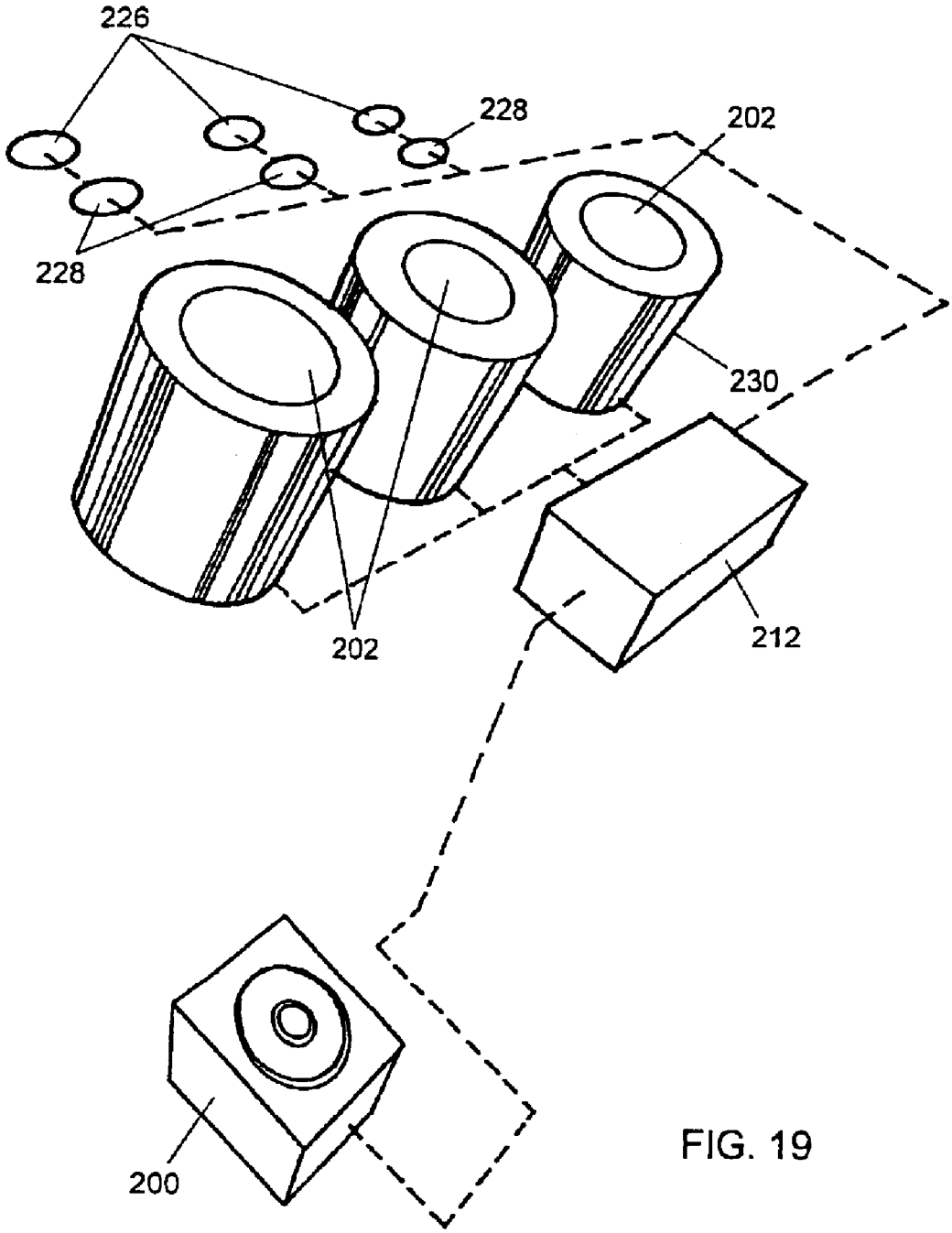
FIG. 19 is a perspective plan view of a drum set which is one element of a sound system.
Figure 20:
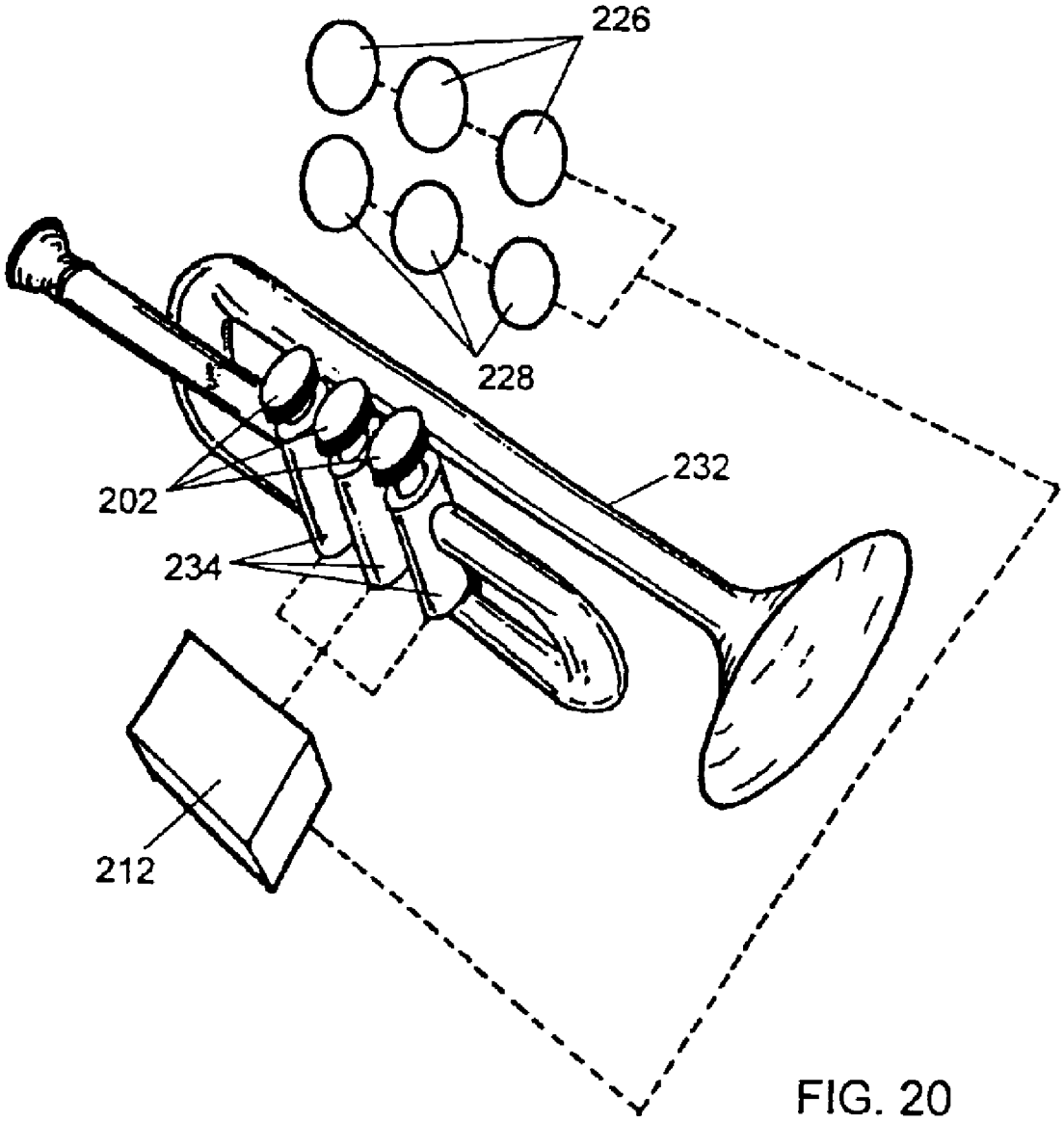
FIG. 20 is a perspective plan view of a trumpet which is one element of a sound system.
Figure 21:
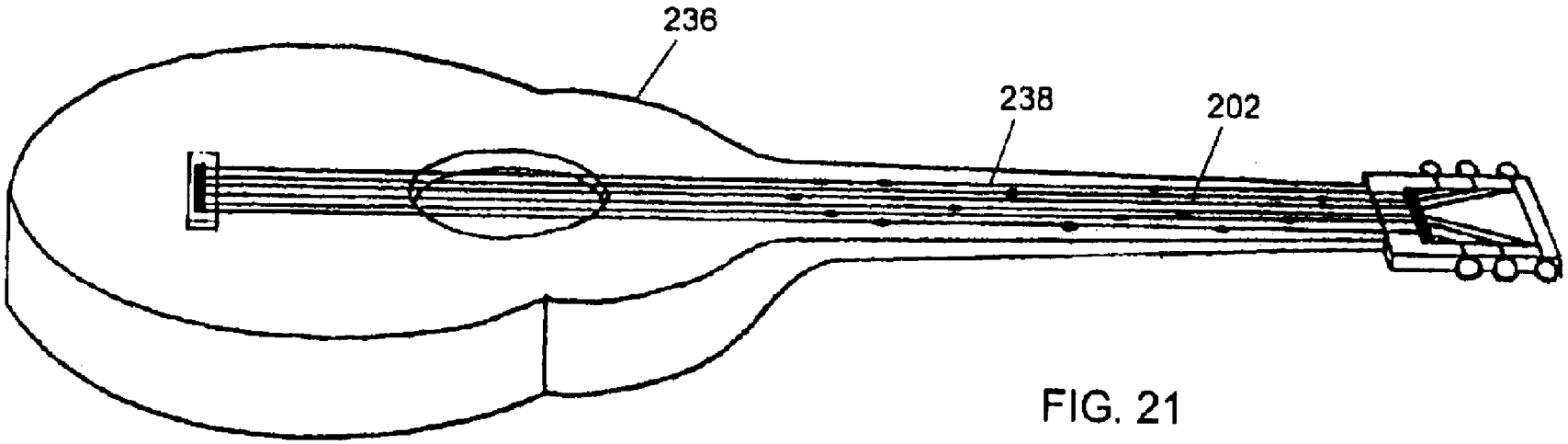
FIG. 21 is a perspective plan view of a guitar which is one element of a sound system.
Figure 22:
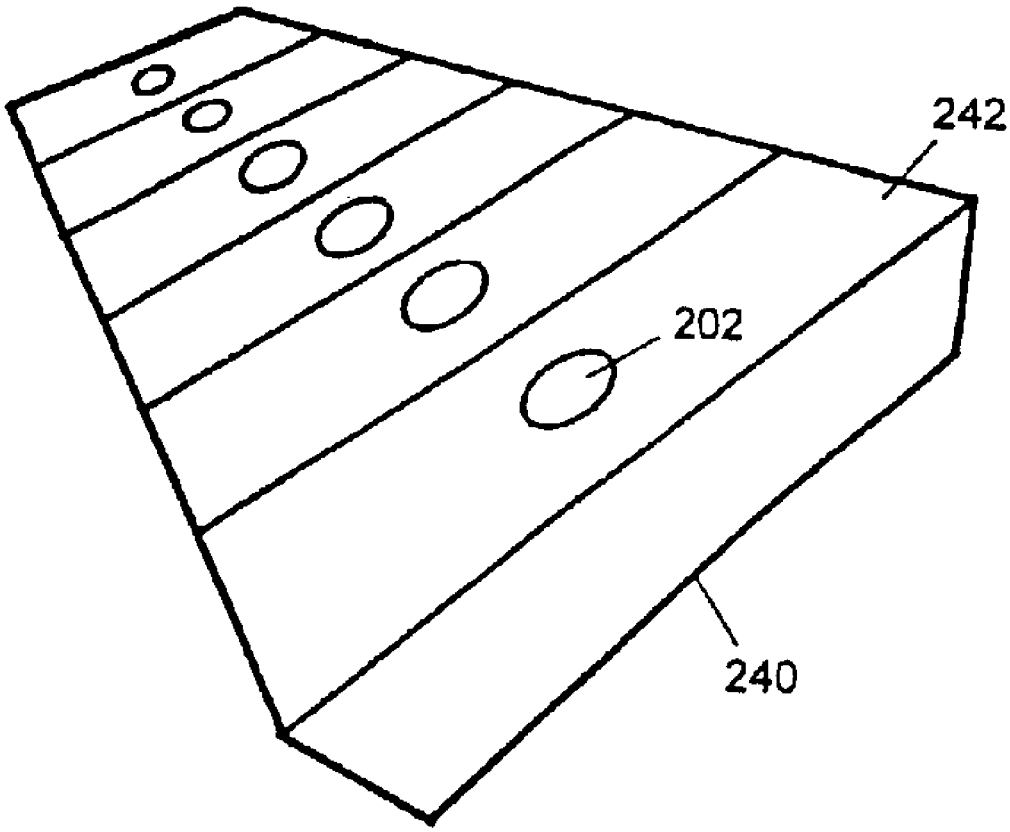
FIG. 22 is a perspective plan view of a xylophone which is one element of a sound system.

FIG. 18 illustrates one type of instrument which may belong to the "orchestra" of instruments activated by the participants. This instrument is a keyboard 222 having a plurality of keys 224. Each key 224 preferably contains an activation point 202 that is electrically coupled to control system 212. In an embodiment, keys 224 are large enough to support a participant standing thereon. In an embodiment, the weight of a participant serves as a force applied to a pressure sensitive activation point 202 to generate a participant signal. Activation point 202 preferably senses the force and generates a first signal and a second signal. Control system 212 may relay the first signal to a sound system 203 that may produce the appropriate note for the pressure point (e.g., key) contacted on keyboard 222. Control system 212 may also send the second signal to a fountain system (not shown) to cause water to be sprayed from the fountain. The water may be sprayed as a result of the opening of a valve in response to the second signal, as described above.

A visual indicator, for example, lights 226 and 228 may indicate when a force should and should not be applied to a certain pressure point. Lights 226 and 228 may be coupled to control system 212 which activates the lights at appropriate times. One of the lights preferably indicates when a participant should apply a force onto (e.g., stand on) one of the activation points 202 while another light preferably indicates when the participant should discontinue application of force onto the activation point. A musical note or sequence of musical notes may be played by sound system 203 in response to various participants applying forces to activation points 202. It is to be understood that lights 226 and 228 may be different colors. In one embodiment, light 226 is red and light 228 is green. In an alternate embodiment, a single light may be activated to indicate to a participant to apply a force to an activation point. The light may be one of a variety of colors, such as yellow, green, red, blue, purple, and orange. After the participant has applied force to the activation point the light may be turned off by control system 212 to indicate when the participant should discontinue applying force to the activation point.

FIGS. 19–22 depict a drum set 230, a trumpet 232 (horn), a guitar 236, and a xylophone 242, respectively. These instruments as well as other instruments may be included in the musical water fountain "orchestra". They preferably operate in a similar manner to keyboard 222 of FIG. 18. Activation points 202 may be located on each drum 230, on each playing valve 234 of trumpet 232, on each string 238 of guitar 236, and on each key 242 of xylophone 240. A participant may apply a force to an activation point by standing on it or by contacting it with a finger or hand. The activation points 202 may be in the form of a button, a lever, etc.

Figure 23:
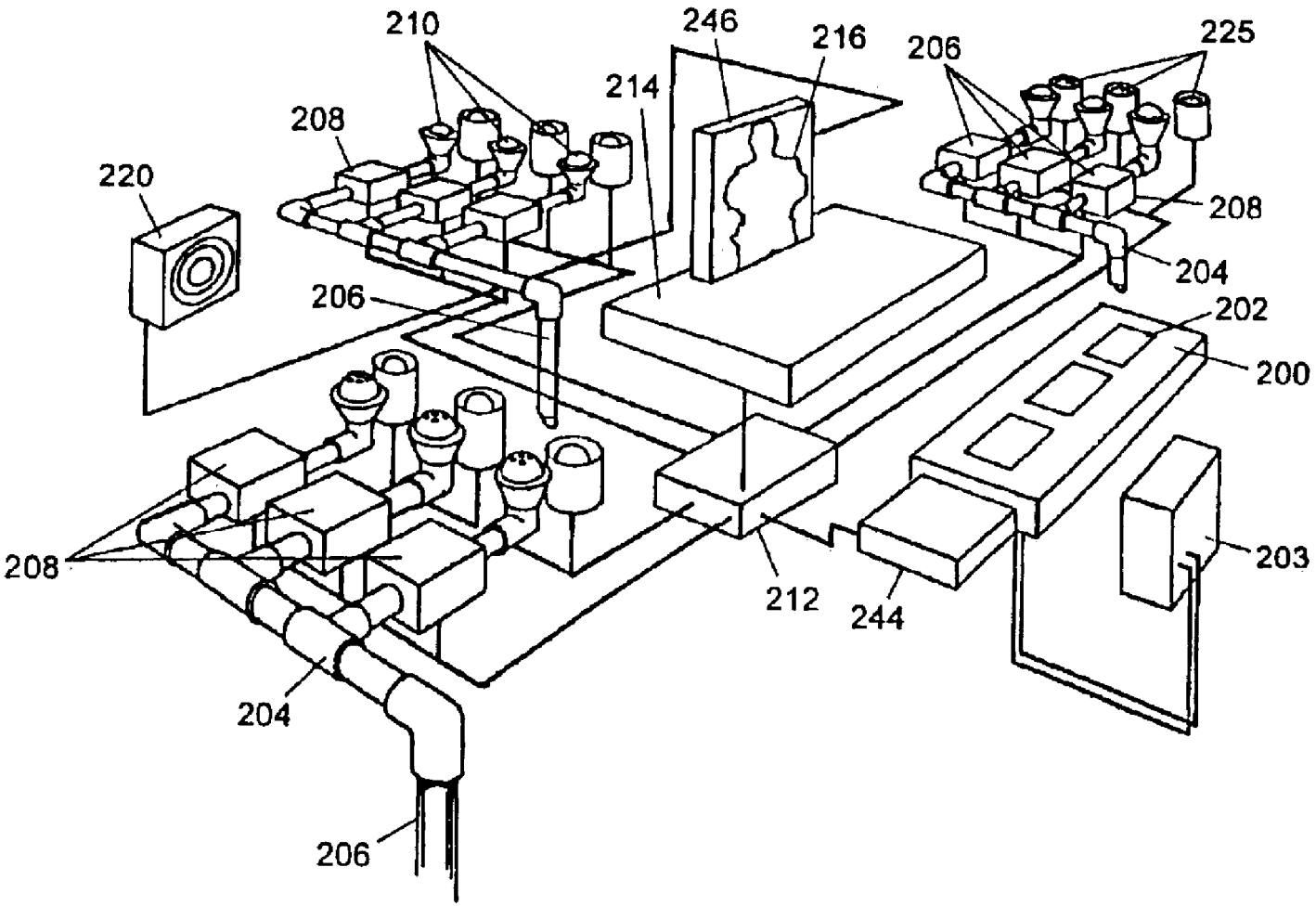
FIG. 23 is a perspective plan view of an alternate embodiment of a musical water fountain system having a plurality of fountain systems.

FIG. 23 illustrates an embodiment of a water fountain system having a plurality of fountain systems 204. This embodiment preferably contains the same features of the previous embodiment with some alternatives. Each fountain system 204 preferably includes a conduit 206, valves 208, and nozzles 210, allowing water to spray in a multitude of directions. Conductor 216 may be an image projected onto a screen 246 (television or movie screen) so that a person or robot need not be present to conduct music. Screen 246 is preferably positioned on platform 214 so that participants in the "orchestra" may see it. A participant may apply a participant signal to a particular activation point 202 in response to receiving an indication from an electrical indicator at a pre-determined time. Upon sensing the force, control system 212 preferably generates signals that are relayed to sound system 203, one of the fountain systems 204, and/or one of the light systems 208. In response to receiving a signal from control system 212, sound system 220 may produce a musical note, one or more of valves 208 may open to spray water, and certain lights 225 may become activated. The lights that are activated are preferably in close proximity to the fountain system from which water is being sprayed. The cooperative effort of the participants at each of the individual fountains may create a pleasant musical tune and/or visual display (lights and/or water displays).

In an embodiment, control unit 212 receives the signals generated in response to the participant's signals being applied to the activation points 202. Control unit 212 then indicates to the sound system the appropriate time to play a particular note. The computer preferably controls operation of sound system 220 such that the resultant music is affected by the presence of particular first signals and the order in which such signals are relayed to control unit 212. In this manner, whether or not a participant applies a signal to an activation point 202 and the time at which a participant applies a signal to one or more activation points may affect the music produced by sound system 203. Control unit 212 may receive the participant signals from activation points 202 and delay playing of sounds by sound system 203 for a predetermined time (e.g., ten seconds or more). Alternately, sound system 203 may play a musical note substantially immediately upon receiving the first signal. In an alternate embodiment, control unit 212 may be programmed to cause a sequence of notes to be produced at a particular time so that a song is correctly played even when the participants do not contact activation points 202 at appropriate times.

In another embodiment, a single fountain system may include a plurality of different activation points for producing various sounds, lights, and/or fountain effects. Each of the activation points may activate an instrument, or some notes of an instrument when a participant signal is applied to the activation point. A conductor may be used to signal the activation of the instruments or of specific notes of the instruments. A group of participants may respond to the conductor's indications such that a musical tune is produced.

In another embodiment, water from the musical fountain may be used to create the sounds produced by the musical fountain system. For example, a plurality of activation points may be disposed about a fountain system. The activation points are preferably coupled to a water spray system. In response to a participant's signal, the activation point preferably causes a stream of water to be fired which then impacts a sound producing device. The impact of the water stream against the sound producing device preferably produces a sound. For example, the sound producing device may be a series of gongs which, when struck with a water stream, produces a ringing sound. Other sound devices which may produce a sound when contacted with water include but are not limited to percussive instruments (e.g., drums), bells, tubes, and chimes.

In another embodiment, the musical fountain system may be a bubble organ. The bubble organ preferably includes a series of pipes arranged in a manner that is typical of a pipe organ. The pipes are preferably made of a substantially transparent material. A series of activation points may be disposed about the bubble organ. In response to a participant's signal, the activation point preferably produces an organ like sound while simultaneously producing a fountain effect. Preferably, the fountain effect includes the production of bubbles, such that bubbles emanate out of a top portion of the pipes. A lighting system may also be coupled to the pipes such that the participant's signal activates the light such that the bubbles appear to be colored as they move through the pipe.

In another embodiment, the musical fountain may be constructed in the form of a walkway. A plurality of activation points are preferably arranged on the surface of the walkway such that participants may step on the activation points. The activation points are preferably configured to respond to the weight of the participants. As the participants move along the walk way, they may contact the activation points such that a musical and/or a fountain effect is produced. For example, when a participant steps on an activation point, a portion of a song may be played by a sound system coupled to the walkway. Additionally, a fountain effect, such as a stream of water, may be produced.

IV. Water Ferris Wheel System

Figure 24A:
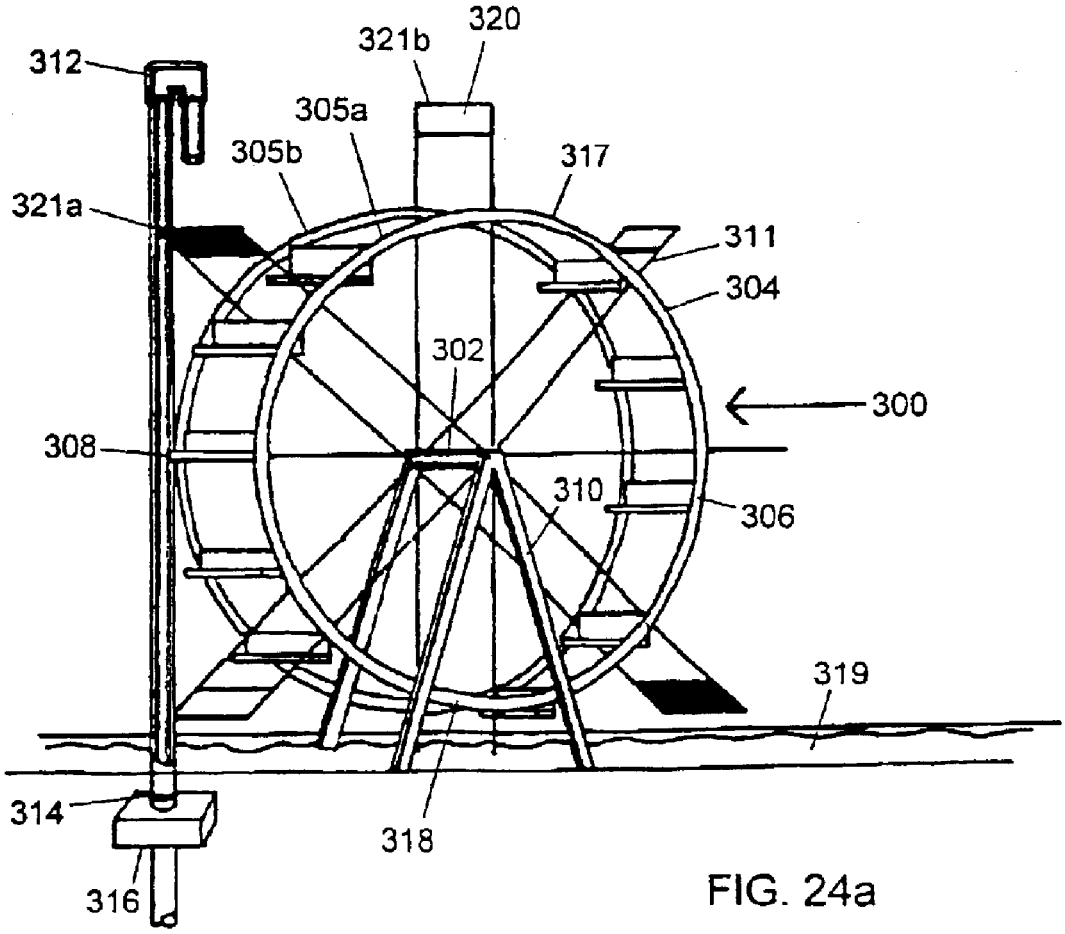
FIG. 24*a* is a perspective view of one embodiment of a water-powered Ferris wheel system.

Turning to FIG. 24*a*, an embodiment of a water Ferris wheel system is depicted. A rotatable Ferris wheel 300 preferably includes a central axle member 302 and a support member 304 coupled to central axle member 302. Support member 304 is preferably configured to rotate about central axle member 302. Central axle member may include a hub configured to rotate about the central axle member. Support member 304 is preferably coupled to the hub such that a force imparted on the support member may cause the rotation of the hub about the central axle member. Rotation of the hub preferably causes support member 304 to also rotate.

Support member 304 is preferably substantially circular in shape, although it may be formed in a number of other shapes including triangular, square, diamond, pentagonal, hexagonal, heptagonal or octagonal. Support member 304 preferably has a number of axle members 306 attached to it. Seating devices 308 are preferably connected to axle members 306. At least one water interaction device 320 may be coupled to support member 304. Preferably, a plurality of water interaction devices are coupled to the support member. Water interaction devices 320 may be receptacles configured to hold water, paddles configured to interact with water, or a combination of receptacles and paddles. Water interaction devices 320 are preferably configured to cause rotation of support member 304 when the water interaction devices are contacted with a water stream. A base support structure 310 is preferably coupled to central axle member 302 to elevate support member 304 above the ground. Base support structure 310 may be composed of members which are affixed to the ground.

Support member 304 is preferably coupled to central axle member 302 via elongated struts 311. In one embodiment, support member 304 may include a single outer member. Seating devices 308 are coupled to the outer member via axle members which extend from the outer member.

In another embodiment, a support member includes a pair of outer members 305*a* and 305*b*, both outer members being coupled to central axle member 302 via elongated struts 311, as depicted in FIG. 24*a*. Axle members 306 are preferably positioned between outer members 305*a* and 305*b*. Seating devices 308 are preferably coupled to a support member via axle members 306 such that the seating devices are positioned between the outer member 305*a* and 305*b*.

In either of the above described embodiments of support member 304, the support member is preferably configured to rotate in either a clockwise or counterclockwise direction about central axle member 302. As support member 304 rotates, seating devices 308 are preferably configured to partially rotate about axle members 306 so that they remain in an upright position. Passengers sitting in seating devices 308 may thus remain in an upright position while riding Ferris wheel 300.

The Ferris wheel further includes a water source 319 for supplying a water stream to water interaction devices 320. In one embodiment, the rate of rotation of support member 304 is preferably a function of the flow rate of the water to water interaction devices 320. To achieve a slow rate of rotation a relatively slow flow of water may be selected. Increasing the rate of water preferably increases the force imparted by the water on water interaction devices 320. By increasing the force imparted upon water interaction devices 320, the rotational force imparted by the water interaction devices upon support member 304 is also increased. This increase in force preferably causes an increase in rotational speed of support member 304.

The rate of rotation of support member 304 may be reduced by reducing the flow of water to water interaction devices 320. Stopping rotation of support member 304 may be accomplished by stopping the flow of water to water interaction devices 320. A braking system may also be coupled to support member 304 to further reduce the speed of the support member. Preferably, the braking system is used to control the position at which support member 304 stops rotating. The brake system preferably imparts a force sufficient to inhibit rotation of support member 304 while water is directed at water interaction devices 320. The use of a braking system in this manner facilitates the transfer of participants to and from the Ferris wheel.

Figure 24B:
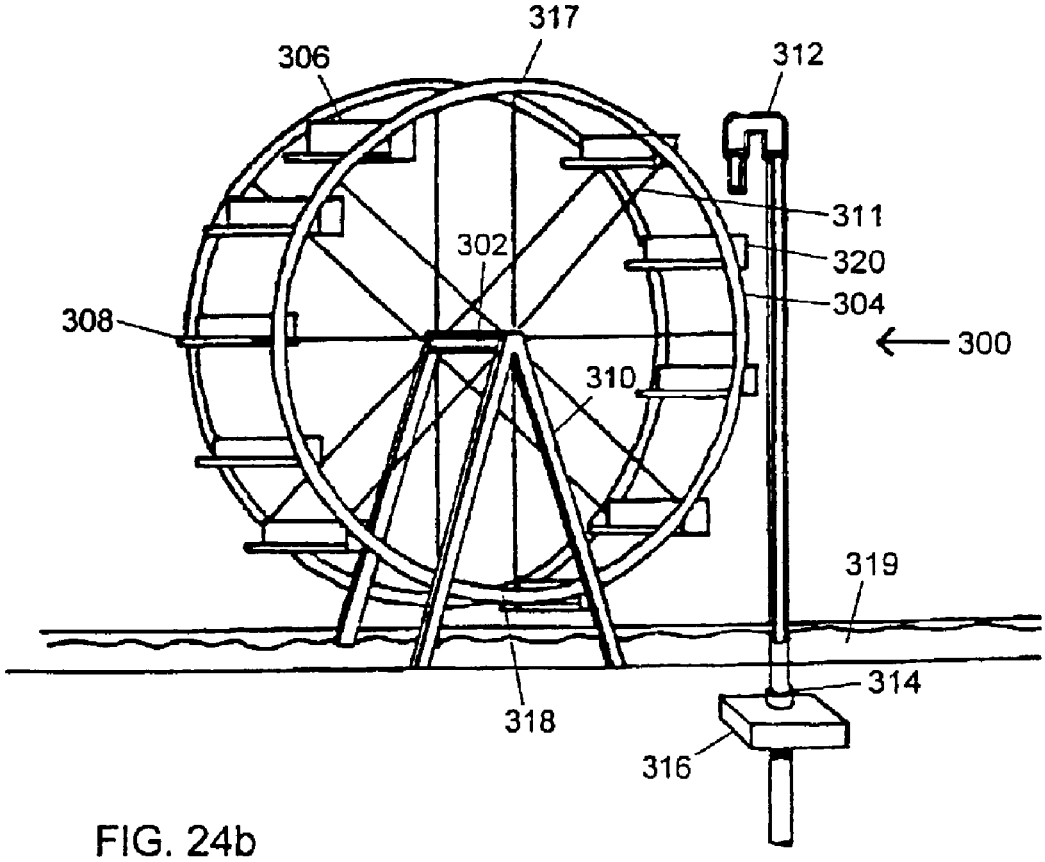
FIG. 24*b* is a perspective view of another embodiment of a water-powered Ferris wheel system.

A conduit 312 is preferably located near Ferris wheel 300 and serves as a water source to Ferris wheel 300. Conduit 312 may be composed of a PVC or galvanized steel type material. Conduit 312 preferably contains a valve 314 and a pump 316. Pump 316 is preferably located upstream of valve 314. When valve 314 is opened, water is preferably forced by pump 316 up conduit 312. Conduit 312 preferably directs water to water interaction devices near support member 304. Preferably, conduit 312 is positioned such that the conduit delivers water to water interaction devices 320 at a position substantially above central axle member 302. In one embodiment, conduit 312 delivers water to water interaction devices at a position approximately level with the central axle member, as depicted in FIG. 24*b*. By positioning conduit 312 approximately level with central axle member 302, a tangential stream of water may be delivered to water interaction devices 320 in a position which minimizes the amount of water reaching the participants. The flow of water from conduit 312 to water interaction devices 320 preferably drives rotation of support member 304 about central axle member 302.

Figure 26:
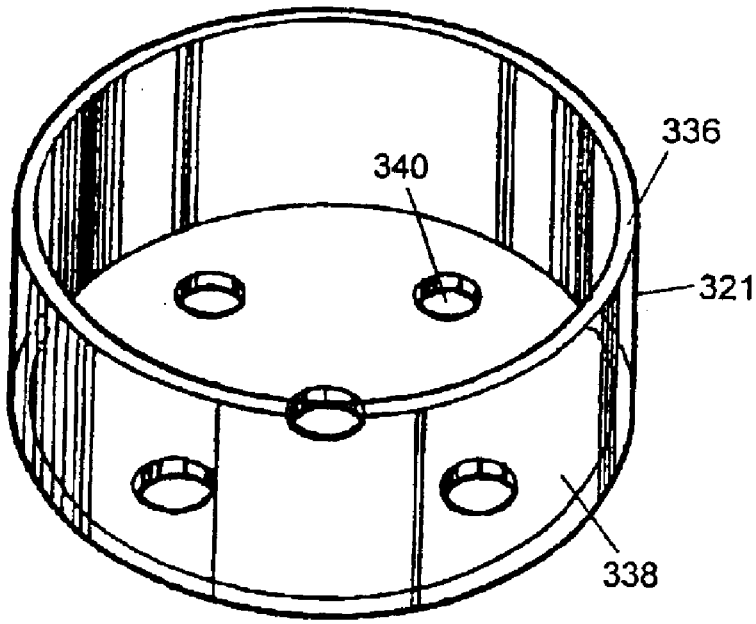
FIG. 26 is a perspective view of an embodiment of the receptacle of a Ferris wheel system.

In one embodiment, water interaction devices 320 are preferably composed of water receptacles (one embodiment of a receptacle is depicted in FIG. 26). The receptacles may be positioned near support member 304. The receptacles may be any container that can hold a large amount of water. The receptacles may have a variety of shapes and cross sections including, but not limited to, cylindrical (e.g., a bucket), rectangular, semi-circular (e.g., like a scoop), cubic, pyramidal, etc. The receptacles preferably hold enough water to initiate rotation of support member 304 about central axle 302. Preferably, the volume of at least one of the receptacles is greater than that of at least one of the seating devices 308.

The water interaction devices may include at least two water interaction devices 320 positioned about support member 304. Rotation of support member 304 about central axle member 302 is preferably initiated by contacting the first water interaction device 321*a* with a water stream from conduit 312, when the first water interaction device 321*a* is near water conduit 312. After rotation of the Ferris wheel has begun, first water interaction device 321*a* rotates toward a bottom position 318 of the Ferris wheel. As first water interaction device 321*a* is rotated to the bottom position 318, a second water interaction device 321*b* moves to the position vacated by first water interaction device 321*a*. The second water interaction device 321*b* then contacts the water stream coming from conduit 312, allowing further rotation of support member 304. When the first water interaction device reaches bottom position 318 of the Ferris wheel, the first water interaction device is preferably no longer in contact with the water stream. The first water interaction device is then carried by further rotation of support member 304 back to water conduit 312 where the first water interaction device is again contacted with a water steam. Preferably, a plurality of water interaction device are used in this manner to rotate support member 304.

In one embodiment, the water interaction devices 320 are preferably oriented tangentially to support member 304. The water interaction device are preferably fixed about support member 304, such that rotation of the water interaction device is substantially inhibited. Thus, they may be upright at apex 317 of support member 304 and upside-down near a bottom portion 318 of support member 304. As the water interaction device approach bottom portion 318, they preferably begin to release water that is being held by the water interaction device. When the water interaction devices reach the bottom portion 318 of support member 304 any remaining water is preferably emptied into the reservoir 319. The now empty water interaction devices may be propelled upward on the opposite side of support member 304 by the rotational force produced by the water filled water interaction devices. This cycle preferably continues as long as valve 314 is open.

In another embodiment, the water interaction devices may be receptacles, as depicted in FIG. 26. Receptacles are pivotally attached to axle members 306 or 322. The receptacles thusly attached may partially rotate around the axle members, thereby remaining upright as support member 304 rotates them from apex 317 to bottom portion 318. Upon reaching bottom portion 318, the receptacles may be rotated to a position from which they can release the water they are carrying. A receptacle rotation system may be coupled to the receptacles. Receptacle rotation system preferably causes the receptacles to rotate to the water releasing position when the receptacles reach bottom portion 318.

In an embodiment, water interaction devices 320 are laterally offset from support member 304 in a direction away from seating devices 308, as depicted in FIG. 24*a*. The water interaction devices 320 may be laterally offset from the seating device in a direction away from central axle member 302. This positioning of water interaction devices 320 away from seating devices 308 and central axle member 302 may help to inhibit-water from contacting passengers within seating devices 308. Alternatively, the water interaction devices 320 may be laterally offset from the seating device in a direction toward central axle member 302. This positioning of water interaction devices 320 away from seating devices 308, but toward central axle member 302, may allow the water released from the water interaction devices to contact the passengers within seating devices 308.

In one embodiment, the Ferris wheel system may further include a reservoir 319 located on the ground below Ferris wheel 300. Reservoir 319 may collect water falling from conduit 312, forming a pool. Water falling into reservoir 319 may be recycled back through conduit 312.

Figure 25A:
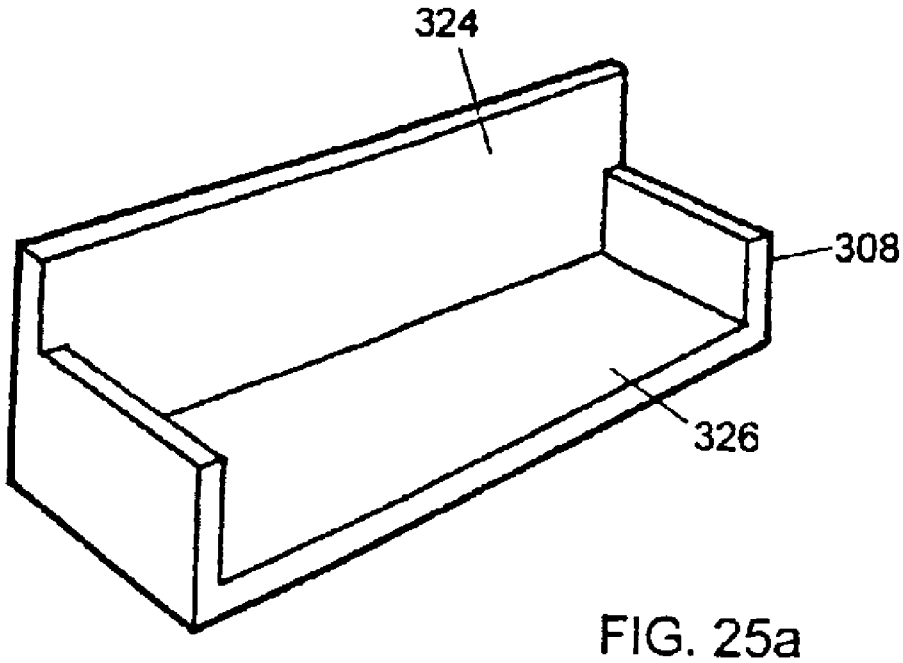
FIG. 25*a* is perspective view of an embodiment of a seating device of the Ferris wheel system.
Figure 25B:
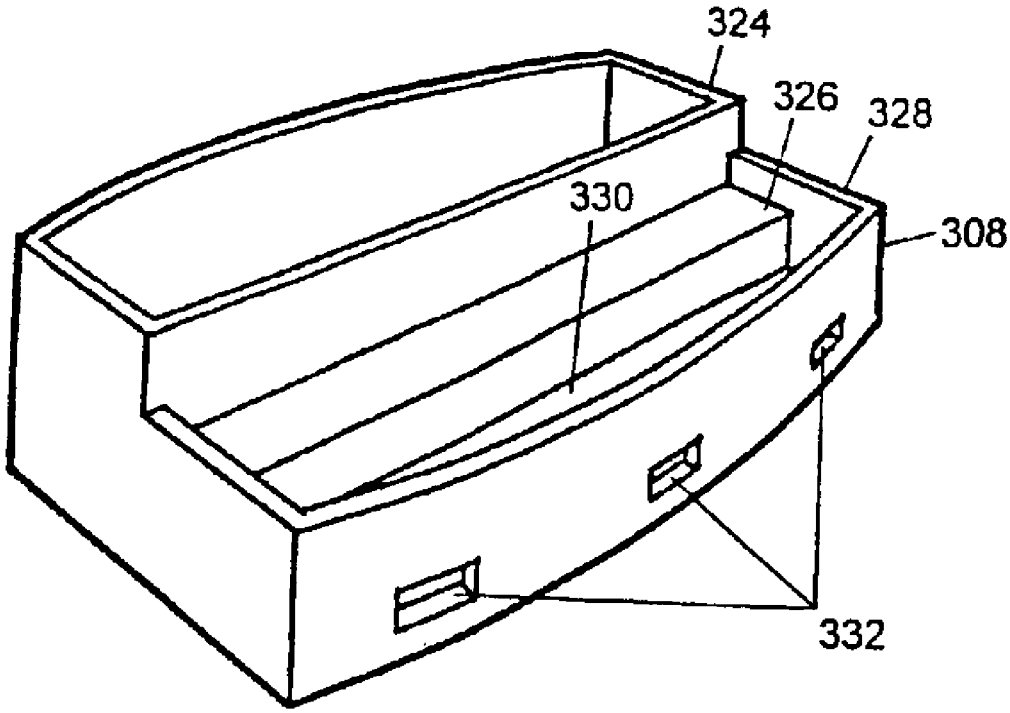
FIG. 25*b* is a perspective view of an embodiment of a seating device of the Ferris wheel system.

FIG. 25*a* illustrates an embodiment of seating device 308. Seating device 308 may hold passengers as Ferris wheel 300 is rotated. Seating device 308 may have a shape that resembles a figure such as, for example, a square, a circle, a triangle, a cone, a sphere, an animal, an insect, a plant, a dinosaur, a space ship, an inner tube, a boat, an auto, an airplane, a musical instrument, etc. Seating device 308 may include an upright portion 324 and a horizontal portion 326. Horizontal portion 326 preferably supports the weight of at least one passenger. FIG. 25*b* depicts a cross-sectional view of another embodiment of seating device 308. Seating device 308 also has upright and horizontal portions, but it further includes vertical sidewall surfaces 328 so that passengers are surrounded on all sides by walls. Seating device 308 also includes a floor 330 that may retain water that may contact the seating device. Openings 332 preferably allow the water to pass through floor 330, preventing the water from completely filling the inside portion of seating device 308.

Figure 25C:
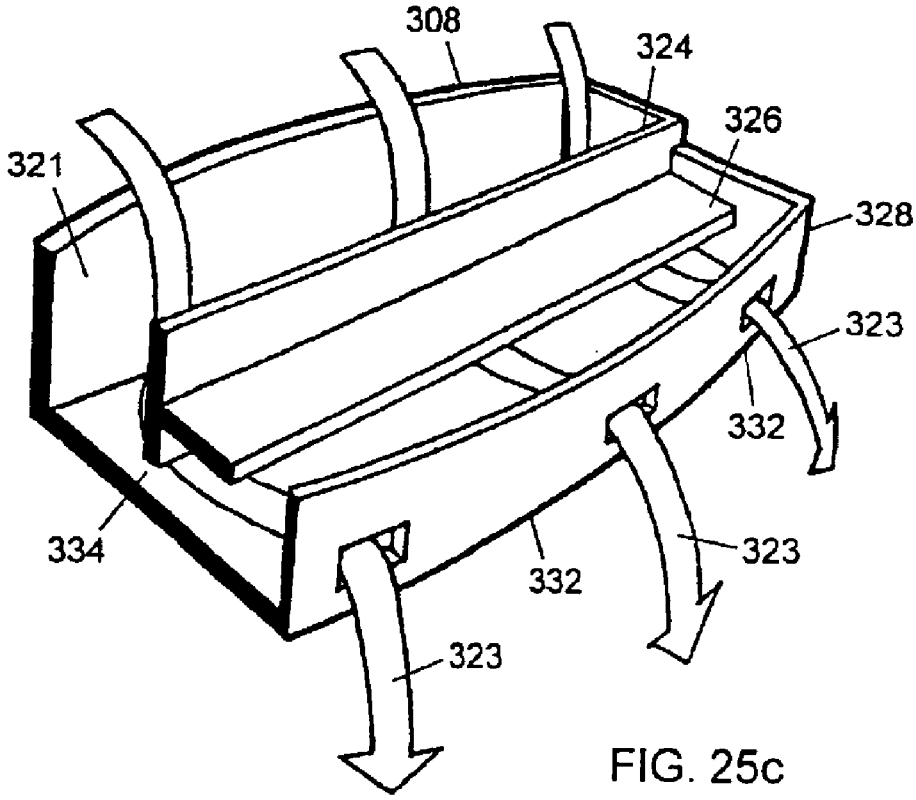
FIG. 25*c* is a perspective view of an embodiment of a seating device of the Ferris wheel system which includes a receptacle for receiving water.

In an embodiment, at least one water interaction device may be attached to at least one of seating devices 308. Preferably, water interaction devices may be attached to some or all of the seating devices. A receptacle or a paddle may be attached to a seating device. Alternately, the seating device itself may also be a water interaction device. FIG. 25*c* illustrates a cross-sectional view of a seating device 308 in which a receptacle 320 is part of seating device 308. Upright portion 324 is preferably located between receptacle 320 and horizontal portion 326 where passengers may sit. An opening 334 may exist at the bottom of upright portion 324 so that water 323 may pass from receptacle 320 to the area where passengers may sit. Openings 332 through floor 330 allow water 323 to pass from seating device 308.

Turning to FIG. 26, a top plan view of one embodiment of a receptacle 321 is depicted. Receptacle 321 may have an upper lip 336 that is circular in shape. Upper lip 336 preferably surrounds an opening through which water may pass into and out of receptacle 321. The bottom 338 of receptacle 321 may also be circular in shape. Receptacle 321 may retain a large amount of water; however, openings 340 in receptacle 321 preferably help drain the water slowly from the receptacle. As receptacle 321 rotates from the apex to the bottom portion of the support member, water may be released through openings 340. Therefore, less water may have to be released when receptacle 321 completely reaches the bottom portion of the support member.

The above described embodiments may be configured such that the passengers remain substantially dry or become substantially wet during the ride. In one embodiment, the seats are preferably configured to inhibit water from reaching the participants. Seating devices 308 may include a roof configured to redirect any water falling onto the roof away from the seating device. Water from water interaction devices 320 and conduit 312 may thus be kept off of the passengers during operation of the Ferris wheel. The flow of water falling upon the roof is preferably directed into reservoir pool 319 for reuse.

Additionally, valve 314, which supplies the flow of water to conduit 312, may be configured to sequentially turn on and off such that discontinuous streams of water are produced. The discontinuous streams of water preferably are timed such that the water will flow out of conduit 312 when water interaction device 320 is positioned below an opening of conduit 312. As water interaction device 320 moves past conduit 312, the flow of water through conduit 312 is preferably reduced such that a minimal amount of water falls into seating devices 308.

In another embodiment, seating devices 308 may be configured to allow the participants to become substantially wet. In one embodiment, depicted in FIG. 24*b*, seating devices 308 are opened ended (i.e., do not have a roof). As seating devices 308 pass by conduit 312, water that falls onto water interaction devices may also fall into the seating devices, causing the passengers to become substantially wet. Seating devices 308 preferably include slots, as described above, to allow the incoming water to be removed from the seating devices. The Ferris wheel system may include a water regulation system for varying the amount of water falling from conduit 312 onto the passengers. The water regulation system may decrease flow of water from conduit 312 when seating devices 308 pass under the conduit. Further, water regulation system may increase the flow of water from conduit 312 as water interaction devices 320 pass under the conduit.

Preferably, seating devices 308 may include a roof The roof may be configured to allow a substantial amount of water to pass through the roof onto the passengers. As the seat passes below water conduit 312, or as water from the water interaction devices 320 falls onto the roof, the water may pass through the roof onto the passengers. Seating devices 308 preferably include slots, as described above, to allow the incoming water to be removed from the seating devices.

Figure 27:
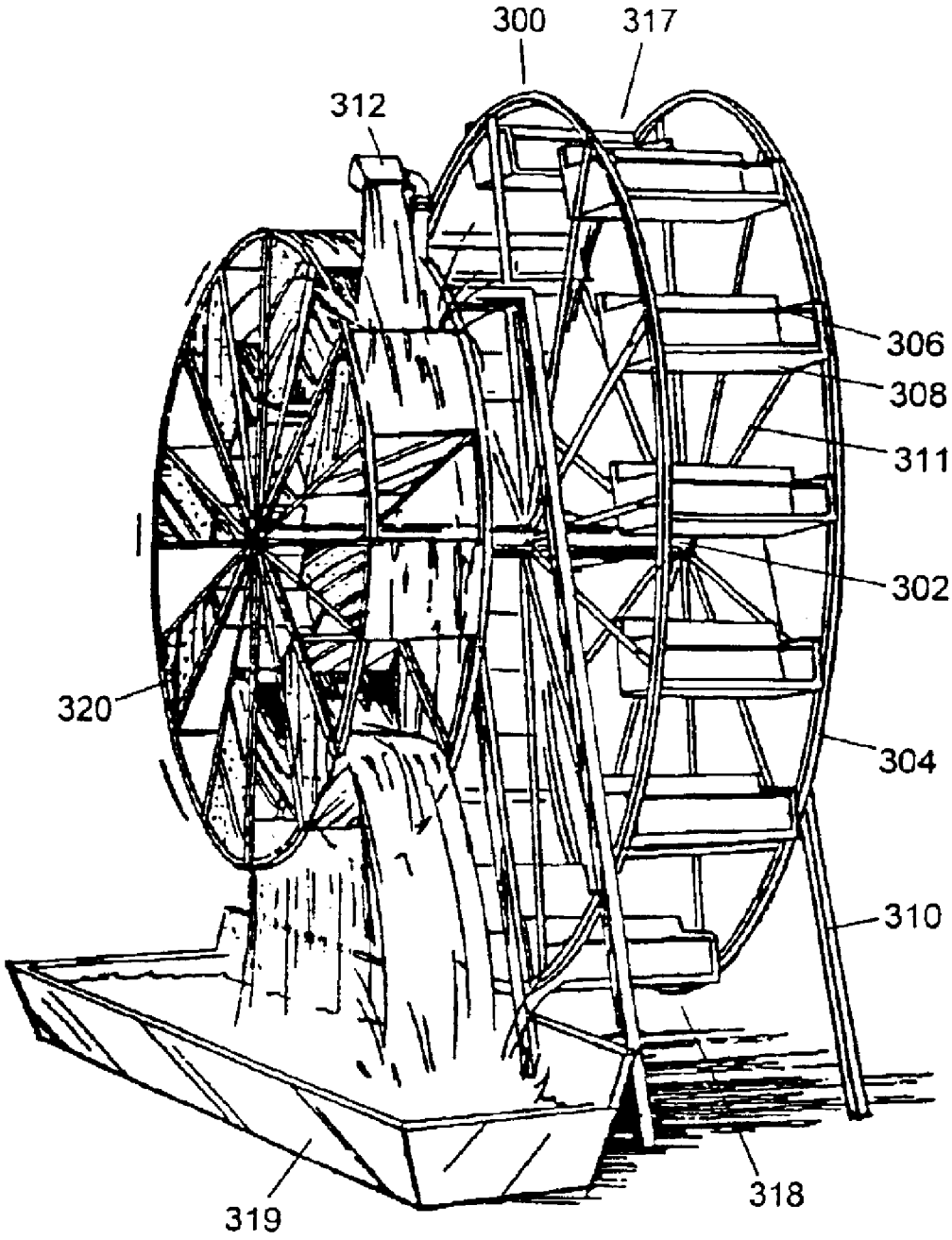
FIG. 27 is a perspective view of an embodiment of a water Ferris wheel system.

In another embodiment, depicted in FIG. 27, a rotatable Ferris wheel 300 preferably includes a central axle member 302 and a support member 304 attached about axle member 302. Support member 304 preferably has a number of axle members 306 attached to it. Seating devices 308 are preferably connected to axle members 306. As support member 304 rotates in either a clockwise or counterclockwise direction, seating devices 308 are configured to partially rotate about axle members 306 so that they remain in an upright position. Passengers sitting in seating devices 308 may thus remain in an upright position while riding Ferris wheel 300. Seating devices 308 are preferably oriented such that the seating devices lie in a first plane.

Water interaction devices 320 are preferably coupled to support member 304 near a central portion of the Ferris wheel. Water interaction devices 320 are preferably spaced a lateral distance away from seating devices 308. Thus, water interaction devices 320 are formed in a second plane which is substantially parallel to the first plane. The second plane is preferably laterally displaced away from the first plane. By displacing water interaction devices 320 away from the seating devices 308 in this manner, water may be inhibited from reaching the seating devices, thus allowing the participants to remain substantially dry while riding the Ferris wheel. Water interaction devices 320 may be placed relatively close to a central axis of the Ferris wheel. Water interaction devices 320 may include receptacles, as described above or paddles configured to interact with a flow of water.

Figure 28:
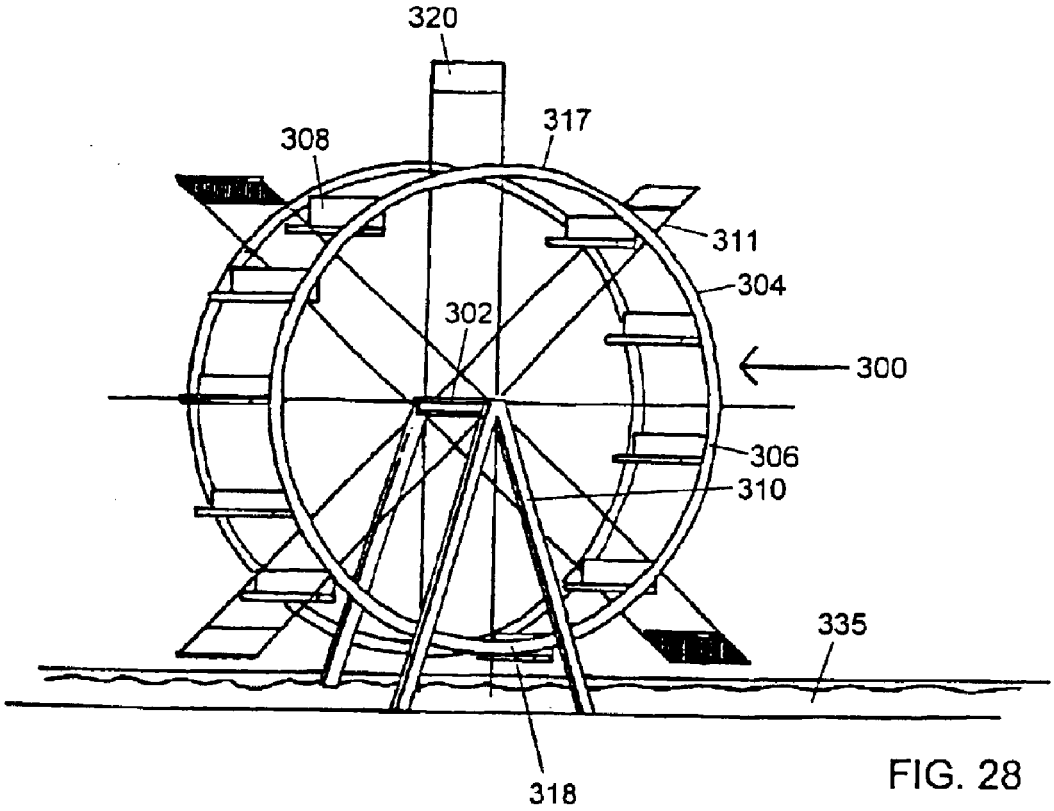
FIG. 28 is a perspective view of an embodiment of a water Ferris wheel system.

In another embodiment, depicted in FIG. 28, the Ferris wheel may be propelled by a stream of water 335 formed underneath the Ferris wheel. The Ferris wheel includes a number of seating devices 308 located about a support member 304, as described above. Water interaction devices 320 preferably extend from support member 304 in a direction away from central axle member 302. Water interaction devices may be paddles or receptacles. A stream of water 335 preferably runs below a bottom portion of support member 304. Water interaction devices 320 are preferably positioned about an outer edge of support member 304 such that the water interaction devices which are at a bottom portion of the support member are partially inserted within the water stream.

Support member 304 is preferably rotated by causing a current to be formed in the water stream. As the water stream passes under the support member 304, the water contacts water interaction devices 320 causing the support member to begin to rotate. As the support member rotates additional water interaction devices 320 may enter the water. The rotation of support member 304 preferably continues until the water stream is stopped, or a braking system, as previously described, is applied. Preferably, a combination of stoppage of water and the application of a braking force is used to stop the Ferris wheel. The participants preferably remain substantially dry while riding the Ferris wheel.

All of the above embodiments relate to a water driven Ferris wheel system. The use of a water driven Ferris wheel system offers advantages over conventional Ferris wheel systems. One advantage is that the passengers may become substantially wet during the ride. The wetting system is preferably incorporated into the water propulsion system such that use of a separate wetting system is not required to wet the passengers. Additionally, energy usage may be minimized by making use of natural sources of water streams (e.g., a river or a waterfall).

V. Water Powered Bumper Vehicle System

Figure 29:
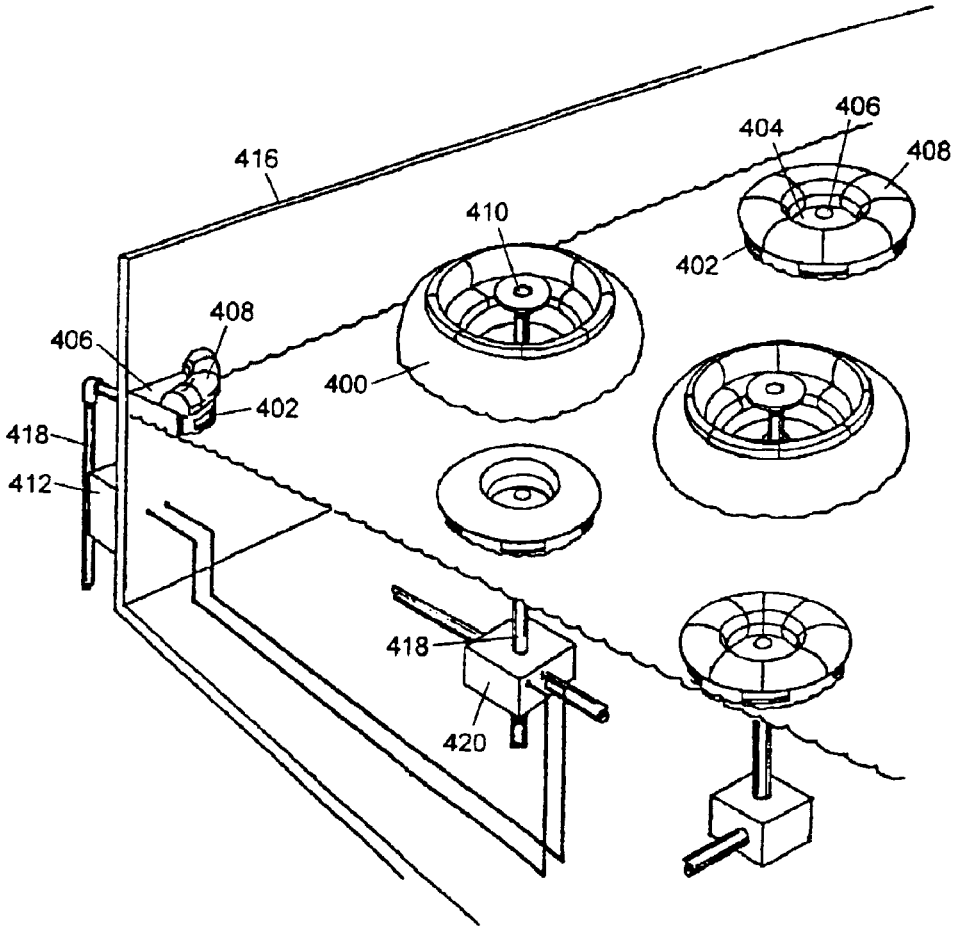
FIG. 29 is a perspective view of an embodiment of a water-powered bumper vehicle system.

Turning to FIG. 29, an embodiment of a water propelled bumper vehicle system is depicted. The water bumper vehicle system preferably includes vehicles 400 to hold participants. The vehicles may be floating on water or resting on a platform. Vehicles 400 may be composed of a material such as a strong plastic that enables them to float and to withstand the impact of other vehicles. Vehicles 400 may have a shape that resembles a figure such as, for example, a square, a circle, a triangle, a cone, a sphere, an animal, an insect, a plant, a dinosaur, a space ship, an inner tube, a boat, an auto, an airplane, a musical instrument, etc.

Vehicles 400 preferably have steering systems 410 that participants can manually maneuver in order to help control the direction the vehicles travel. Vehicle 400 may include a seat 436 on which a participant may sit inside the shell of the vehicle. A participant restraint system (e.g., a seat belt) is preferably included within the shell of the vehicle. The participant restraint system preferably inhibits the participant from being thrown from seat 436 when the vehicle is contacted by water (e.g., from a nozzle) or by another vehicle.

The water bumper vehicle system further preferably includes a plurality of nozzles 402 that are positioned to direct water towards vehicles 400. The force of the water against vehicles 400 preferably imparts momentum to the vehicles, causing them to move in different directions. Thus, vehicles 400 may impact other vehicles, and/or walls which surround the water bumper vehicle system. Nozzles which may be used to direct water towards the vehicles are described in U.S. Pat. No. 5,213,547 to Lochtefeld and U.S. Pat. No. 5,503,597 to Lochtefeld et al.

Figure 32:
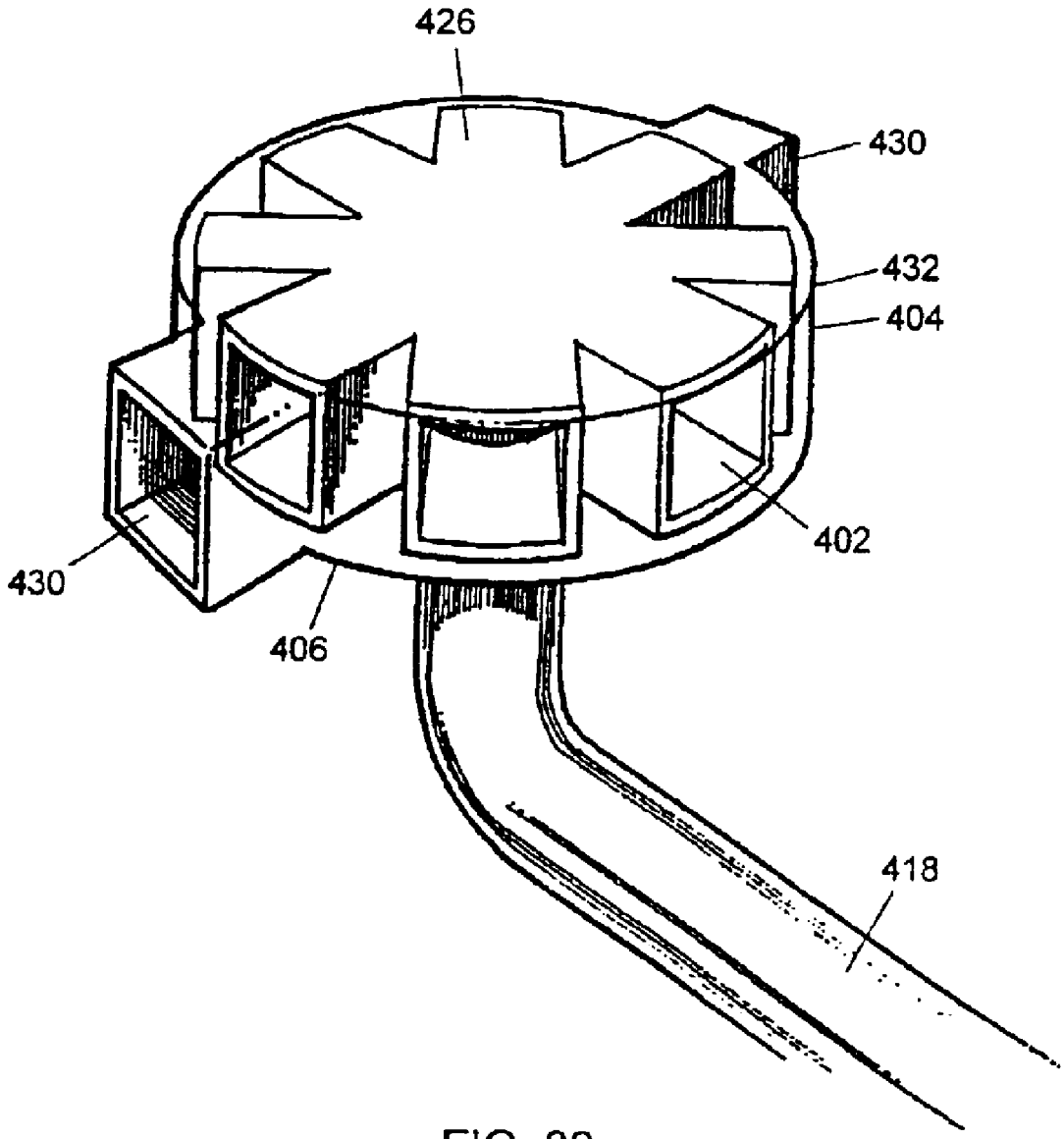
FIG. 32 is a cross-sectional view of an embodiment of a nozzle assembly of a water bumper vehicle system.

Turning to FIG. 32, an embodiment of a detailed cross-sectional view of a nozzle assembly 404 is illustrated. Nozzle assembly 404 preferably includes a valve 406 having a head 426. A plurality of nozzles 402 may be attached to head 426. Nozzles 402 preferably extend outward from head 426 to an inner surface of a curvate structure 432. Curvate structure 432 preferably surrounds head 426. Conduit 418 preferably communicates with an inner cavity of head 426 via an opening (not shown) at the base of the head. Water may thus pass into head 426 and further into nozzles 402. Curvate structure 432 preferably includes openings 430 extending through the structure. Curvate structure 432 may be rotated such that one or more of the nozzles 402 communicates with one of the openings 430. Water within this particular nozzle is then free to pass through the opening of curvate structure 432 so that it may be directed to a water bumper vehicle. Nozzles 402 that are not in contact with openings 430 about the inner surface of structure 432 are preferably inhibited from releasing water. A control system may control the rotation of curvate structure 432.

Figure 33:
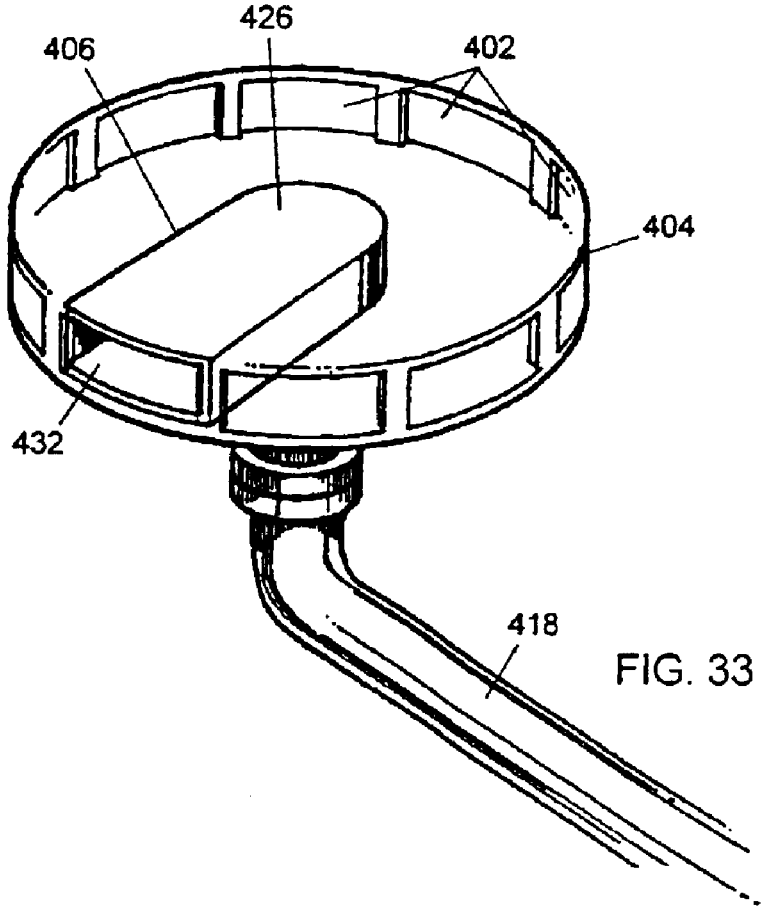
FIG. 33 is a cross-sectional view an embodiment of a nozzle assembly of a water bumper vehicle system.

FIG. 33 depicts another embodiment of a nozzle assembly 404. Nozzle assembly 404 preferably includes a head 426. Conduit 418 preferably extends to a position under head 426 where it contacts an opening (not shown) at the base of the head. Water may pass through conduit 418 and into head 426 through this opening. Nozzles 402 abut the outer surface of head 426 but are not attached to the head. Head 426 may be rotated in a substantially clockwise or counterclockwise direction about the end of conduit 418. Head 426 is preferably rotated until an opening 432 extending through the wall of the head may come in contact with one of the nozzles 402. Thus, water may pass from head 426 to one of the nozzles 402 to be directed to a vehicle. Head 426 may be rotated to a particular nozzle that extends toward a vehicle so that water can be directed at the vehicle to propel it away from nozzle assembly 404.

Turning back to FIG. 29, nozzles 402 may belong to a nozzle assembly 404 that includes a valve 406. Valve 406 may restrict water flow through at least one of the nozzles 402 while permitting water flow through at least one of the other nozzles. A conduit 418 preferably conveys water from a water source, such as a pool 414, to valve 406. A pump 420 may be disposed in conduit 418. Pump 420 may force the water through valve 406 at a pre-determined pressure so that the water is strong enough to propel the vehicles. The water bumper vehicle system may also include an automatic control system 412 that sends a signal to valve 406 to adjust the valve. Upon receiving the signal, valve 406 may respond by adjusting the nozzles such that a pulse of water is emitted from at least one of nozzles 402. Control system 412 may be programmed such that these pulses of water from nozzles 402 are produced in a random sequence or at predetermined times.

Sensors 408 may be placed at different positions on nozzle assembly 404. Sensors are configured to detect when a vehicle is approaching a nozzle assembly. In one embodiment, sensors 408 may detect contact between nozzle assembly 404 and a water bumper vehicle 400. Alternatively, sensors may include a motion detection device which allows the sensor to determine if a vehicle is close to a nozzle assembly. Preferably, a motion detection system is configured to determine if a vehicle has approached within a certain distance range. When the sensor detects the presence of a vehicle, by either contact or motion detection, the sensor preferably sends a signal to control system 412 which responds by activating nozzle assembly 404.

Water sprayers 450 may be positioned around the water bumper vehicle system. Water sprayers 150 preferably spray water at a lower pressure and/or rate than the nozzles. Preferably, water sprayers 450 may be used to spray participants with water. Water sprayers 450 may also be coupled to the control system. The control system may be programmed such that water from water sprayers 450 is produced in a random sequence or at pre-determined times. Alternately, water sprayers 450 may be coupled to the sensors. When a vehicle is detected by a sensor, the sensor may turn on a water sprayer 450 near the sensor such that the participants become wet. Preferably the sensor is configured to activate nearby water nozzles and water sprayers 450.

In another embodiment, the control system may be coupled to participant activation devices located in each vehicle. Each of the participant activation devices may include a series of activation points, which are activated in response to a signal from the participant. The activation points may be pressure activated, movement activated or audibly activated, as described in the musical water fountain system. Activation of the activation points may initiate a number of events. For example, nozzle assemblies 404 may be coupled to the activation points such that the participants may turn on and/or off some or all of the nozzles. The activation points may be coupled to valve 406 such that a signal from the participant causes valve 406 to activate a nozzle assembly 404. Additionally, the activation points may also enable the participants to turn on and/or off water sprayers 450. The use of activation points in this manner allows the participants to have more interaction with the water bumper vehicle system. For example by controlling nozzle assemblies 404 the participants may be able to alter the movement of their vehicle or of other participants' vehicles. By controlling water sprayers 450 the participants may be able to spray themselves or other participants with water. The activation devices may be used while the control unit also controls the nozzles and/or sprayers. Alternatively, the activation devices may be used in place of a programmed control unit. The control unit may then serve to interpret signals from the participants and relay the signals to the various components.

In one embodiment, the vehicles are preferably configured to float on water. As shown in FIG. 29, vehicles 400 are floating in pool 414. The boundaries of pool 414 are defined by retaining walls 416 configured to hold the water of pool 414. A plurality of nozzle assemblies 404 are preferably arranged about retaining wall 416. The nozzle assemblies preferably direct pulses of water toward the vehicles to propel the vehicles across a portion of pool 414.

Sensors 408 may also be mounted on walls 416 near the wall mounted nozzle assemblies. These sensors preferably detect the presence of a vehicle, by either contact or motion detection, when a vehicle approaches a wall. When a sensor detects a vehicle, the sensor preferably generates a signal that is sent to control system 412. In response to this signal, control system 412 preferably activates the nozzle assembly in close proximity to the sensor. Therefore, water bumper vehicles 400 may be propelled away from walls 416 so that they are constantly moved around pool 414.

Additional nozzle assemblies may be present within the pool. The nozzle assemblies may be floating or may be coupled to the bottom of the pool. Sensors are also attached to these nozzles assemblies such that the detection of a vehicle by a sensor causes a nozzle to shoot water at the vehicle, propelling the vehicle away from the nozzle assembly.

The vehicles may also include a steering system for allowing the participant to control the direction of travel of the vehicle. Referring to FIG. 29, the steering system includes a steering device coupled to a handle or wheel 410. Steering devices may be a rudder or paddle or any other similar device which may be used to alter the direction of travel of the vehicle. The steering device may be any of several shapes including rectangular. A rod may be connected to the steering device that extends vertically up to handle 410. Thus, a participant may turn handle 410 making the rod turn, which causes the steering device to move. Movement of the steering device preferably alters the course of the vehicle while the vehicle is moving. In one embodiment, turning the handle in a first direction also turns the steering device in a similar direction. By turning the steering device in a similar direction as the handle, the vehicle will tend to turn in the direction that the handle is turned. The use of a steering system may allow the participant to control the direction that the vehicle travels over the water surface.

Figure 30:
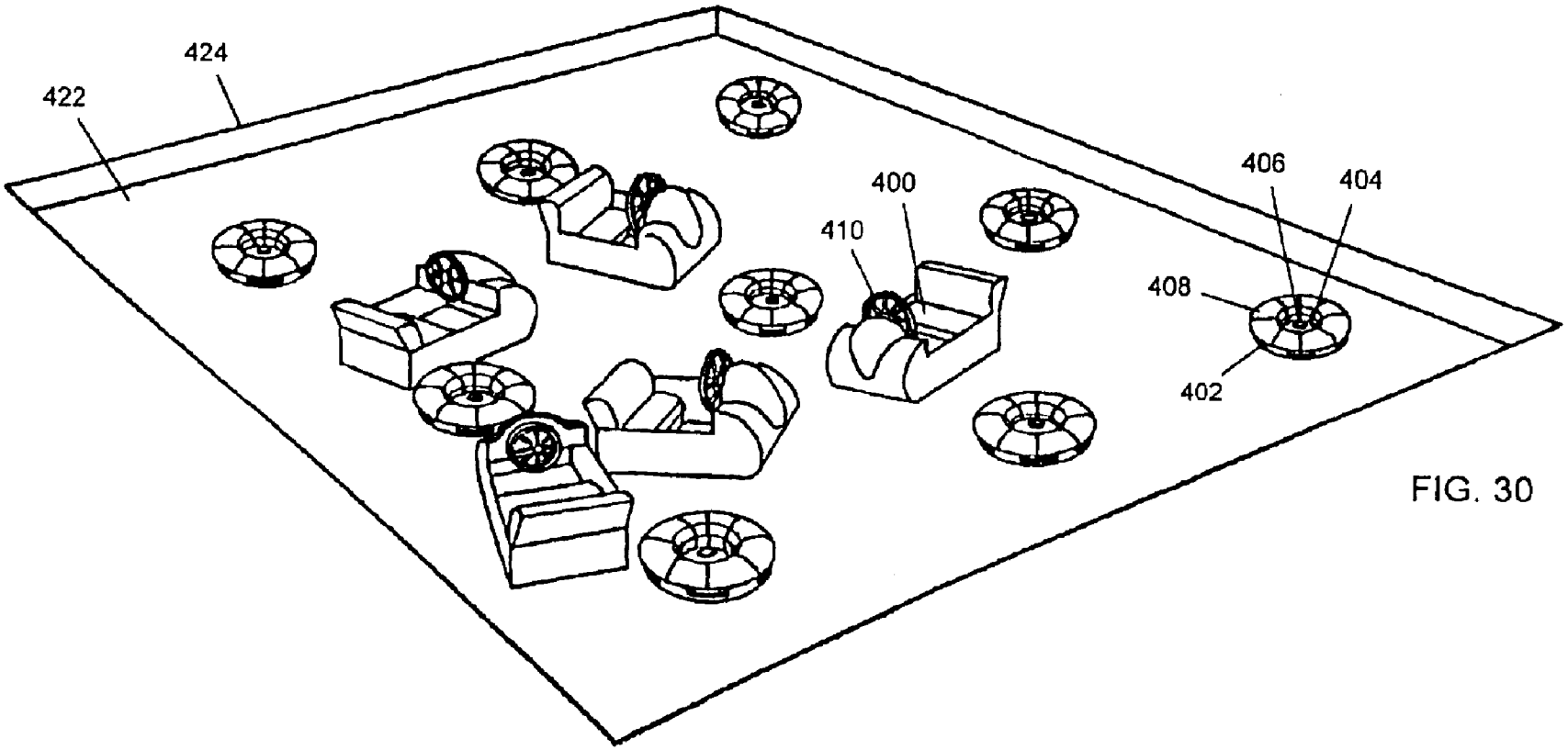
FIG. 30 is a top plan view of an embodiment of a water bumper vehicle system.

In another embodiment, the vehicles may be siting upon a substantially smooth floor as depicted in FIG. 30. Floor 422 may be surrounded by a wall 424. Nozzle assemblies 404 are preferably located at various locations on top of floor 422. They are preferably spaced apart at a distance which allows vehicles 400 to pass between them. Vehicles 400 may be propelled by nozzle assemblies 404 to move across floor 422 in different directions. Preferably, only a small amount of friction exists between vehicles 400 and floor 422 so that the vehicles may slide across the floor.

Figure 31:
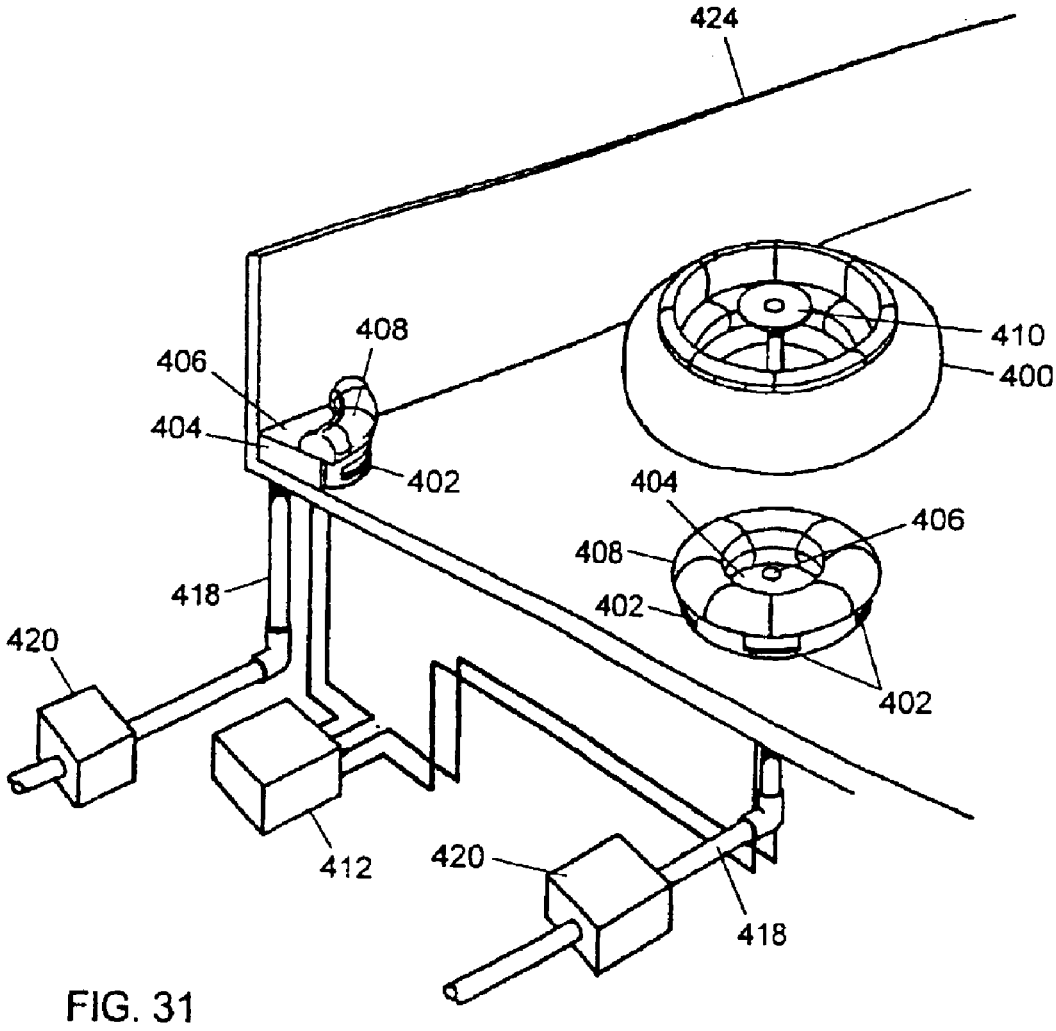
FIG. 31 is a side plan view of a portion of a water bumper vehicle system.

FIG. 31 depicts a perspective view of a portion of the water bumper vehicle system. Nozzle assemblies 404 are also preferably mounted to the base of wall 424. Conduits 418 preferably extend from a high pressure water source (i.e., pumps 420) to nozzle assemblies 404 through floor 422 and/or wall 424. Conduits 418 may be constructed from different materials, including a galvanized steel or a PVC material. Sensors 408 near nozzle assemblies 404 may detect the presence of vehicle 400. Thus, when a vehicle is detected by the sensor system, control system 412 activates the assembly so that water is directed toward the vehicle. Water sprayers, as described above, may also be positioned about the floor and/or wall.

An advantage of this system is that the propulsive power of the vehicle is supplied by the nozzles. The force of the water produced by the nozzles propels the participants' vehicles into each other to create an entertaining ride. The use of a control unit to produce a random or predetermined pattern of water spray adds to the enjoyment by producing an unpredictable ride. Thus, each time a participant uses the water bumper vehicle system the experience may be different from previous experiences. The use of activation devices in the vehicles may enable the participants to exert more control over the system, thus enhancing the overall experience of their ride.

VI. Boat Ride System

Figure 34:
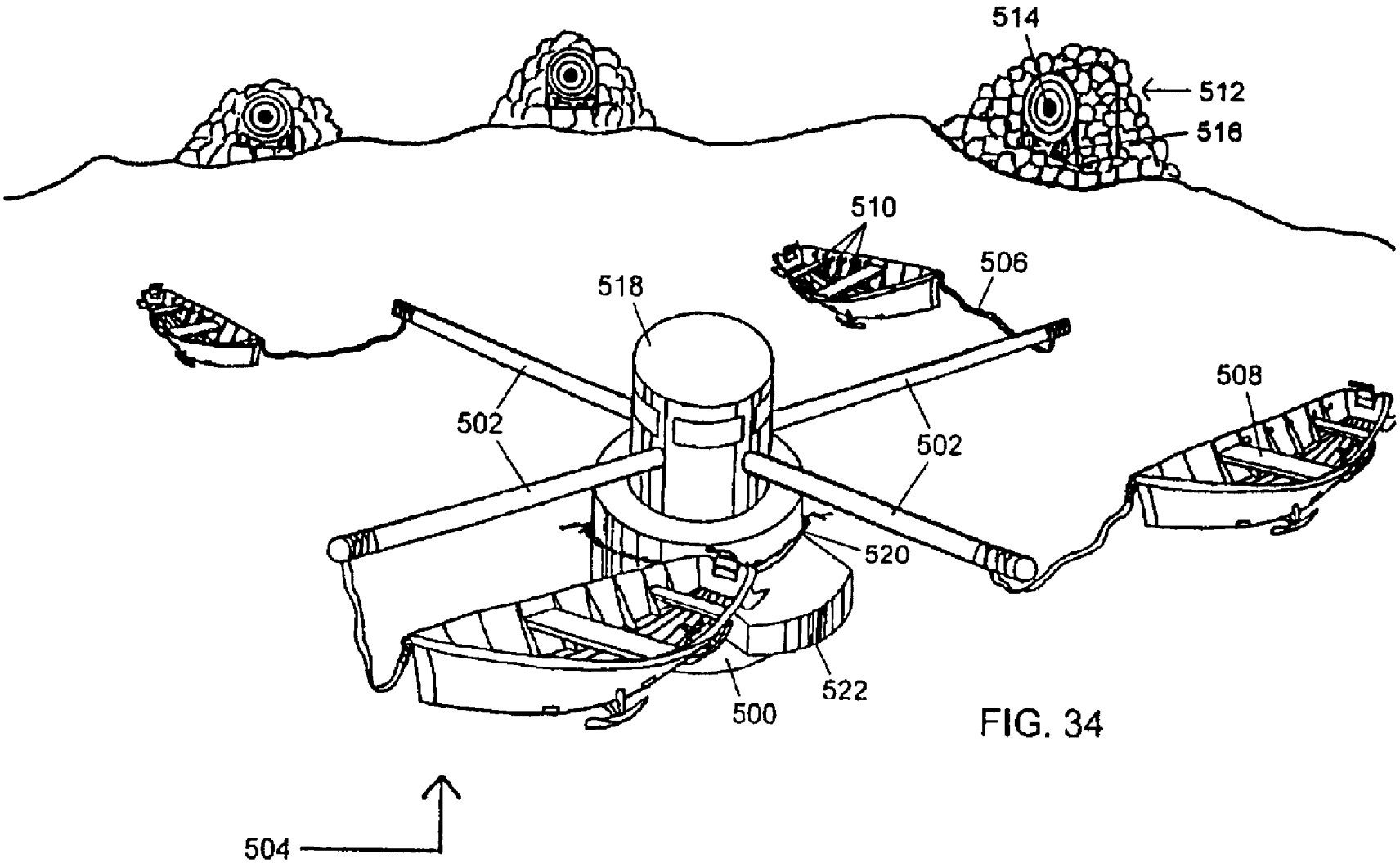
FIG. 34 perspective view of an embodiment of a boat ride system.

Turning to FIG. 34, an embodiment of a boat ride system is depicted. The boat ride system preferably includes a rotatable base 500 sitting in a body of water. A portion of base 500 may extend above the surface of the water. One or more elongated members 502 are preferably attached to base 500, extending outward from the center of the base. Elongated members 502 preferably lie in a horizontal plane above the surface of the water. A boat 504 may be coupled to the end of one of the elongated members 502. Preferably, boat 504 is coupled to elongated member 502 via a substantially flexible towing member 506. Boat 504 may have seats 508 for participants of the boat ride system.

A motor may be operated to make base 500 spin. Boat 504 may be pulled in a substantially circular direction around base 500 by elongated member 502 during the rotation of the base. Rotation of base 500 preferably causes the boat to move in a similar direction (e.g., if the base rotates in a clockwise direction, the boat will rotate about the base in a clockwise direction). The boat preferably remains on the surface of the water during its movement around the rotatable base.

Figure 39:
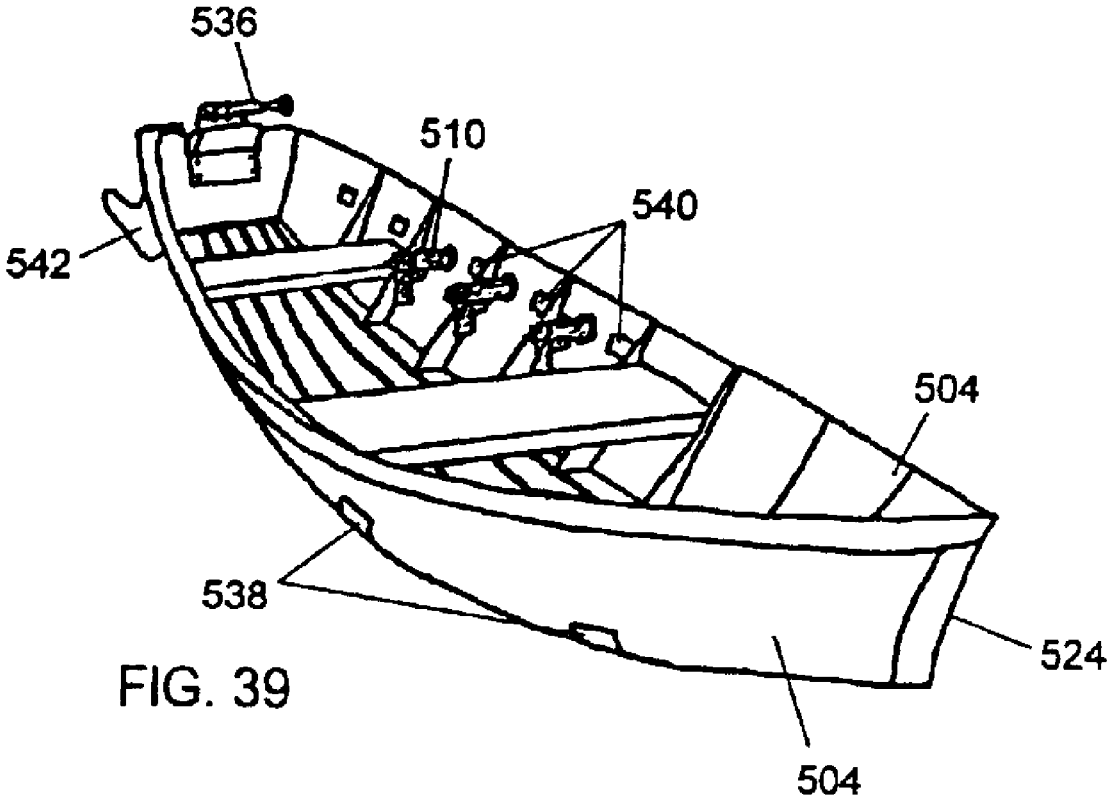
FIG. 39 is a perspective view of an embodiment of a boat of the boat ride system having a rudder.

The boat may also include a steering system for allowing the participant to control the direction of travel of the boat, as depicted in FIG. 39. Preferably the steering system includes a steering device 542 coupled to a handle or tiller 536. Steering device 542 may be a rudder or paddle or any other similar device which may be used to alter the direction of travel of a floating boat. Steering device 542 may be any of several shapes including rectangular. Movement of steering device 542 is preferably accomplished by moving handle 536. In one embodiment, turning handle 536 in a first direction moves steering device 542 in an opposite direction. By turning steering device 542 in an opposite direction as handle 536, the boat will tend to turn in the direction opposite to the direction that handle 536 is turned. In another embodiment, turning handle 536 in a first direction also turns steering device 542 in a similar direction. By turning steering device 542 in a similar direction as handle 536, the boat will tend to turn in the direction that handle 536 is turned. The use of a steering system may allow the participant to control a lateral distance at which the boat travels as the boat rotates about rotatable base 500. The range of lateral distances at which the boat may travel about rotatable base 500 is determined by the length of towing member 506.

Figure 35:
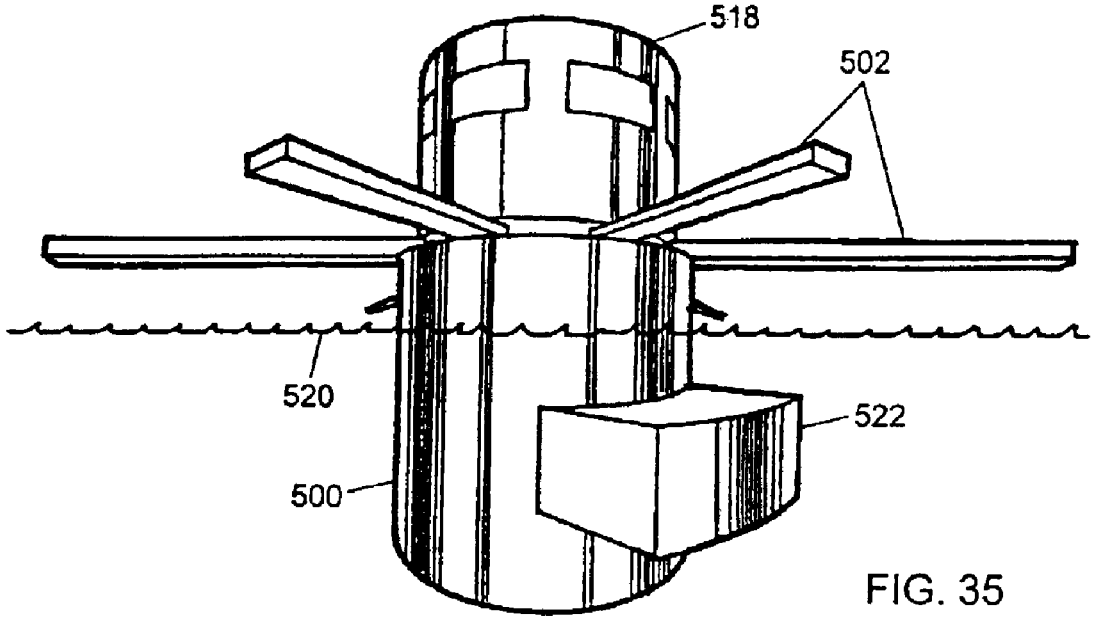
FIG. 35 is a side view of a rotatable base of a boat ride system.

FIG. 35 illustrates a side view of base 500. Base 500 is partially submerged under the water. The upper end of base 500 preferably extends above surface 520 of the water to allow elongated members 502 to lie horizontally above and substantially parallel to surface 520. The rotation of base 500 is preferably driven by motor 522.

Figure 37:
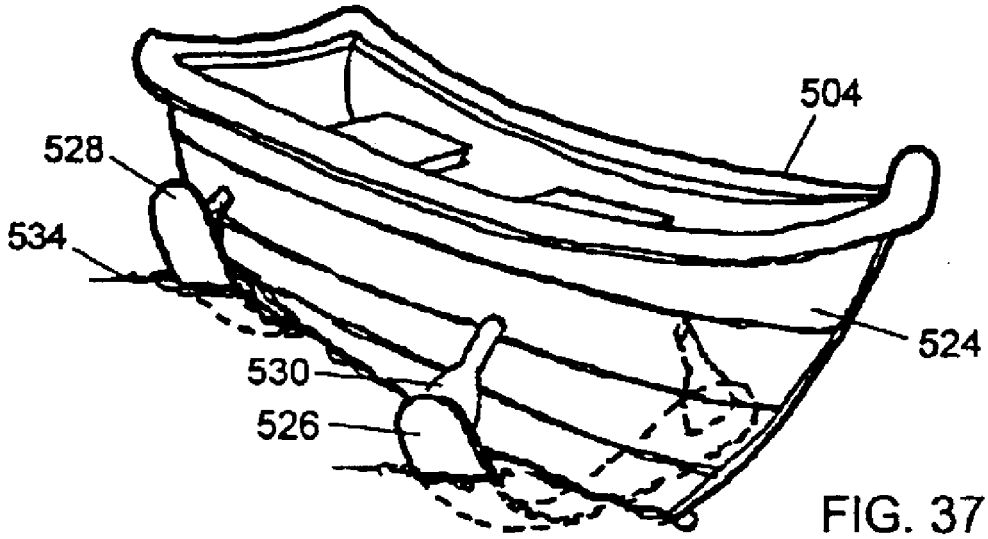
FIG. 37 is a perspective view of an embodiment of a boat in which the hydrofoils have a surface piercing configuration.

In another embodiment boat 504 may include hydrofoils in place of a steering system. FIG. 37 depicts a perspective view of an embodiment of boat 504 with hydrofoils 526 and 528. Boat 504 preferably includes a hull 524 that may be made of a various materials, such as metal, wood, fiberglass, or plastic. A front hydrofoil 526 and an aft hydrofoil 528 may be located under hull 524. Struts 530 preferably connect the hydrofoils to boat 504. Hydrofoils 526 and 528 preferably form "wings" in the water that generate lift. When boat 504 is pulled by elongated arm 502 (shown in FIG. 34), hydrofoils 526 and 528 preferably lift the bottom of boat 504 above the water level. The hydrofoils 526 and 528 may remain partially submerged in the water during the lift. The purpose of using hydrofoils 526 and 528 for the boat ride system is to allow boat 504 to move more easily and more quickly around base 500. Lifting boat 504 above the water only requires drag on the foils to be overcome instead of drag on the entire boat 504. A steering arm 536 is preferably connected to hydrofoils 526 and 528. It may be the job of at least one participant to adjust a steering arm to make hydrofoils 526 and 528 turn so that boat 504 may more easily move through the water. Moreover, the flexibility of towing member 506 (shown in FIG. 34) adds to the maneuverability of boat 504.

In FIG. 37, hydrofoil 526 is shown as having a surface piercing configuration in which a portion of the hydrofoil is designed to extend through the air/water surface 534 interface when boat 504 is raised by the hydrofoil. Struts 530 preferably connect hydrofoil 526 to hull 524 at a predetermined length required to support hull 524 free of water surface 534 while boat 504 is in full motion. As the velocity of the boat increases, the flow of water over the submerged portion increases, causing the boat to rise, reducing the area of the foil that is submerged. The boat will eventually rise until the lifting force equals the weight carried by the foils.

Figure 38:
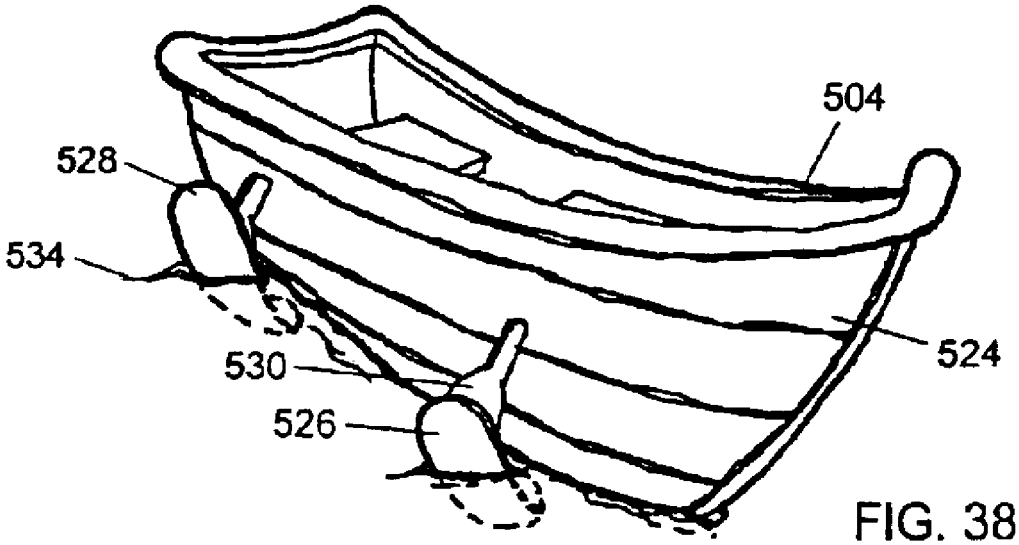
FIG. 38 is a perspective view of an embodiment of a boat in which the hydrofoils have a fully-submerged configuration.

FIG. 38 illustrates a perspective view of another embodiment of hydrofoils 526 for boat 504 in which two pairs of hydrofoils 526 and 528 are positioned on opposite sides of boat 504. Struts 530 which connect the hydrofoils to hull 524 do not contribute to the overall force of the hydrofoil system. In this configuration the hydrofoil system is not self-stabilizing. The angle of the hydrofoils in the water may be varied to change the lifting force in response to changing conditions of ship speed, weight, and water conditions. The hydrofoils have a unique ability in that they can uncouple a boat to a substantial degree from the effect of the waves so that passengers on the boat encounter a substantially smooth ride.

Figure 36:
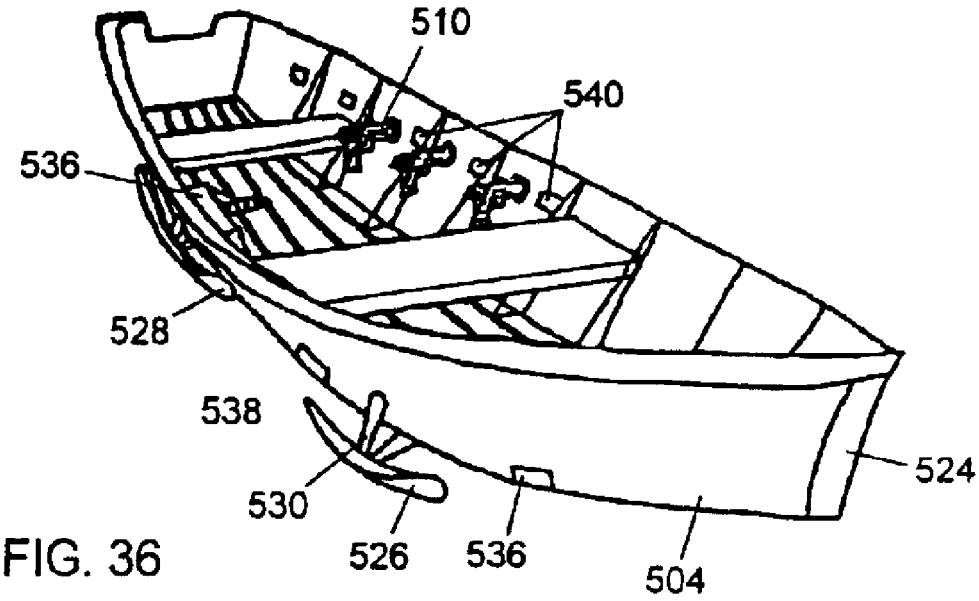
FIG. 36 is a perspective view of an embodiment of a boat of a boat ride system having hydrofoils.

In another embodiment, participant interaction devices 510 are also preferably located on boat 504, as depicted in FIG. 36. Participant interaction devices preferably include any device that allows participants to interact with targets and/or other participants and/or spectators. Examples of participant interaction devices include, but are not limited to electronic guns for producing electromagnetic radiation, water based guns for producing pulses of water, and paintball guns. Participants known as "fire specialists" on boat 504 may fire participant interaction devices 510 as the boat is moving as part of a game. Participant interaction devices 510 may extend through openings in the side of boat 504, or they may be located above the sides of hull 524. The participant interaction devices may be directed at targets 512 positioned on base 500 or floating in the body of water. The participant interaction devices may also be directed at other boats which are coupled to rotatable base 500. Participant interaction devices may be fired to send a projectile at a boat or target. A projectile as used herein is meant to refer to a beam of electromagnetic radiation, water, a paint ball, a foam object, a water balloon, or any other relatively non-harmful object that may be thrown from a participant interaction device. Participant interaction devices may also be located around the perimeter of the body of water to allow spectators to fire projectiles at the boats.

In one embodiment, participant interaction devices 510 may be electronic guns. Participants may fire participant interaction devices 510 as part of a game. The object of the game may be to direct a signal electromagnetic beam from participant interaction devices 510 toward targets 512 that are floating in the body of water, as depicted in FIG. 34. Targets 512 may be located at various positions around base 500. Each of the targets 512 preferably includes a receiver 514 for sensing electromagnetic beams that hit the target. Targets 512 may include an effects system 516 that creates effects in response to receiver 514 sensing the electromagnetic beam. The effects created by the effects system may include visual (e.g., lights), audio (e.g., sound effects), or physical effects (e.g., smoke, bubbles, water sprays, etc.). Receiver 514 may generate a signal corresponding to each participant interaction device fired, and the signals may be sent to an electronic scoring system 518. Electronic scoring system 518 is preferably located in close proximity to base 500. In one embodiment, the fire specialists may be competing to see who can hit the most targets. Scoring system 518 may sit on the top of base 500 so that the participants can easily view it. Scoring system 518 preferably displays scores in response to signals received from the targets.

Turning to FIG. 39, boat 504 may further include at least one sensor 538 that is electrically coupled to electronic participant interaction devices 510. Sensor 538 is preferably capable of detecting the height of hull 524 above water surface 534. When the detected height of the hull exceeds a predetermined height, a control switch 540 for each sensor may automatically activate participant interaction devices 510. The predetermined height is preferably the height that hull 524 reaches when it has been lifted above the water due to constant motion of boat 504.

Figure 40:
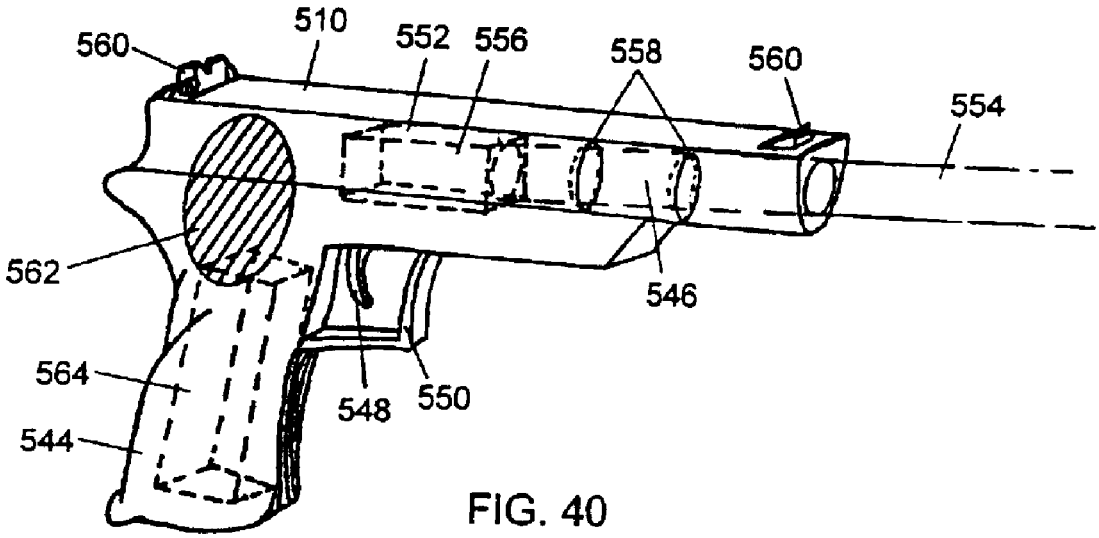
FIG. 40 is a side view of an embodiment of an electronic gun of a boat ride system.

FIG. 40 depicts an embodiment where the participant interaction device is an electronic gun 510. It is envisioned that electronic gun 510 includes a handle 544, a barrel 546, and a trigger 548 disposed within a trigger guard 550. A projector 552 for producing an electromagnetic beam 554 may be mounted within barrel 546. Preferably, projector 552 includes an infrared light emitting diode 556 and focusing lenses 558 so that a substantially narrow beam of infrared light may be projected when trigger 548 is pulled. This light beam is preferably an amplitude-modulated infrared light beam. A speaker may be mounted under a speaker grill 562 to produce noise as electronic gun 510 is fired. Lights in the form of Light Emitting Diodes (LED's) 560 may be located at the top of electronic gun 510. Handle 544 may include a chamber 564 for receiving batteries needed to power the electronic gun. Electronic gun 510 may be activated by an electronic switch 540 (see FIG. 39). An adequate electronic gun that may be used in the present invention is fully described in U.S. Pat. No. 5,437,463 to Fromm and is incorporated by reference as if fully set forth herein.

Figure 41:
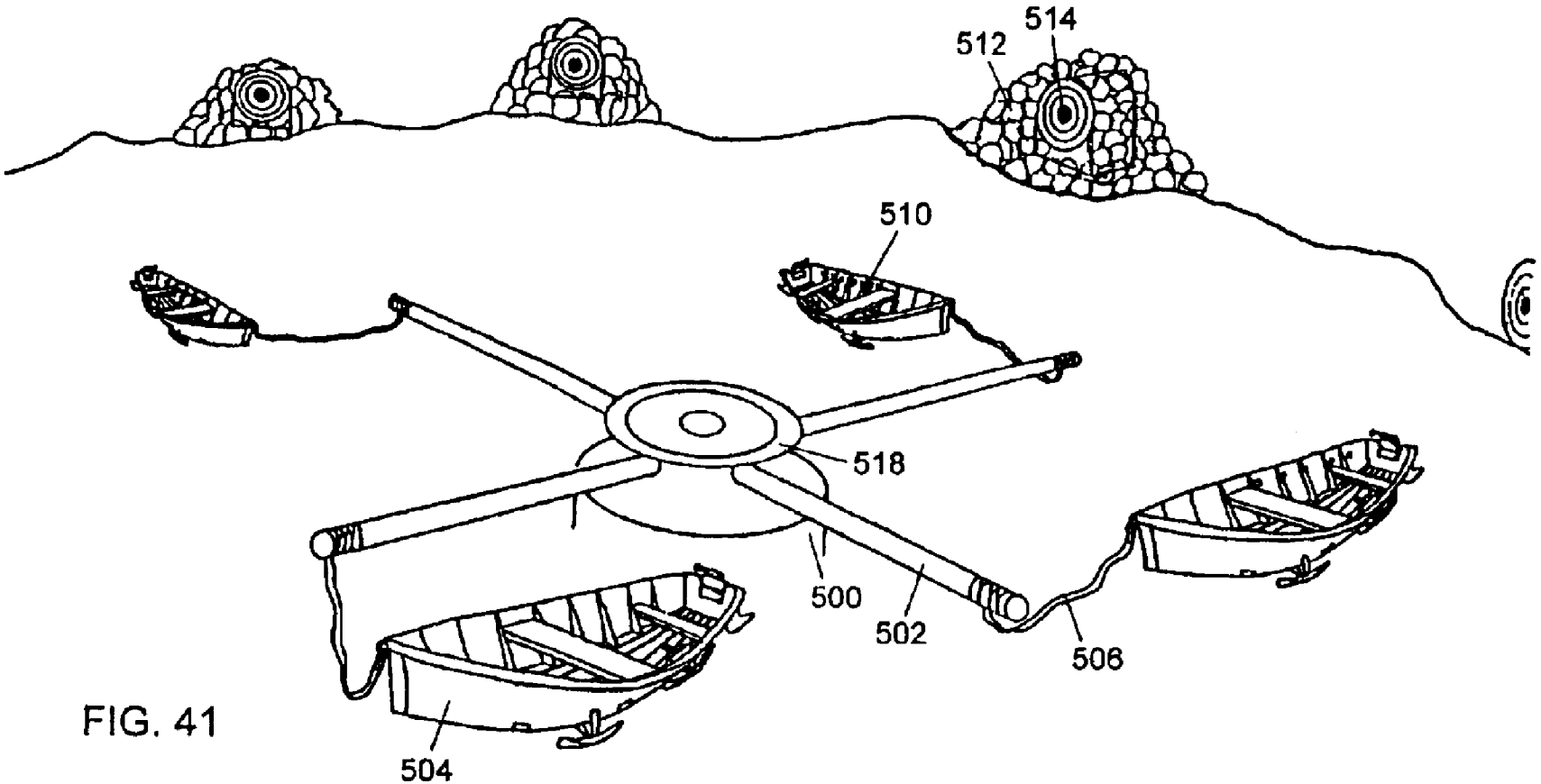
FIG. 41 is an embodiment of a boat ride system having a plurality of boats.

As depicted in FIG. 41 a plurality of boats 504 are preferably connected to arms 502. Such a configuration provides an opportunity for participants on each of the boats 504 to compete in an electronic gun game. In this game, participants on each of the boats 504 may fire electronic guns 510 toward targets 512. Targets 512 may be located on base 500, floating in the body of water, mounted on the boats, and/or positioned along the boundaries of the body of water. Receivers 514 of targets 512 may sense the electromagnetic beams produced by electronic guns 510. Receivers 514 may generate an electronic signal in response to each instance of being struck by electromagnetic beams that originate from a particular gun. Receivers 514 are preferably electronically coupled to an electronic scoring system (not shown). Thus, signals produced by receivers 514 may be sent to the scoring system. The scoring system may then display separate scores corresponding to each of the electronic guns 510 and/or to each of the boats 504.

In another embodiment, participant interaction devices 509 may be water gun systems. Water gun systems are configured to fire a pulse of water when a trigger is depressed. Water guns 510 allow participants to fire pulses of water from boat 504 toward targets 512 and other boats 504. Participants may use the water guns to wet participants on other boats and/or spectators surrounding the body of water. Additionally, targets 512 may be configured to respond to a blast of water. Targets may be electronically coupled to scoring system 518 as described above.

One advantage of this boat ride system is that the participants may control, to a limited extent, the direction of travel of the boat. Participants may thus interact with the boat in a manner which tends to be absent from typical passive boat ride systems. The use of a hydrofoil system, allows the boats to be elevated above the surface of the water. Furthermore, the elevation of the boats may be controlled by the participants. This elevation control further increases the possible interaction of the participants with the boat system. Finally, a system of participant interaction devices and targets may be added to the system to allow the participants and/or spectators to interact with each other in a competitive manner.

VII. Floating Train Ride System

Figure 42:
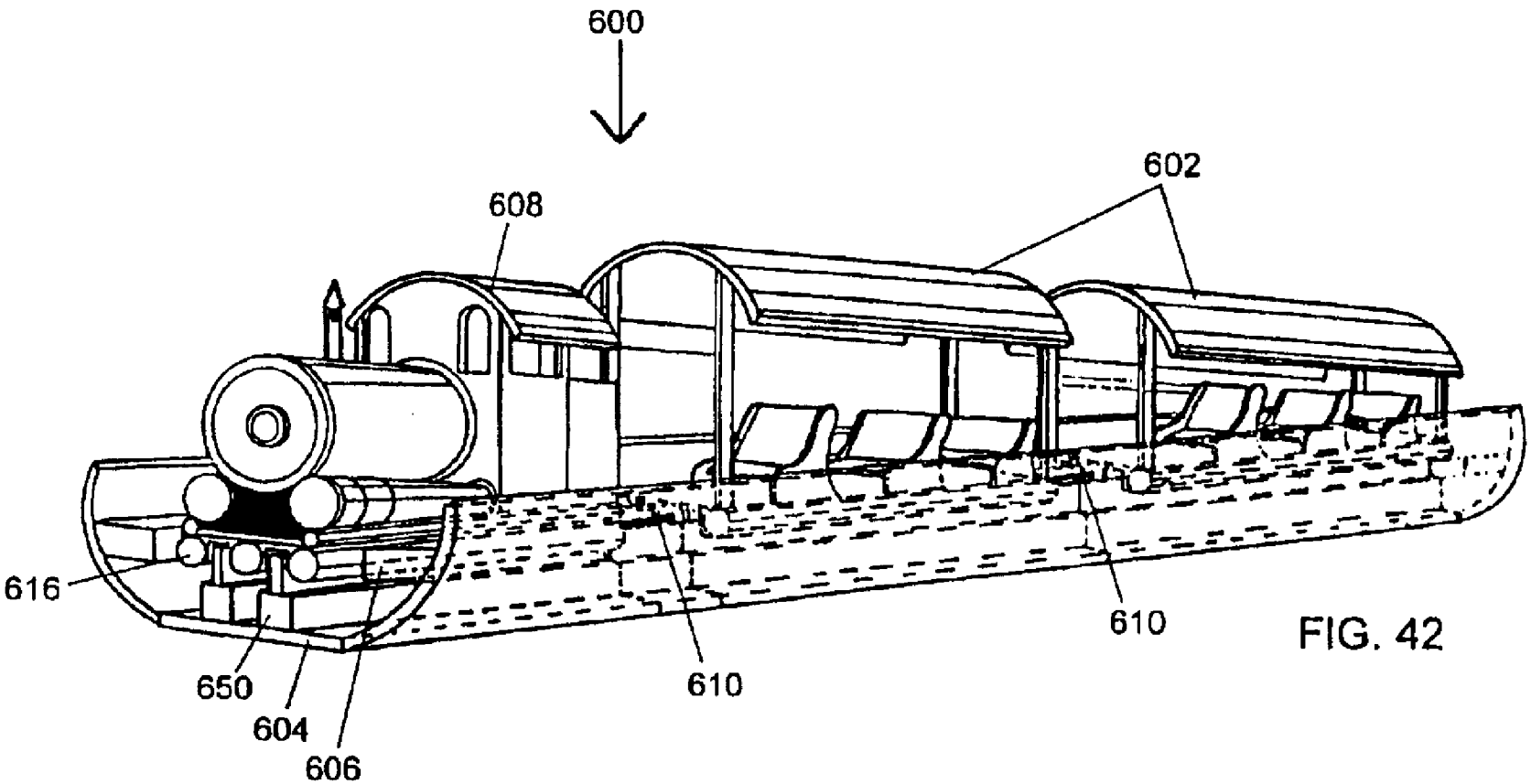
FIG. 42 is a perspective view of an embodiment of a water train ride system.

Turning to FIG. 42, a perspective view of one embodiment of a water train ride system is depicted. The train ride system preferably includes a passenger train 600, a trough 604, and a pair of elongated members 606 extending from opposite sides of trough 604. Only a portion of trough 604 is illustrated. Train 600 is preferably capable of floating in water and includes a propulsion system to propel it through water. Before operation, train 600 is preferably placed in trough 604 which holds water. Trough 604 may be a very long trough that extends to various areas of a water park so that train 600 may travel to different areas of the park via the trough.

Elongated members 606 may serve as guides for train 600 as it moves. Elongated members 606 may be mounted to the inner sidewalls of trough 604 to prevent train 600 from moving from side to side within trough 604. Thus, elongated members 606 help provide a smoother train ride for passengers.

Train 600 preferably includes a plurality of passenger train cars 602 for holding passengers and an engine car 608 that houses the propulsion system. The number of train cars 602 belonging to the system may be varied. Train cars 602 and engine car 608 may have a shape that resembles a figure such as, for example, a train, an animal, an insect, a plant, a dinosaur, a space ship, an inner tube, a boat, an auto, an airplane, a musical instrument, etc. Train cars 602 are preferably arranged in series behind engine car 608. Couplers 610 may connect the back of one train car to the front of another train car. Further, one of the couplers 610 may connect the back of engine car 608 to the front of one of train cars 602.

A sound system may be located within engine car 608 and/or among train cars 602. The sound system is preferably configured to produce sounds for the train system. Sounds preferably include train noises (e.g., moving wheels, train whistles, steam engine sounds, etc.). The sound system may also produce other sound effects (e.g., music, animal noises, boat noises, etc.). The sound system may also be used to transmit messages to the participants. Messages may be produced by a "train conductor". The train conductor may be an employee of the park or the conductor may be a sound system with prerecorded messages. The messages may be used to inform the participants about the amusement park while the participants are seated within the train.

As shown, each of the elongated members 606 preferably extends toward train 600 such that the elongated members are directly adjacent the sides of train 600. As train 600 moves through trough 604, elongated members 606 remain at the sides of the train and thus guide train 600. Alternately, train 600 may have grooves (not shown) disposed within its sides, and elongated members 606 may fit into the grooves.

Flotation members 616 are preferably located under train 600 to render the train floatable. Flotation members 616 preferably have a density that allows train 600 to float while sitting on the flotation members. Flotation members 616 may be plastic and/or may be hollow inside.

Trough 604 is preferably configured as a U-shaped member having opposite sidewall surfaces 618. However, trough 604 may also be in the form of other shapes. For instance, it may be more linear shaped with straight sides and a straight bottom. The width of trough 604 is preferably larger than train 600. Trough 604 preferably contains a predetermined amount of water that allows train 600 to float and to move through trough 604 without the bottom surface of the train touching the trough. The trough may be made of a substantially transparent material to allow the participants to see through the trough. Portions of trough 604 may include sections where the trough is formed into a tunnel. Thus, portions of trough 604 may be in the form of a cylindrical tube. Preferably, an upper portion of the cylindrical trough section may be substantially transparent. Water may be directed onto the cylindrical section of trough 604 to create a waterfall effect which falls onto the train ride system. The upper portion of the cylindrical trough section preferably inhibits the water from reaching the participants.

Figure 43:
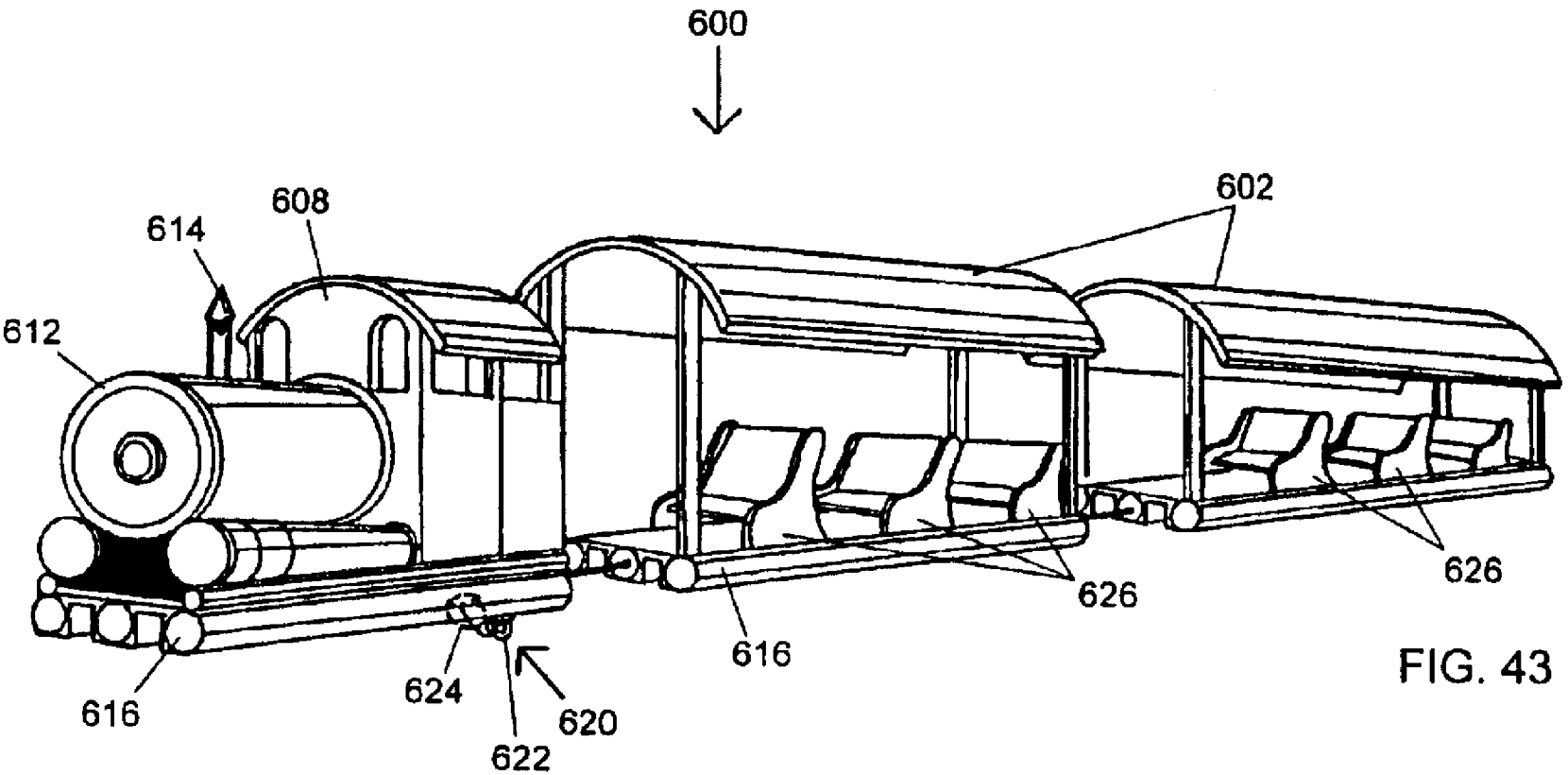
FIG. 43 is a perspective view of an embodiment of a train.

Turning to FIG. 43, the sound system may be configured to generate train noises by use of steam. A steam generator 612, such as a boiler may be located within engine car 608. Steam generator 612 may produce steam which is used to blow a steam whistle 614 located on top of engine car 608.

A propulsion system 620 preferably extends downward from engine car 608. Propulsion system 620 includes any type of propulsion device which propels train 600 through the water. Propulsion system 620 preferably includes a water propulsion device 622 and a motor 624 to operate the water propulsion device. Examples of water propulsion devices include, but are not limited to, paddles, paddle wheels, impellers, and propellers. During operation of propulsion system 620, water propulsion device 622 is preferably powered by motor 624 to propel train 600 forward.

Train cars 602 preferably have seats 626 in which participants may sit. The sides of train cars 602 may have openings to expose the inner portion of the train cars and the participants therein to the air. Alternately, train cars 602 may be enclosed and have windows through which the participants may look to see outside the train cars. A sound system (not shown) may be connected to train 600 to play music or give information which entertains the passengers.

Figure 44:
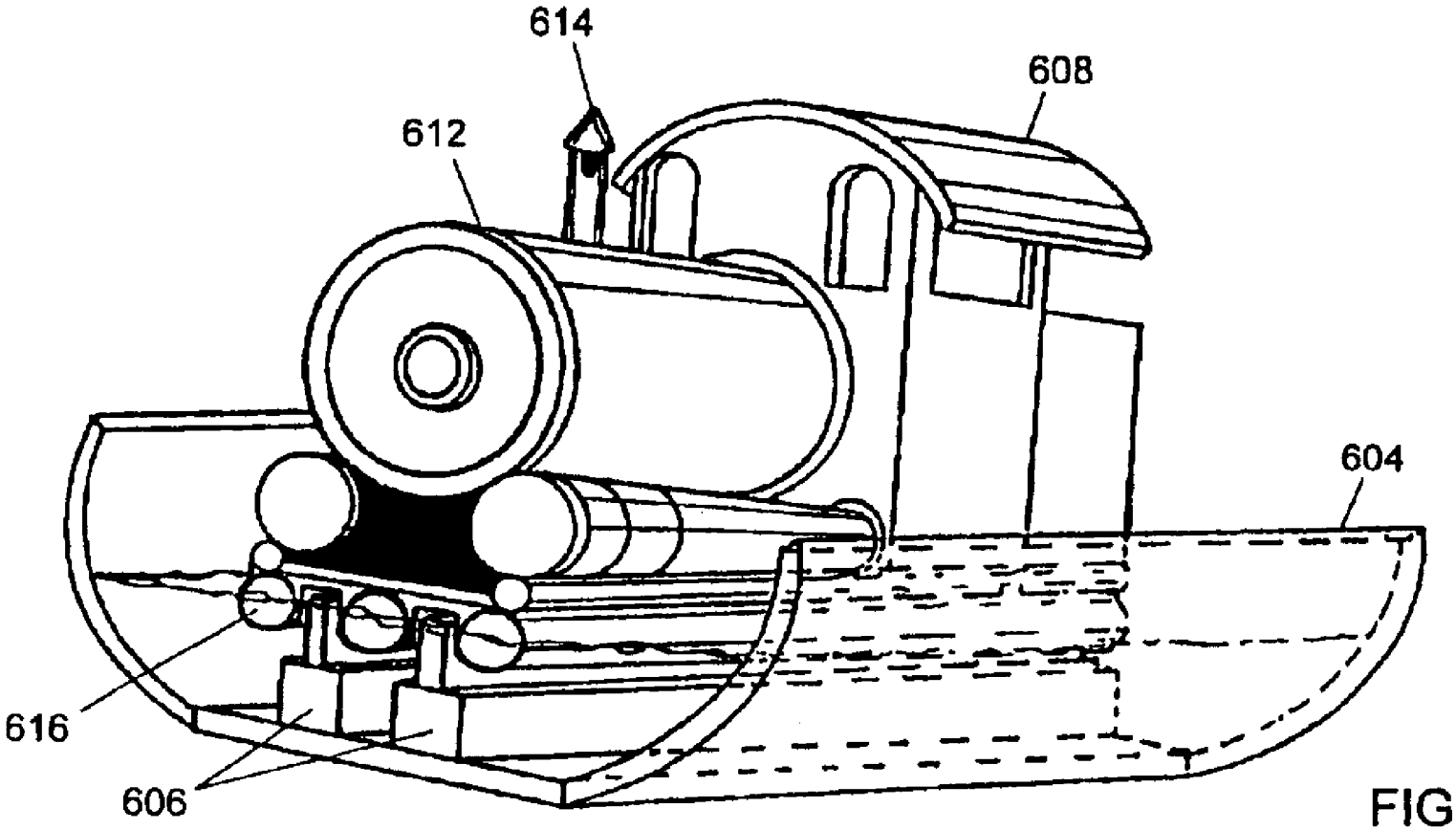
FIG. 44 is a perspective view of a train engine.

FIG. 44 illustrates another embodiment of a floating train ride system. This drawing is similar to FIG. 43. In this embodiment, elongated members 606 preferably extend upward from the bottom of trough 604. They preferably lie in parallel along trough 604. The upper ends of elongated members 606 may fit snugly into grooves that are located between members 616. Elongated members 606 are preferably located along the entire length of trough 604. Thus, as train 600 moves through trough 604, elongated members 606 may constantly pass through the grooves. Trough 604 may contain a sufficient amount of water to lift a large portion of train 600 above the trough. Such positioning of train 600 may allow train passengers to easily see areas of the water park from within the train. As train 600 moves, a bottom portion of the train may be maintained under water so that members 606 slide through grooves 620.

In another embodiment, floating train ride system 600 may include two sets of guides, as depicted in FIG. 42.

Elongated members 650 may extend upward from the bottom of trough 604. Elongated members 650 may engage flotation members 616 to control the direction of the train as the train passes through the trough. Additional elongated members 606 may extend from the sides of trough 604 to control the lateral movement (e.g., side to side movement) of the train. The combination of guides beneath and adjacent to the train may impart additional stability to the train, thus creating a smoother ride for the participants.

Figure 45:
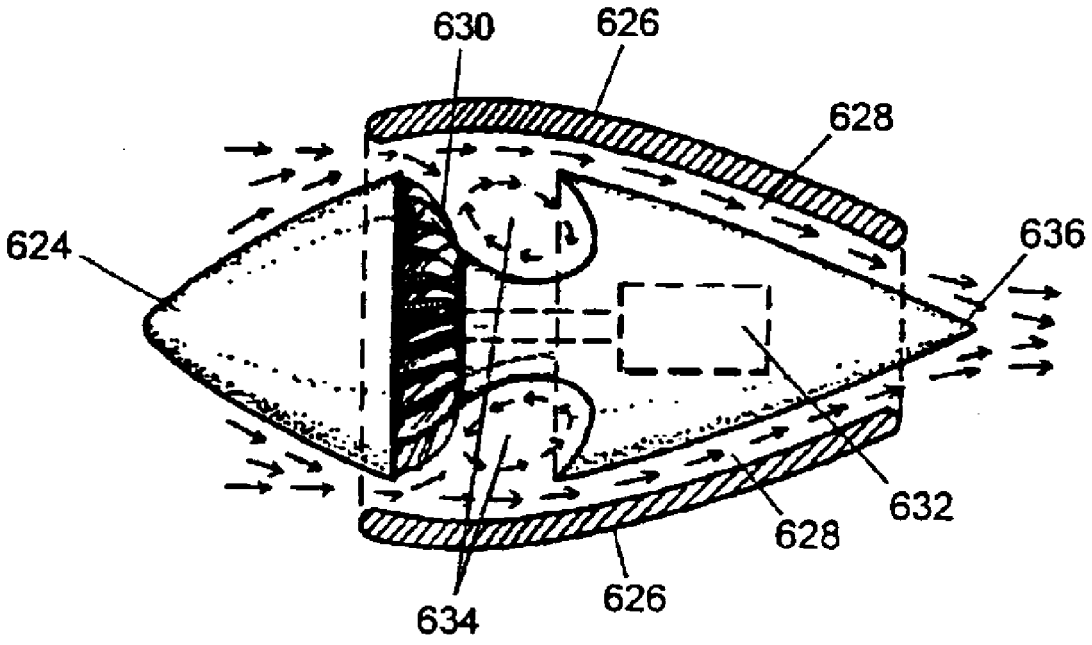
FIG. 45 is a cross-sectional view of an embodiment of a jet propulsion system of a train ride system.
Figure 45:
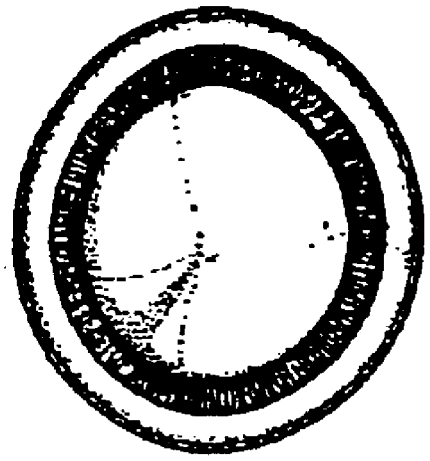

Turing to FIG. 45, an embodiment of a jet propulsion system 620 for the train ride system is depicted. A jet propulsion system is envisioned which is virtually wake free. Such a system may include a main body 624, a jet fan impeller 630 disposed within main body 624, an outer partition 626 partially covering main body 624, and an angular slot 628 interposed between main body 624 and outer partition 626. Outer partition 626 and angular slot 628 may be located at opposite sides of main body 624. A motor 632 for making impeller 630 rotate may also be disposed within main body 624. The front and back portions of body 624 may taper inward. When operating jet propulsion system 620, impeller 630 may continuously recirculate water within grooves 634 that are located near impeller 630. The speed of the recirculating water may result in a lowering of pressure at the front of body 624, causing water to be pushed to the rear of body 624 via angular slots 628. The rushing water may exert pressure on a tapered portion 636 of body 624. This pressure "squeezes" tapered portion 636, causing it to propel forward and pull train 600.

VIII. Amusement Park System

An amusement park system is provided that comprises a number of water based rides. The amusement park system may be a "wet park" in which at least some or all of the participants become substantially wet during the rides. In another embodiment, the amusement park system may be a combination of a "wet park" and a "dry park" in which at least some or all of the participants remain substantially dry during the rides.

In an embodiment, the amusement park system preferably includes a water fountain system, a water carousel system, a musical water fountain system, a water Ferris wheel system, a water bumper vehicle system, a boat ride system, or a water train system. All of these systems are described in more detail in sections I–VII, respectively.

In another embodiment, the amusement park system preferably includes a water fountain system and a water carousel system. The amusement park system may also include a musical water fountain system, a water Ferris wheel system, a water bumper vehicle system, a boat ride system, and a water train system.

In an embodiment, the amusement park system preferably includes a water fountain system. The amusement park system may also include a musical water fountain system, a water Ferris wheel system, a water bumper vehicle system, a boat ride system, or a water train system.

In another embodiment, the amusement park system preferably includes a water carousel system. The amusement park system may also include a musical water fountain system, a water Ferris wheel system, a water bumper vehicle system, a boat ride system, or a water train system.

In another embodiment, the amusement park system preferably includes a musical water fountain system. The amusement park system may also include a water Ferris wheel system, a water bumper vehicle system, a boat ride system, or a water train system.

In another embodiment, the amusement park system preferably includes a water fountain system and a water carousel system. The amusement park system may also include a musical water fountain system, a water Ferris wheel system, a water bumper vehicle system, a boat ride system, or a water train system.

In another embodiment, the amusement park system preferably includes a water carousel system and a musical water fountain system. The amusement park system may also include a water Ferris wheel system, a water bumper vehicle system, a boat ride system, or a water train system.

In another embodiment, the amusement park system preferably includes a water fountain system and a musical water fountain system. The amusement park system may also include a water Ferris wheel system, a water bumper vehicle system, a boat ride system, or a water train system.

Other rides which may be found in a wet or dry park may also be present.

Each of the inventions I–VIII discussed above may be used individually or combined with any one or more of the other inventions.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A water Ferris wheel system, comprising:

a Ferris wheel;

one or more water interaction devices coupled to the Ferris wheel;

one or more seating devices configured to hold participants during use, wherein the seating devices are coupled to the Ferris wheel; and a water supply system for directing a water stream onto at least one of the water interaction devices during use;

wherein the Ferris wheel is configured to rotate about a central axis in response to the force imparted by the water stream upon at least one of the water interaction devices.

2. The Ferris wheel system of claim 1, wherein the water supply system is configured to direct water onto at least one of the water interaction devices at a location above the central axis during use.

3. The Ferris wheel system of claim 1, wherein the water supply system is configured to direct water onto at least one of the water interaction devices at a location substantially even with the central axis during use.

4. The Ferris wheel system of claim 1, wherein the water supply system is configured to direct water onto at least one of the water interaction devices at a location below the Ferris wheel during use.

5. The Ferris wheel system of claim 1, wherein the water supply system is configured to supply water along a tangent of the Ferris wheel.

6. The Ferris wheel system of claim 5, wherein the water supply system is configured to supply the water stream such that the water falls from the water supply system along a substantially vertical path.

7. The Ferris wheel system of claim 1, wherein the water supply system comprises a conduit, a water regulation system, and a reservoir, the water regulation system being disposed between the reservoir and an opening of the conduit, and wherein water flows out of the opening of the conduit to form the water stream.

8. The Ferris wheel system of claim 7, wherein the water regulation system is configured to vary the flow of water from the reservoir through the conduit and to at least one of the water interaction devices.

9. The Ferris wheel system of claim 7, wherein the reservoir is configured to collect water from at least one of the water interaction devices.

10. The Ferris wheel system of claim 7, wherein the water regulation system comprises a pump.

11. The Ferris wheel system of claim 1, wherein at least one of the water interaction devices is coupled to at least one of the seating devices.

12. The Ferris wheel system of claim 11, wherein at least one of the water interaction devices and at least one of the seating devices is separated by a wall, the wall comprising an opening for passing water from the water interaction device into the seating device.

13. The Ferris wheel system of claim 11, wherein at least one of the water interaction devices communicates with at least one of the seating devices such that water from the water interaction device contacts at least some of the participants during use.

14. The Ferris wheel system of claim 11, wherein at least one of the water interaction devices is substantially offset from at least one of the seating devices such that water released from the water interaction device is inhibited from contacting participants during use.

15. The Ferris wheel system of claim 14, wherein at least one of the water interaction devices are positioned between at least one of the seating devices and a central axis of the Ferris wheel.

16. The Ferris wheel system of claim 1, wherein at least one of the water interaction devices comprises a paddle.

17. The Ferris wheel system of claim 1, wherein at least one of the water interaction devices comprises a receptacle.

18. The Ferris wheel system of claim 1, wherein at least one of the water interaction devices comprises one or more openings for releasing the water during use.

19. The Ferris wheel system of claim 1, wherein at least one of the water interaction devices is substantially non-rotatable, and wherein at least one of the water interaction devices is oriented in a substantially upright position as the water interaction device passes through an apex of the Ferris wheel, and wherein at least one of the water interaction devices is configured to release water as the water interaction device reaches a location substantially below the central axis.

20. The Ferris wheel system of claim 1, wherein at least one of the water interaction devices is at least partially rotatable and wherein at least one of the water interaction devices is configured to release water at a location substantially below the central axis.

21. The Ferris wheel system of claim 1, further comprising a braking system configured to inhibit rotation of the Ferris wheel during use.

22. The Ferris wheel system of claim 1, wherein the Ferris wheel defines a first plane, and wherein at least one of the water interaction devices is oriented in a second plane, and wherein the first and second planes are substantially parallel, and wherein the second plane is laterally displaced from the first plane.

23. The Ferris wheel system of claim 1, wherein at least one of the water interaction devices is substantially non-pivotally attached to the Ferris wheel, and wherein at least one of the water interaction devices is oriented in a substantially upright position as the water interaction device passes through an apex of the support member, and wherein the water interaction device is configured to release water at a location substantially below the central axis.

24. A water Ferris wheel system, comprising:

a Ferris wheel;

one or more water interaction devices coupled to an outer portion of the Ferris wheel;

one or more seating devices configured to hold participants during use, wherein the seating devices are coupled to the Ferris wheel; and a water supply system for producing a substantially vertical water stream such that the water stream is directed onto at least one of the water interaction devices during use;

wherein the Ferris wheel is configured to rotate about a central axis in response to the force imparted by the water stream upon at least one of the water interaction devices.

25. The Ferris wheel system of claim 24, wherein the water supply system is configured to direct water onto at least one of the water interaction devices at a location above the central axis during use.

26. The Ferris wheel system of claim 24, wherein the water supply system is configured to direct water onto at least one of the water interaction devices at a location substantially even with the central axis during use.

27. The Ferris wheel system of claim 24, wherein the water supply system is configured to supply water along a tangent of the Ferris wheel.

28. The Ferris wheel system of claim 24, wherein the water source comprises a conduit, a water regulation system, and a reservoir, the water regulation system being disposed between the reservoir and an opening of the conduit, and wherein water flows out of the opening of the conduit to form the water stream.

29. The Ferris wheel system of claim 24, wherein at least one of the water interaction devices is coupled to at least one of the seating devices of the Ferris wheel.

30. The Ferris wheel system of claim 24, wherein at least one of the water interaction devices communicates with at least one of the seating devices such that water from one of the water interaction devices contacts at least some of the participants during use.

31. The Ferris wheel system of claim 24, wherein at least one of the water interaction devices is substantially offset from at least one of the seating devices such that water released from at least one of the water interaction devices is inhibited from contacting participants during use.

32. The Ferris wheel system of claim 24, wherein at least one of the water interaction devices comprises a paddle.

33. The Ferris wheel system of claim 24, further comprising a braking system configured to inhibit rotation of the Ferris wheel during use.

34. A water Ferris wheel system, comprising:

a Ferris wheel;

one or more water interaction devices coupled to an outer surface of the Ferris wheel;

one or more seating devices configured to hold participants during use, wherein the seating devices are coupled to the Ferris wheel; and a water supply system for supplying a water stream, wherein the water stream flows at a location below the Ferris wheel, and wherein the water supply system is further configured to direct water onto at least one of the water interaction devices during use;

wherein the Ferris wheel is configured to rotate about a central axis in response to the force imparted by the water stream upon at least one of the water interaction devices.

35. The Ferris wheel system of claim 34, the water supply system is configured to supply water along a tangent of the Ferris wheel.

36. The Ferris wheel system of claim 34, wherein at least one of the water interaction devices is coupled to at least one of the seating device of the Ferris wheel.

37. The Ferris wheel system of claim 34, wherein at least one of the water interaction devices is substantially offset from at least one of the seating devices such that water released from at least one of the water interaction devices is inhibited from contacting participants during use.

38. The Ferris wheel system of claim 34, wherein at least one of the water interaction devices comprises a paddle.

39. The Ferris wheel system of claim 34, further comprising a braking system configured to inhibit rotation of the Ferris wheel during use.

40. A water Ferris wheel system, comprising:

a Ferris wheel;

one or more water interaction devices coupled to the Ferris wheel, wherein the Ferris wheel defines a first plane, and wherein at least one of the water interaction devices is oriented in a second plane, and wherein the first and second planes are substantially parallel, and wherein the second plane is laterally displaced from the first plane; and a water supply system for directing a water stream onto at least one of the water interaction devices during use;

wherein the Ferris wheel is configured to rotate about a central axis in response to the force imparted by the water stream upon at least one of the water interaction devices.

41. The Ferris wheel system of claim 40, wherein the water supply system is configured to direct water onto at least one of the water interaction devices at a location above the central axis during use.

42. The Ferris wheel system of claim 40, wherein the water supply system is configured to direct water onto at least one of the water interaction devices at a location substantially even with the central axis during use.

43. The Ferris wheel system of claim 40, wherein the water source comprises a conduit, a water regulation system, and a reservoir, the water regulation system being disposed between the reservoir and an opening of the conduit, and wherein water flows out of the opening of the conduit to form the water stream.

44. The Ferris wheel system of claim 40, further comprising one or more seating devices coupled to the Ferris wheel, wherein at least one of the water interaction devices is substantially offset from at least one of the seating devices such that water released from at least one of the water interaction devices is inhibited from contacting participants during use.

45. The Ferris wheel system of claim 40, wherein at least one of the water interaction devices comprises a paddle.

46. The Ferris wheel system of claim 40, further comprising a braking system configured to inhibit rotation of the Ferris wheel during use.

47. A water Ferris wheel system, comprising:

a central axle member;

a support member coupled to the central axle member, wherein the support member is rotatable about the central axle member in a substantially vertical plane during use;

a base support structure, wherein the central axle member is coupled to the base support structure such that the support member is substantially suspended above the ground;

a plurality of axle members positioned about the support member during use;

a plurality of seating devices for holding participants during use, the seating devices coupled to the axle members during use;

a plurality of water interaction devices for imparting a force to the support member during use; and a water source for supplying a water stream to the water interaction devices during use;

wherein a support member is configured to rotate about a central axle member in response to the force imparted by the water interaction devices during use.

48. The Ferris wheel system of claim 47, wherein the water supply system is configured to direct water onto at least one of the water interaction devices at a location above the central axis during use.

49. The Ferris wheel system of claim 47, wherein at least one of the water interaction devices is substantially offset from at least one of the seating devices such that water released from at least one of the water interaction devices is inhibited from contacting participants during use.

50. The Ferris wheel system of claim 47, wherein at least one of the water interaction devices comprises a paddle.

51. The Ferris wheel system of claim 47, further comprising a braking system configured to inhibit rotation of the Ferris wheel during use.

52. A method for powering a Ferris wheel with water, comprising:

directing a water stream from a water source to a plurality of water interaction devices disposed on the Ferris wheel;

interacting at least a portion of the water stream with the water interaction devices, wherein interaction of the water stream with the water interaction devices causes rotation of the Ferris wheel; and releasing at least a portion of the water stream from the water interaction devices through an opening in at least one of the water interaction devices as the Ferris wheel rotates.

53. The method of claim 52, wherein directing the water stream comprises pumping water through a conduit from the water source to the water interaction devices.

54. The method of claim 52, wherein the water interaction devices communicate with seating devices of the Ferris wheel, and further comprising passing water from the water interaction devices to the seating devices such that the water contacts the participants.

55. The method of claim 52, further comprising collecting at least a portion of the released water stream in a reservoir located under the Ferris wheel and recycling at least a portion of the water stream to the water interaction devices.

56. The method of claim 52, wherein at least a portion of the water stream is directed to the water interaction devices at a location proximate an apex of the Ferris wheel.

57. The method of claim 52, wherein at least a portion of the water stream is directed to the water interaction devices at a location approximately level with a central axis of the Ferris wheel.

58. The method of claim 52, further comprising directing at least a portion of the water stream to the water interaction devices at a location below the Ferris wheel.

59. The method of claim 52, wherein the water interaction devices comprise one or more receptacles, and further comprising substantially completely filling at least one receptacle with water at a location proximate an apex of the Ferris wheel, and further comprising substantially gradually releasing the water from at least one of the receptacles as the receptacles move from the apex of the Ferris wheel to a lower portion of the Ferris wheel such that substantially all of the water is released from at least one of the receptacles by a time that at least one of the receptacles is located at a lower portion of the Ferris wheel.

60. The method of claim 52, further comprising controlling a flow rate of the water stream, wherein a rate of rotation of the Ferris wheel is a function of the flow rate of the water stream to the water interaction devices.

61. The method of claim 52, further comprising reducing a speed of rotation of the Ferris wheel, wherein the speed of rotation is reduced by reducing a flow of the water stream to the water interaction devices.

62. The method of claim 52, wherein the Ferris wheel further comprises a braking system, and further comprising reducing a speed of rotation of the Ferris wheel by reducing a flow of the water stream to the water interaction devices and by applying a braking force from the braking system to the Ferris wheel.

63. The method of claim 52, further comprising increasing a speed of rotation of the Ferris wheel, wherein the speed of rotation is increased by increasing a flow of the water stream to the water interaction devices.

64. A method of constructing a water Ferris wheel system, comprising:

coupling one or more water interaction devices to a Ferris wheel;

coupling one or more seating devices to hold participants during use to the Ferris wheel; and coupling a water supply system to a water Ferris wheel system for directing a water stream onto at least one of the water interaction devices to the Ferris wheel;

wherein the Ferris wheel is configured to rotate about a central axis in response to the force imparted by the water stream upon at least one of the water interaction devices.

65. The method of claim 64, wherein the water source comprises a conduit, a water regulation system, and a reservoir, and further comprising:

positioning the conduit proximate at least one of the water interaction devices such that water passing through an opening of the conduit contacts at least one of the water interaction devices;

coupling the conduit to the reservoir; and positioning the water regulation system between the reservoir and the opening of the conduit.

66. The method of claim 65, further comprising positioning the reservoir proximate at least one of the water interaction devices such that the reservoir collects water from at least one of the water interaction devices.

67. The method of claim 64, wherein coupling at least one of the water interaction devices to the Ferris wheel comprises attaching at least one of the water interaction devices to at least one seating device of the Ferris wheel.

68. The method of claim 64, wherein coupling at least one of the water interaction devices to the Ferris wheel comprises positioning at least one of the water interaction devices such that the water interaction device is substantially offset from at least one of the seating devices.

69. The method of claim 64, wherein coupling at least one of the water interaction devices to the Ferris wheel comprises positioning at least one of the water interaction devices between at least one of the seating devices and a central axis of the Ferris wheel.

70. The method of claim 64, further comprising coupling a braking system to the Ferris wheel, wherein the braking system is configured to inhibit rotation of the Ferris wheel during use.

71. The method of claim 64, wherein the Ferris wheel defines a first plane, and wherein coupling at least one of the water interaction devices to the Ferris wheel comprises positioning the water interaction devices in a second plane, and wherein the first and second planes are substantially parallel, and wherein the second plane is laterally displaced from the first plane.

72. A water Ferris wheel system, comprising:

a Ferris wheel;

one or more water interaction devices coupled to the Ferris wheel; and a water supply system for directing a water stream onto at least one of the water interaction devices during use;

wherein the Ferris wheel is configured to rotate about a central axis in response to the force imparted by the water stream upon at least one of the water interaction devices, and wherein at least one of the water interaction devices comprises one or more openings for releasing the water during use.

73. The Ferris wheel system of claim 72, wherein the water supply system comprises a conduit, a water regulation system, and a reservoir, the water regulation system being disposed between the reservoir and an opening of the conduit, and wherein water flows out of the opening of the conduit to form the water stream.

74. The Ferris wheel system of claim 73, wherein the reservoir is configured to collect water from at least one of the water interaction devices.

75. The Ferris wheel system of claim 72, further comprising one or more seating devices coupled to the Ferris wheel, wherein at least one of the water interaction devices is coupled to at least one of the seating devices.

76. The Ferris wheel system of claim 72, wherein the Ferris wheel defines a first plane, and wherein at least one of the water interaction devices is oriented in a second plane, and wherein the first and second planes are substantially parallel, and wherein the second plane is laterally displaced from the first plane.

77. A method of constructing a water Ferris wheel system, comprising:

coupling one or more water interaction devices to a Ferris wheel, wherein the Ferris wheel defines a first plane, and wherein coupling at least one of the water interaction devices to the Ferris wheel comprises positioning the water interaction devices in a second plane, and wherein the first and second planes are substantially parallel, and wherein the second plane is laterally displaced from the first plane; and coupling a water supply system to a water Ferris wheel system for directing a water stream onto at least one of the water interaction devices to the Ferris wheel;

wherein the Ferris wheel is configured to rotate about a central axis in response to the force imparted by the water stream upon at least one of the water interaction devices.

78. The method of claim 77, wherein the water source comprises a conduit, a water regulation system, and a reservoir, and further comprising:

positioning the conduit proximate at least one of the water interaction devices such that water passing through an opening of the conduit contacts at least one of the water interaction devices;

coupling the conduit to the reservoir; and positioning the water regulation system between the reservoir and the opening of the conduit.

79. The method of claim 77, further comprising coupling one or more seating devices to the Ferris wheel and wherein coupling at least one of the water interaction devices to the Ferris wheel comprises attaching at least one of the water interaction devices to at least one seating device of the Ferris wheel.

80. The method of claim 77, further comprising coupling one or more seating devices to the Ferris wheel and wherein coupling at least one of the water interaction devices to the Ferris wheel comprises positioning at least one of the water interaction devices such that the water interaction device is substantially offset from at least one of the seating devices.

81. The method of claim 77, further comprising coupling one or more seating devices to the Ferris wheel and wherein coupling at least one of the water interaction devices to the Ferris wheel comprises positioning at least one of the water interaction devices between at least one of the seating devices and a central axis of the Ferris wheel.

* * * * *